US005103711A

United States Patent [19]

Iwase

[11] Patent Number: 5,103,711

[45] Date of Patent: Apr. 14, 1992

[54] MUSICAL SOUND WAVEFORM GENERATOR HAVING A CARRIER SIGNAL AND A MODULATION SIGNAL MIXED AT A CONTROLLED MIXING RATIO

[75] Inventor: Hiroshi Iwase, Tokyo, Japan

[73] Assignee: Casio Computer Co., Ltd., Tokyo, Japan

[21] Appl. No.: 492,664

[22] Filed: Mar. 12, 1990

[30] Foreign Application Priority Data

| | | | |
|---|---|---|---|
| Mar. 13, 1988 | [JP] | Japan | 1-60532 |
| Mar. 13, 1989 | [JP] | Japan | 1-60530 |
| Mar. 13, 1989 | [JP] | Japan | 1-60531 |
| Mar. 15, 1989 | [JP] | Japan | 1-62400 |
| May 17, 1989 | [JP] | Japan | 1-123375 |

[51] Int. Cl.[5] ..... G10H 1/057; G10H 1/08

[52] U.S. Cl. ..... 84/660; 84/663

[58] Field of Search ..... 84/622-625, 84/627, 659-661, 663, 692-700, 702, 703, 735, 736, 738

[56] References Cited

U.S. PATENT DOCUMENTS

| | | | |
|---|---|---|---|
| 4,018,121 | 4/1977 | Chowning . | |
| 4,643,066 | 2/1987 | Oya | 84/624 |
| 4,748,888 | 6/1988 | Oya | 84/623 X |

FOREIGN PATENT DOCUMENTS 61-12279 4/1986 Japan .

*Primary Examiner*—Stanley J. Witkowski

*Attorney, Agent, or Firm*—Frishauf, Holtz, Goodman & Woodward

[57] ABSTRACT

A carrier signal generating unit generates a carrier signal. A modulation signal generating unit generates a modulation signal. A mixing controlling unit controls, in mixing the modulation signal with the carrier signal, a mixing ratio of the modulation signal to the carrier signal and outputs a mixed signal in which the modulation signal and the carrier signal are mixed in the controlled mixing ratio. A waveform outputting unit has a predetermined functional relation between its input and output and receives the mixed signal from the mixing controlling unit to provide a modulated musical sound waveform. In this case, the carrier signal and the modulation signal are set such that a desired musical sound waveform is obtained from the waveform outputting unit when the mixing ratio of the modulation signal to the carrier signal is controlled by the mixing controlling unit to a predetermined mixing ratio. And the present invention provides a method of setting the carrier signal and the modulation signal.

37 Claims, 38 Drawing Sheets

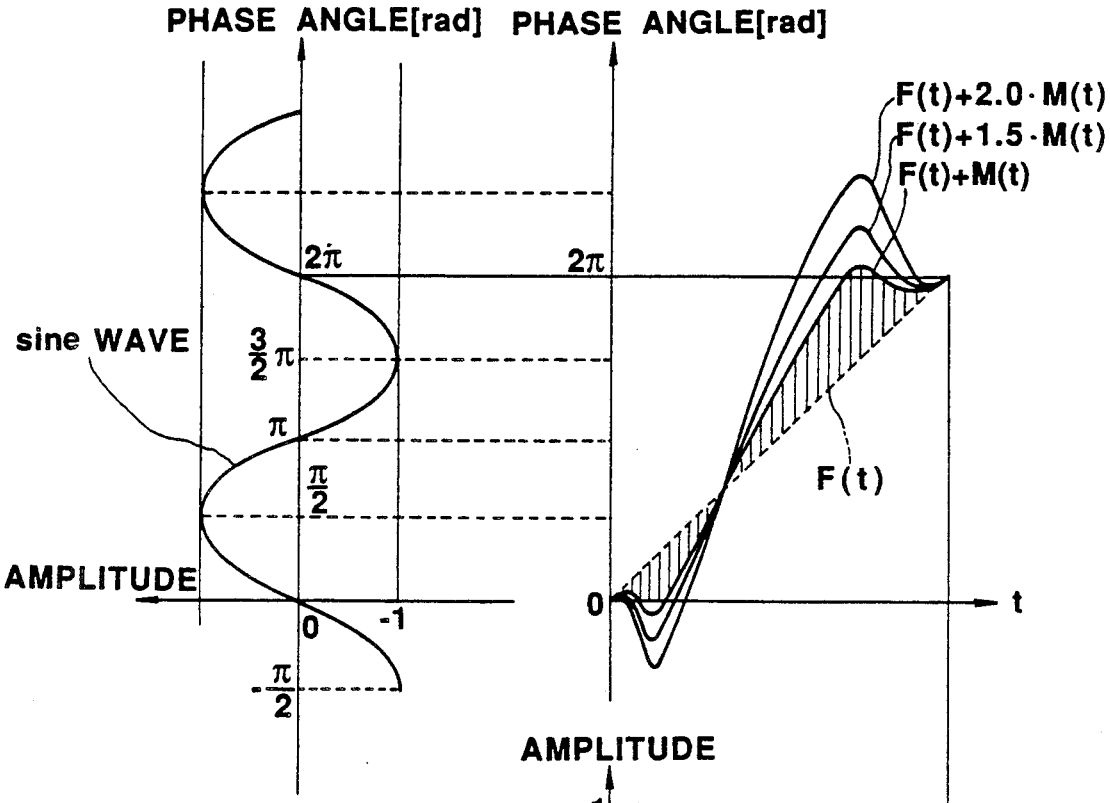
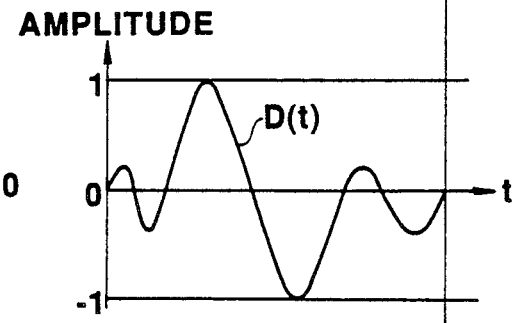
FIG. 5 (a-1)
I = 1.0
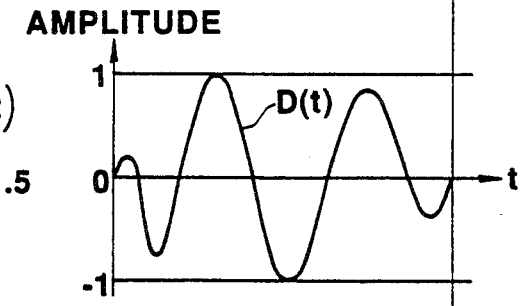
FIG. 5 (a-2)
I = 1.5
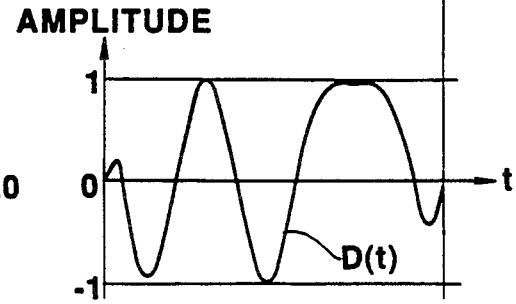
FIG. 5 (a-3)
I = 2.0

WAVEFORM PERIOD A
WAVEFORM PERIOD B
FIG. 9 (a) STRT
FIG. 9(b) CLK#1
FIG. 9(c) d
FIG. 9(d) ADD#1
FIG. 9(e) IB
FIG. 9 (f) Q
FIG. 9(g) EOR
FIG. 9(h) CLK#2
FIG. 9( i ) ADD#2
FIG. 9( j ) K (PERIOD)
FIG. 9(k) F(t)
FIG. 9( l ) M(t)
FIG. 9(m) I
FIG. 9(n) D(t)
FIG. 9(o) OUT(t)
t1
t2
t3
t4
t5
t6
t7
t8
t9
t10
t11
t12
t13
t14
t15
t16
t17
t18
t19
b
b+1
1
K(PERIOD A)
K(PERIOD B)

I(t) = 0.0
Wc=
Wc+WM
e(A=1)

I(t) = 0.3
Wc
Wc+WM

I(t) = 0.6
Wc
Wc+WM

I(t) = 1.0
Wc
Wc+WM
2π
π
0
ωct
1
-1

(a) ωct0 – ωct9

(b) ωct10

(c) A0 – A9

(d) D0 – D9

(e) Wc0 – Wc8

(f) Wc0 – Wc10

FIG.22(a) ωct0–ωct8

FIG.22(b) ωct9

FIG.22(c) ωct10

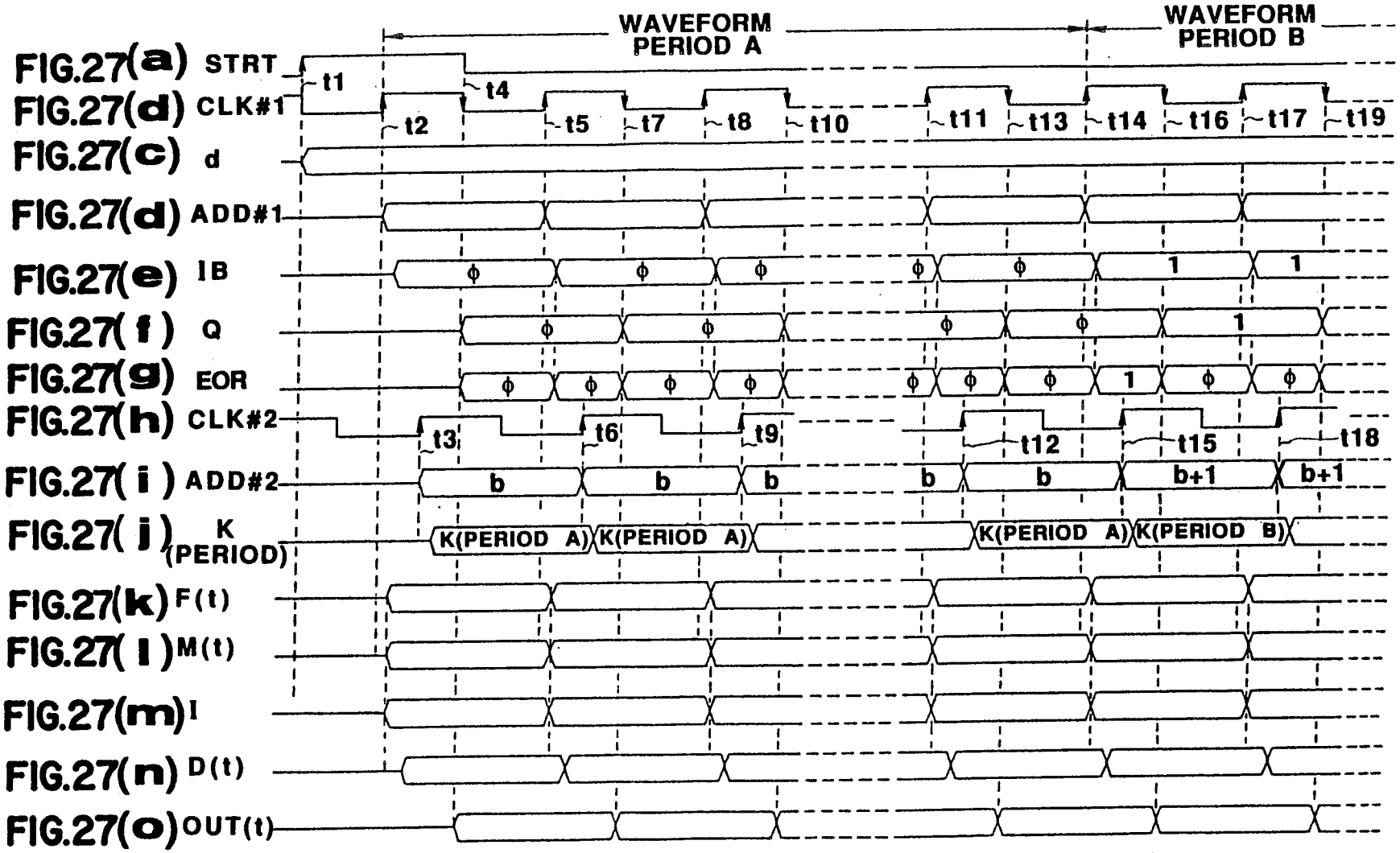
WAVEFORM PERIOD A
WAVEFORM PERIOD B
FIG.27(a) STRT
FIG.27(d) CLK#1
FIG.27(c) d
FIG.27(d) ADD#1
FIG.27(e) IB
FIG.27(f) Q
FIG.27(g) EOR
FIG.27(h) CLK#2
FIG.27(i) ADD#2
FIG.27(j) K (PERIOD)
FIG.27(k) F(t)
FIG.27(l) M(t)
FIG.27(m) I
FIG.27(n) D(t)
FIG.27(o) OUT(t)
t1
t2
t3
t4
t5
t6
t7
t8
t9
t10
t11
t12
t13
t14
t15
t16
t17
t18
t19
K(PERIOD A)
K(PERIOD B)
b
b+1
1
Φ

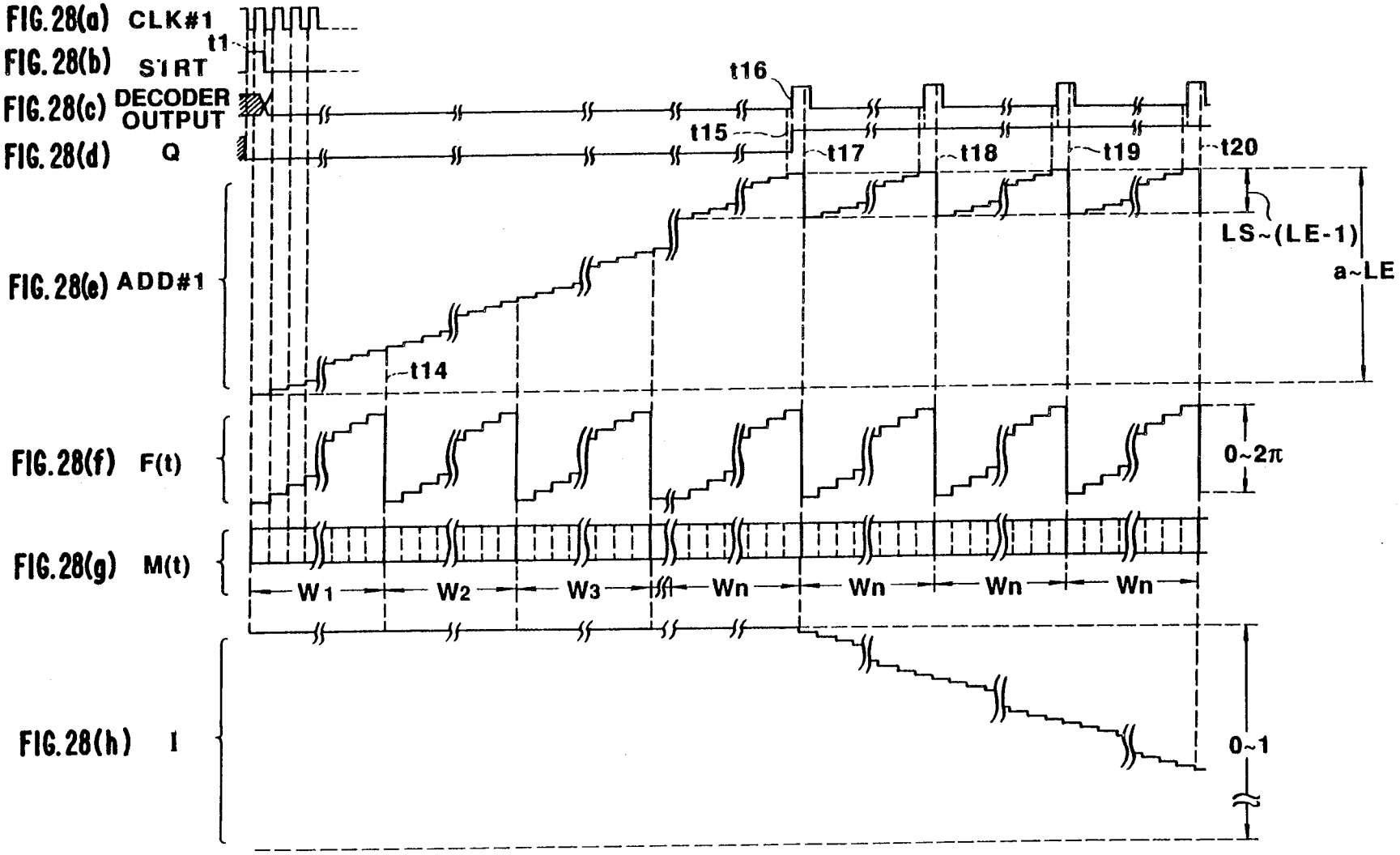
FIG. 28(a) CLK#1
FIG. 28(b) SIRT
FIG. 28(c) DECODER OUTPUT
FIG. 28(d) Q
FIG. 28(e) ADD#1
FIG. 28(f) F(t)
FIG. 28(g) M(t)
FIG. 28(h) I
t1
t14
t15
t16
t17
t18
t19
t20
LS~(LE-1)
a~LE
0~2π
0~1
W1
W2
W3
Wn
Wn
Wn
Wn
Wn

MUSICAL SOUND WAVEFORM GENERATOR HAVING A CARRIER SIGNAL AND A MODULATION SIGNAL MIXED AT A CONTROLLED MIXING RATIO

BACKGROUND OF THE INVENTION

1. Field of the Invention

The present invention relates to a musical sound waveform generator for use in an electronic musical instrument and, more particularly, to a musical sound waveform generator for generating musical sound waveforms containing various harmonic components by use of modulation.

2. Description of the Prior Art

The advances in digital signal processing techniques have enabled a PCM type of electronic musical instrument which is a first prior art of an electronic musical instrument using digital processing. The PCM type of electronic musical instrument can generate musical sound waveforms simple in characteristics. In addition, the PCM type of electronic musical instrument can directly sample sounds generated by conventional or traditional musical instruments, sounds generated by humans and sounds generated in the natural world (hereinafter they are referred to as natural sounds) to store them and reproduce them at arbitrary pitches.

A second prior art of an electronic musical instrument capable of generating musical sound waveforms having various kinds of complex characteristics in a digital manner is an electronic musical instrument using an FM method which is disclosed in a Japanese Examined Patent Publication No. 54-33525 or a Japanese Unexamined Patent Publication No. 50-12640.

This type of electronic musical instrument generates a musical sound waveform e which is given by $$e=A\cdot sin\{\omega ct+I(t)sin\omega mt\} \quad \text{(A)}$$

By selecting a carrier waveform frequency $\omega_c$ and a modulation waveform frequency $\omega_m$ for modulating the carrier waveform frequency $\omega_c$ in an appropriate ratio and setting a time-varying modulation index I(t) and a time-varying amplitude coefficient A, it is possible to obtain very individual synthetic musical sounds having complex and time -varying harmonic characteristics.

A third prior art of an electronic musical instrument, which is improved over the FM type of electronic musical instrument, is disclosed in a Japanese Examined Patent Publication No. 61-12279. This type of electronic musical instrument employs an arithmetic operation using a triangular waveform in place of the arithmetic operation using a sine waveform as indicated in equation (A). Namely, an output musical sound waveform e is given by $$e=A\cdot T\{\alpha+I(t)T(\theta)\} \quad \text{(B)}$$

where $T(\theta)$ is a triangular function which is produced by a modulation wave phase angle $\theta$. By advancing a carrier wave phase angle $\alpha$ and the modulation wave phase angle $\theta$ in an appropriate proceeding speed ratio and setting a modulation index I(t) and the amplitude coefficient A as in the case of the first prior art, it is possible to synthesize a musical sound waveform.

In view of such prior arts as described above, electronic musical instruments have been called upon recently to have a capability of dynamically generating various types of sounds including musical sounds which are very peculiar to electronic musical instruments and natural sounds.

However, the PCM type of electronic musical instrument, which is the first prior art, is very good at generating natural sounds themselves but is poor at processing the natural sounds so as to obtain individual tone colors.

That is, with the PCM type of electronic musical instrument, in order to continuously change an original sound to a sine waveform by way of example, digital filters or analog filters are used to eliminate harmonic components of the original sound. The digital filters will inevitably become relatively large in circuit scale. Furthermore, to vary the characteristics of the digital filters with a time-varying function such as an envelope, it is required to store filter coefficients corresponding to the filter characteristics in addition to data on natural sounds. With the analog filters, on the other hand, desired characteristics are difficult to obtain. In addition, a time-division operation for generating a plurality of sounds simultaneously cannot be performed.

Furthermore, where, in contrast to the above, it is desired to continuously change an original sound to a musical sound with a more complex harmonic structure, the system using filters for eliminating harmonic components of the original sound cannot produce new harmonic components.

A musical sound generated by an actual musical instrument such as a piano contains not only a fundamental wave component having a pitch frequency but also a plurality of harmonic components having frequencies which are integral multiples of the pitch frequency. The musical sound can contain up to fairly high harmonic components. In addition, the musical sound may contain harmonic components whose frequencies are non-integral multiples of the pitch frequency. The proportion in which each of the harmonic components is contained in a musical sound differs according to the kinds of musical instruments, and there are as many harmonic characteristics as there are the kinds of musical instruments. In this way musical sounds with a rich tone quality are produced by virtue of harmonic components inherent in each musical instrument. The second or third prior art electronic musical instrument based on the FM method is very good at processing of the harmonic structure of a musical sound to be generated. However, it is difficult to set optimum parameters for generating a desired musical sound peculiar to each musical instrument.

That is, since the second prior art is based on sine wave modulation, a musical sound generated in accordance with equation (A) has its frequency components concentrated on lower harmonic components (low in frequency). Thus, even if the modulation index I(t) is made large in value for a deep modulation, higher harmonic components (high in frequency) cannot be produced well. With the second prior art, therefore, musical sounds with rich tone qualities as in actual musical sounds cannot be generated and the tone qualities of musical sounds that can be generated are limited.

In contrast to the second prior art, the third prior art using equation (B) is based on a modulation system using a triangular wave, which contains many harmonics from the beginning, and thus can easily generate a musical sound which definitely contains up to higher harmonic components for the time being. In order to obtain a desired musical sound as an output, it is difficult to set the proceeding speed ratio of the carrier wave phase angle $\alpha$ to the modulation wave phase angle $\theta$, the modulation index I(t) and the amplitude coefficient A in equation (B) most appropriately. In addition to this, the third prior art, which drives a triangular wave with a triangular wave, cannot realize a process during which the harmonic components of a musical sound sequentially decay beginning with the highest harmonic component and finally only a single sine wave component corresponding to the pitch frequency remains while the musical sound gradually decays after it has been generated.

Furthermore, in a case where a musical sound waveform to be obtained varies with time after its generation, it is difficult for each of the second and third prior arts to set parameters so as to produce a desired waveform varying with time.

For example, a piano can generate a musical sound which contains many higher harmonic components and which provides a feeling of hardness when a key is depressed strongly and a musical sound which contains almost only a single sine wave component and which provides a feeling of softness if the key is depressed very weakly. Also, the piano can generate musical sounds which contain many higher harmonic components when depressing low-tone keys and musical sounds which have few harmonic components by depressing high-tone keys. In this way the characteristics of musical sounds can be controlled in accordance with performance information at the time of performance operation. However, since the first prior art has difficulty in controlling harmonic components as described above, the above effects are also difficult to realize. Also, with the second prior art, even if the modulation index I(t) can be controlled to a large value, there are limitations on the level of higher harmonic components that can be generated. Thus, it is impossible to generate a musical sound which contains higher harmonic components richly according to a performance operation. Moreover, with the third prior art, in a case where the key is operated very weak, even if the modulation index I(t) can be controlled to a small value (for example, 0) according to such performance information, it is impossible to control so as to allow a single sine wave component to be generated. Namely, the third prior art has a problem that a musical sound with a feeling of softness, which contains only a single sine wave component, cannot be generated according to a performance operation.

With the electronic musical instrument of the PCM type, the so-called loop reproduction is generally performed in which a specific waveform period of a natural sound is reproduced from a memory repeatedly in order to economize the storage capacity or to reproduce a sustained sound. However, the mere loop reproduction will always reproduce musical sounds of the same characteristics of the waveform period. In this case, even if the amplitude envelopes are allowed to be varied, monotonous musical sounds will result because tone colors themselves do not vary. Having difficulty in processing natural sounds as described above, the PCM type of electronic musical instrument has difficulty in adding tone color variations at the time of the loop reproduction as well.

In general, acoustic pianos and so on have a considerable difference in tone color between when low note keys are depressed and when high-note keys are depressed or when keys are depressed strongly and when keys are depressed weakly. To realize such a difference in tone color by means of the PCM system, data have to be stored for each of tone colors, causing a considerable increase in cost. Having a difficulty in processing the characteristics of musical sounds as described above, the PCM system also has a problem that it is further difficult to generate a musical sound having its characteristic varied continuously between high and low frequency ranges by way of example.

SUMMARY OF THE INVENTION

An object of the present invention is to generate natural sounds faithfully with small-scale circuits, to control harmonic components of the natural sounds easily and continuously and to synthesize a musical sound of a sine wave and the like.

Another object of the present invention is to control harmonic components on the basis of performance information generated according to a performance operation.

Still another object of the present invention is to realize a loop reproduction and to arbitrarily control musical sound characteristics during a loop reproduction operation.

A further object of the present invention is to generate a plurality of natural sounds whose characteristics continuously vary according to a performance state and the like.

First, a first aspect of the present invention that is the most basic aspect will be described. The first aspect is based on a musical sound waveform generator for generating a musical sound waveform according to a mixed signal obtained by mixing a modulation signal with a carrier signal.

The musical sound waveform generator is provided with a carrier signal generating unit for generating a carrier signal. For example, the carrier signal generating unit receives a carrier wave phase angle signal which repeats an operation in which a phase angle linearly increases with time within its cycle period and converts it to a carrier signal (period data) to be outputted in accordance with a predetermined function. The unit may be composed of a ROM using the carrier wave phase angle signal as its address input. The characteristic of the carrier signal will be described later.

A modulation signal generating unit for generating a modulation signal is further provided, for example, the modulation signal generating unit receives the carrier wave phase angle signal and converts it to a modulation signal (phase difference data) to be outputted in accordance with a predetermined function. The unit may be composed of a ROM which receives the carrier wave phase angle signal as its address signal. The characteristic of the modulation signal will be described later.

A mixing controlling unit is further provided, which controls, in mixing the modulation signal with the carrier signal, a mixing ratio of the modulation signal to the carrier signal and outputs a mixed signal in which the modulation signal and the carrier signal are mixed in the controlled mixing ratio. For example, the unit may comprise a multiplier for multiplying the modulation signal by a modulation index which may vary from 0 to about 2 and an adder for adding an output signal of the multiplier and the carrier signal together to provide a mixed signal. The mixing ratio may vary with time after a musical sound waveform has been generated. That is, the unit may be arranged so that a different modulation index may be multiplied in the multiplier at each of times elapsed after the initiation of tone generation of the musical sound waveform.

A waveform outputting unit is further provided which has a predetermined functional relation between its input and output and receives the mixed signal from the mixing controlling unit to provide a modulated musical sound waveform. For example, this unit may be a decoder for converting the mixed signal to the musical sound waveform in accordance with the functional relation Alternatively, the unit may be composed of a ROM which receives the mixed signal as its address signal.

In this case the carrier signal and the modulation signal are set such that a desired musical sound waveform (hereinafter referred as to the second desired musical sound waveform) is obtained from the waveform outputting unit when the mixing ratio of the modulation signal to the carrier signal is controlled by the mixing controlling unit to a predetermined mixing ratio. The predetermined mixing ratio (hereinafter referred to as the second predetermined mixing ratio) has a value of, for example, 1. The musical sound waveform may be either a waveform which is repeated at regular periods or a waveform which varies every fixed period or every arbitrary period. The carrier signal and the modulation signal are set as repetitive waveforms or continuous waveforms so as to correspond to such musical sound waveforms.

According to the present invention, there is provided a method of setting the carrier signal and the modulation signal, which comprises the following steps.

First, in a carrier signal defining step, a carrier signal corresponding to each time within a period of the second desired musical sound waveform is defined. The carrier signal in this case may be period data which linearly vary in value with time.

In a repetitive controlling step after the carrier signal has been defined as described above, the following amplitude calculating step, input value calculating step, subtracting step and modulation signal calculating step are repeated while a time (hereinafter referred to as a specified time) is varied within the period of the second desired musical sound waveform, to thereby calculate a modulation signal corresponding to each time within the period of the second desired musical sound waveform First, in the amplitude calculating step, a value corresponding to the amplitude value corresponding to a specified time on the second desired musical sound waveform is calculated.

Next, in the input value calculating step, about the predetermined functional relation, an input value of the function corresponding to an output value of the function which is equal to the value found by the amplitude calculating step is calculated.

Subsequently, in the subtracting step, a value of the carrier signal defined by the carrier signal defining step corresponding to the specified time is subtracted from the input value found by the input value calculating step.

Finally, in the modulation signal value calculating step, a value of the modulation signal corresponding to the specified time is calculated by dividing the result of calculation by the subtracting step by the second predetermined mixing ratio. It is to be noted that, when the second predetermined mixing ratio has a value of 1, the process of dividing is not needed.

In setting the carrier signal and modulation signal in accordance with the above setting method, it is not necessarily required that all waveforms extending from when the generation of the second desired musical sound waveform is initiated until it fades away be processed by one setting operation. Alternatively, the second desired musical sound waveform may be divided into a plurality of waveform periods of equal lengths or different lengths and the setting operation may be performed for each of the waveform periods. In this case, the carrier signal and modulation signal are set for each of the waveform periods. In the carrier signal defining step, it is also possible to define a carrier signal which repeats itself with the same characteristic every waveform period.

In addition to the above, the first aspect of the present invention may be provided with the following condition that the musical sound waveform outputted from the waveform outputting unit becomes a sine wave, a cosine wave or another predetermined functional waveform when the mixing ratio of the modulation signal is controlled to another predetermined mixing ratio other than the second predetermined mixing ratio by the mixing controlling unit. The mixing ratio (hereinafter referred to as the first predetermined mixing ratio) is 0 for example. The functional waveform may be a triangular waveform, a sawtooth waveform or a rectangular waveform and so on. Alternatively, the musical sound waveform outputted from the waveform outputting unit need not be a sine wave, cosine wave or predetermined functional waveform but a natural sound of a piano or the like when the mixing ratio of the modulation signal is controlled to the first predetermined mixing ratio.

In addition, according to the first aspect, an amplitude envelope controlling unit may be provided, which varies the amplitude envelope characteristic of the musical sound waveform outputted from the waveform outputting unit with time. The unit may be a multiplier which multiplies the musical sound waveform by an amplitude coefficient which may vary from 0 to 1 with time in accordance with a predetermined amplitude envelope function after initiation of tone generation of the musical sound waveform. The unit may be a unit which multiplies the amplitude of an output from the waveform outputting unit by a predetermined coefficient so as to agree with the desired musical sound waveform.

According to the first aspect of the present invention, as described above, a musical sound waveform outputted from the waveform outputting unit comes to have a characteristic resulting from converting of a carrier signal outputted from the carrier signal generating unit in accordance with a predetermined function, and the carrier signal is mixed with a modulation signal in the mixing controlling unit to thereby impart a characteristic resulting from modulation by the modulation signal to the musical sound waveform.

In particular, the present invention is arranged such that a second desired musical sound waveform is outputted from the waveform outputting unit when the mixing ratio of the modulation signal to the carrier signal is controlled to the second predetermined mixing ratio by the mixing controlling unit. If, therefore, the mixing ratio is previously set at the second predetermined mixing ratio in the mixing controlling unit, such a second desired musical sound waveform as obtained by a traditional musical instrument will be obtained. A conventional modulation type of musical sound waveform generator is good at handling the harmonic structure of a musical sound waveform to be sounded but has difficulty in setting optimum parameters needed to obtain a desired musical sound waveform peculiar to each of the traditional musical instruments. In contrast to the conventional type, the present invention enables the optimum setting of the carrier signal and modulation signal for obtaining a desired musical sound waveform by the use of the setting method described above. Since the modulation type of musical sound waveform generator of the present invention enables the generation of a desired musical sound waveform, only continuous varying of the mixing ratio from the second predetermined mixing ratio to another mixing ratio will produce a musical sound waveform which continuously varies from a second desired one to an arbitrary one.

Moreover, in the present invention, the predetermined functional relation and the carrier signal can be set such that a musical sound waveform becomes a predetermined first desired musical sound waveform when the first predetermined mixing ratio is specified other than the second predetermined mixing ratio by the mixing controlling unit. Therefore, a musical sound waveform which continuously varies from the first desired one to the second desired one will be produced by continuous varying of the mixing ratio from the first predetermined one to the second predetermined one. In particular, by supposing that the first desired musical sound waveform is a sine wave, a cosine wave or a predetermined functional the wave, following advantage is obtained.

That is, if the mixing ratio is previously set at the first predetermined mixing ratio in the mixing controlling unit, a musical sound waveform consisting of a simple functional waveform such as a sine wave, a cosine wave and a rectangular wave can be generated.

If, during a performance, the mixing ratio is set at the second predetermined mixing ratio immediately after the initiation of tone generation and then is varied toward the first predetermined mixing ratio with time, the frequency characteristic of a musical sound waveform can gradually be varied so that at first it is the second desired musical sound waveform and it finally contains only a sine wave component. The mixing ratio may continuously be varied to the second predetermined mixing ratio or more so that a musical sound waveform varies from the second desired musical sound waveform to an individual musical sound waveform with a more complex harmonic structure. Alternatively, a musical sound waveform of a piano or a guitar can be naturally adopted as the first desired musical sound waveform For example, when a guitar sound waveform is adopted as the first desired musical sound waveform and a piano sound waveform is adopted as the second desired musical sound waveform, the tone color of the musical sound waveform to be generated can be continuously varied between the tone color of a guitar and the tone color of a piano by continuous varying of the mixing ratio of the modulation signal between the first predetermined one and the second predetermined one.

Moreover, in addition to the above operation, the amplitude envelope characteristic of a musical sound waveform outputted from the waveform outputting unit may be controlled by an amplitude envelope controlling unit so that it decays with time for example. In this case, a process in which the musical sound waveform gradually decays can be realized like actual traditional musical instruments.

In the first aspect, it is possible to divide a first or second desired musical sound waveform into a plurality of waveform periods and set a carrier signal and a modulation signal for each of the waveform periods. In this case, it is not necessarily required to divide the waveform in accordance with the pitch period of the first or second musical sound waveform The waveform has only to be divided with an appropriate period (e.g., every zero-crossing point), thus providing easy setting of carrier and modulation signals corresponding to the first or second desired waveform.

Next, a second aspect of the present invention will be explained. The second aspect is of a modulation type as is the first aspect and based on a musical sound waveform generator which controls the characteristic of a musical sound waveform in accordance with performance information produced by a performance operation. In this case, the performance information is, in the case of a keyboard musical instrument for example, tone pitch information indicating which key is depressed, velocity information indicating a velocity at which a key is depressed, after -touch information indicating a pressure applied to a key when depressed or tone range information indicating a key range in which a depressed key lies.

In the second aspect, a carrier signal generating unit, modulation signal generating unit and waveform outputting unit are the same as those in the first aspect.

A mixing controlling unit is provided, which controls, in mixing the modulation signal with the carrier signal, the mixing characteristic of the modulation signal to the carrier signal according to the performance information and outputs a mixed signal in which the modulation signal and the carrier signal are mixed in a mixing ratio based on the mixing characteristic. In this case, the modulation index is varied according to the performance information (for example, in the case of a keyboard musical instrument, tone pitch information, velocity information, after-touch information or tone range information) as in the first aspect.

According to the second aspect, by setting the mixing characteristic in the mixing controlling unit prior to a performance operation and varying it according to the performance information, i.e., velocity information or tone range information, it becomes possible to vary the frequency characteristic of a musical sound waveform generated in accordance with a performance operation. That is, if, during the performance, the mixing ratio is large when a key is depressed strongly and the mixing ratio is approximately equal to the first predetermined mixing ratio when the key is depressed weakly, then a state in which many higher harmonic components are contained and a state in which only a sine wave component is contained will be produced at discretion of a player. The mixing ratio may be varied with time so as to vary the frequency characteristic of a musical sound waveform with time. Moreover, if the rate of variations of the mixing ratio with time is controlled in accordance with the performance information, then the rate of variations of the frequency characteristic of the musical sound waveform with time will also be changed.

In this case, if modulation index I is varied according to the velocity information so that, for example, modulation index I has a large value when a key is depressed strongly (fast) and a small value approximately equal to 0 when the key is depressed weakly (slowly), then a state in which many higher harmonic components are contained and a state in which only a sine wave component is contained will arbitrarily be produced according to the key depressing velocities. Likewise, if modulation index I is varied according to the tone range information so that, for example, modulation index I has a large value when a key within a low tone range is depressed and a small value approximately equal to 0 when a key within a high tone range is depressed, then a state in which many higher harmonic components are contained and a state in which only a sine wave component is contained will arbitrarily be produced according to the tone ranges.

Subsequently, a third aspect of the present invention is based on a modulation type of musical sound waveform generator as is the first aspect.

In the third aspect, a carrier signal generating unit, a modulation signal generating unit and a waveform outputting unit are the same in arrangement as those in the first aspect. Also, a mixing controlling unit is the same as that of the first aspect except the mixing ratio therein can vary with time which will be described later.

The carrier signal generating unit and modulation signal generating unit generate a carrier signal and a modulation signal which allow a second desired musical sound waveform to be outputted from a waveform outputting unit when the mixing ratio of the modulation signal is controlled to the second predetermined mixing ratio by the mixing controlling unit. This is the same as the first aspect. Moreover, the carrier signal generating unit and the modulation signal generating unit also have a function of repeatedly generating an arbitrary signal period of the carrier signal and modulation signal so that an arbitrary waveform period of the musical sound waveform may repeatedly be outputted from the waveform outputting unit. The mixing controlling unit varies the mixing ratio with time in synchronism with the repeated generating operation.

In the third aspect, an amplitude envelope controlling unit may further be provided which varies the amplitude envelope characteristic of the musical sound waveform outputted from the waveform outputting unit with time in synchronism with the repeated generating operation.

According to the third aspect, the carrier signal generating unit and the modulation signal generating unit repeatedly generate an arbitrary signal period of the carrier signal and modulation signal so that an arbitrary waveform period of the musical sound waveform may repeatedly be outputted from the waveform outputting unit. Thereby, the so -called loop reproduction operation is made possible.

In this case, if the mixing controlling unit sets the mixing ratio at the second predetermined mixing ratio before the initiation of the loop reproduction operation and varies the mixing ratio with time to approach the first predetermined mixing ratio after the initiation of the loop reproduction operation, the frequency characteristic of a musical sound waveform will gradually be controlled during the loop reproduction as well so that at first it is a second desired musical sound waveform and finally it is a first desired musical sound waveform, for example it contains only a sine wave component. As a result, a musical sound waveform rich in variations can be produced only by the carrier signal and modulation signal for an arbitrary waveform period. Thus, the storage capacity for the carrier signal and modulation signal can be saved, and the tone color can be prevented from becoming monotonous during the loop reproduction.

In addition to the above operation, by controlling the amplitude envelope characteristic of a musical sound waveform outputted from the waveform outputting unit so as to vary with time in synchronism with the loop reproduction operation, a process in which the musical sound waveform gradually decays can be realized like actual traditional musical instruments.

Subsequently, a fourth aspect of the present invention is based on a modulation type of musical sound waveform generator as is the first aspect.

In the fourth aspect, a carrier signal generating unit, a waveform outputting unit and a mixing controlling unit are the same in arrangement as those in the first aspect.

The fourth aspect is further provided with a modulation signal generating unit for selectively generating a plurality of modulation signals. The unit may be composed of a ROM which receives a carrier wave phase angle signal and converts it to a modulation signal to be outputted in accordance with a fixed function. The unit stores a plurality of functions. A select signal is applied to high-order address inputs of the ROM to select one of the functions and the carrier wave phase angle signal is applied to low-order address inputs of the ROM to selectively output a modulation signal. In this case, when the fourth aspect is applied to a keyboard musical instrument, a modulation signal is selectively generated which corresponds to performance information such as velocity information and key range information.

According to the fourth aspect, if the waveform generator is controlled and set so that a different one of the modulation signals is outputted in accordance with performance information and a musical sound waveform as obtained by an actual traditional musical instrument is obtained for each of modulation signals which corresponds to each of key ranges or key depressing velocities, then musical sounds will be produced which have various characteristics according to performance information.

Finally, a fifth aspect of the present invention is also based on a modulation type of musical sound waveform generator as is the first aspect.

In the fifth aspect, a carrier signal generating unit and a waveform outputting unit are the same in arrangement as those in the first aspect.

A modulation signal generating unit is provided which generates a plurality of modulation signals. The unit generates a plurality of modulation signals in parallel.

Furthermore, a composite modulation signal outputting unit is provided which mixes the plurality of modulation signals in arbitrary proportions to output a composite modulation signal. The proportions are controlled according to performance information such as key range information and velocity information.

A mixing controlling unit is provided which mixes the composite modulation signal with a carrier signal and outputs the resulting mixed signal. This unit is substantially the same in arrangement as that in the first aspect.

In the fifth aspect, the carrier signal generating unit and modulation signal generating unit generate a carrier signal and each of modulation signals which allow each of predetermined second desired musical sound waveforms corresponding to each of the modulation signals to be outputted from the waveform outputting unit when each of the modulation signals is outputted from the composite modulation signal outputting unit as it is as each of the composite modulation signals and the mixing ratio of each of the composite modulation signals is controlled to each of second predetermined mixing ratios for each of the modulation signals by the mixing controlling unit. Each of the second predetermined mixing ratios may be the same for each of the modulation signals or vary from modulation signal to modulation signal.

In the fifth aspect, a setting is made first such that each of musical sound waveforms for each of key ranges or key depressing velocities as obtained by an actual traditional musical instrument is obtained corresponding to each of the modulation signals generated by the modulation signal generating unit. The composite modulation signal outputting unit outputs a composite modulation signal while controlling the mixing proportions of the modulation signals in accordance with performance information. By the use of the composite modulation signal, a musical sound waveform is outputted through the mixing controlling unit and waveform outputting unit as is the case with the first aspect.

Specifically, the modulation signal generating unit generates two modulation signals corresponding to musical sound waveforms for a high tone range and a low tone range of an actual traditional musical instrument. When information that a key on the high tone range side is depressed is obtained, the proportion of the modulation signal for the high tone range is made larger, while, when information that a key on the low tone range side is depressed is obtained, the proportion of the modulation signal for the low tone range is made larger. If information that a key in a middle tone range is depressed is obtained, the modulation signals for the high and low tone ranges are mixed in equal proportions. Thereby, a musical sound waveform can be obtained which has a characteristic very close to such a characteristic of an actual traditional musical instrument as continuously varies with tone ranges. The proportions of the modulation signals can also be controlled by velocity information on key depression.

In any of the first through fifth aspects of the present invention described above, the carrier signal generating unit, the modulation signal generating unit, the mixing controlling unit and the waveform outputting unit may be arranged to control a plurality of channels adapted for tone generation on a time-division basis to thereby produce a plurality of musical sound waveforms assigned to the respective channels in a polyphonic manner.

BRIEF DESCRIPTION OF THE DRAWINGS

Further objects and advantages of the present invention will be apparent to those skilled in the art from the following description of the preferred embodiments of the present invention with reference to the accompanying drawings in which:

FIGS. 5(*a*-1) to 5(*a*3) are diagrams illustrating a relation among the D(t), F(t) and M(t) when I is varied;

FIGS. 27(*a*) to 27(*o*) are timing diagrams for explaining the operation of the fourth embodiment;

FIG. 28(*a*) to 28(*h*) are timing diagrams for explaining the operation of the fourth embodiment at a time of the loop reproduction;

DESCRIPTION OF THE PREFERRED EMBODIMENTS

Hereinafter the embodiments of the present invention will be described with reference to the accompanying drawings.

The principle of a first embodiment of the musical sound waveform generator

Figure 1:
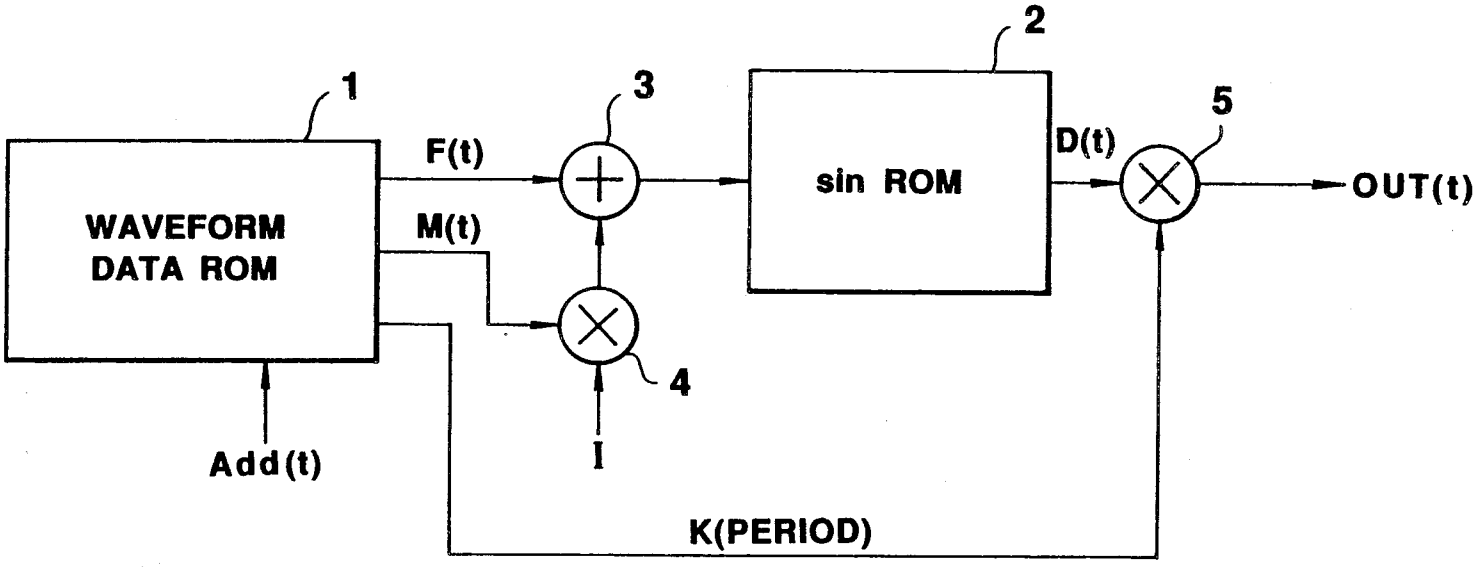
FIG. 1 is a diagram illustrating the principle of a first embodiment of a musical sound waveform generator according to the present invention.

FIG. 1 illustrates the principle of the first embodiment of the musical sound waveform generator of the present invention. The present embodiment is characterized in that an arbitrary waveform can be generated which corresponds to a musical sound waveform of any pitch period generated by a traditional musical instrument from the initiation of tone generation until the tone fades away, and the waveform characteristics can continuously be varied between the arbitrary waveform and a sine wave.

First, from a waveform data ROM 1, period data F(t), phase difference data M(t) and a normalization coefficient K(period) which has a fixed value for each of waveform periods (which will be described later) are read synchronously with one another in accordance with address data Add(t) which ascends with time. The phase difference data M(t)[rad] is multiplied by a modulation index I in a multiplier 4 and then added to the period data F(t)[rad] in an adder 3 so that phase angle data F(t)+I·M(t) is obtained, which is used to modulate a sine wave. The data is applied, as an address signal, to a sin ROM 2 storing sine wave data so that a sine wave is read modulated. A modulated output D(t) read from sin ROM 2 is multiplied by the normalization coefficient K(period) which has been read from waveform data ROM 1 for each of waveform periods in a multiplier 5 and then outputted as a waveform output OUT(t). Here it is to be noted that the maximum value of amplitude absolute values of sin waves stored in sin ROM 2 is normalized to 1.

The operation of the musical sound waveform generator of FIG. 1 based on the above principle will be described below.

Figures 2A, 2B, 2C:
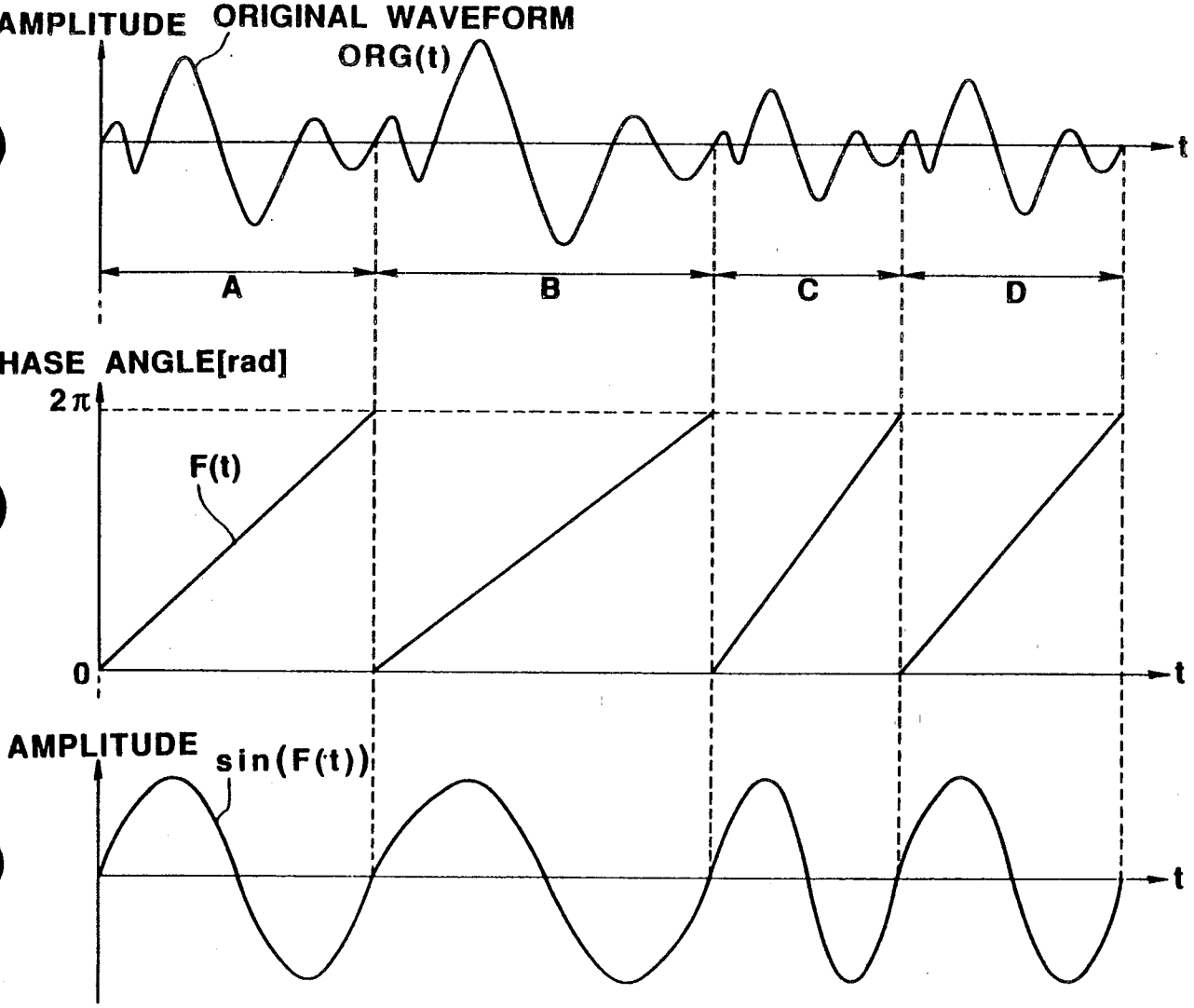
FIGS. 2(*a*) to 2(*c*) are diagrams illustrating a relation between the ORG(t) and F(t)

First, an original waveform ORG(t) of a musical sound waveform of a traditional musical instrument is divided into, for example, waveform periods A through D each of which corresponds to a cycle period (pitch period) of a fundamental wave as shown in FIG. 2(*a*).

Phase angle data which increases linearly with time t between 0[rad] and $2\pi$[rad] within each of the waveform periods as shown in FIG. 2(*b*) is assumed to be period data F(t)[rad] read from waveform data ROM 1 of FIG. 1. Assuming that modulation index I of FIG. 1 is 0 and a sine wave is read from sin ROM 2 in accordance with the period data F(t) itself with its phase angles specified linearly to obtain output sin(F(t)), a sine wave of a period corresponding to phase angles from 0 to $2\pi$[rad] is read unmodulated for each of waveform periods A to D as shown in FIG. 2(*c*). Each of waveform periods A to D is not necessarily required to correspond to a pitch period accurately. With musical sounds poor in periodicity such as percussive tones in particular, a period from a zero-crossing point to the next zero-crossing point may be used as one waveform period.

Figure 3A:
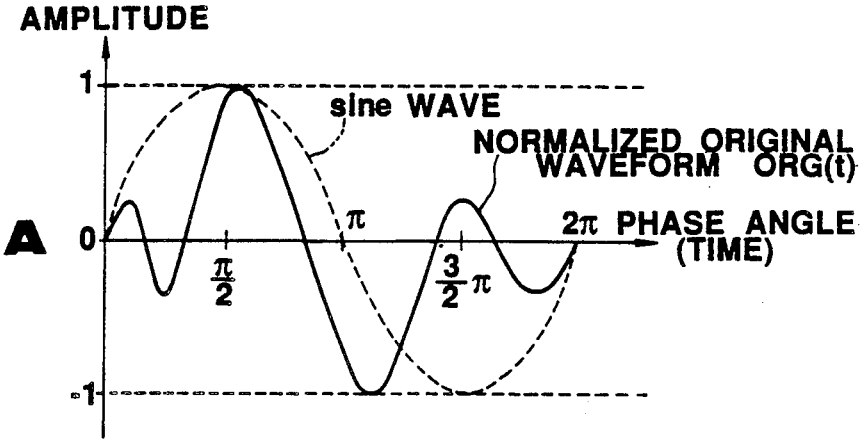
FIG. 3A, 3B, and 3C is a diagram illustrating a relation among the ORG(t), F(t) and M(t)
Figure 3B:
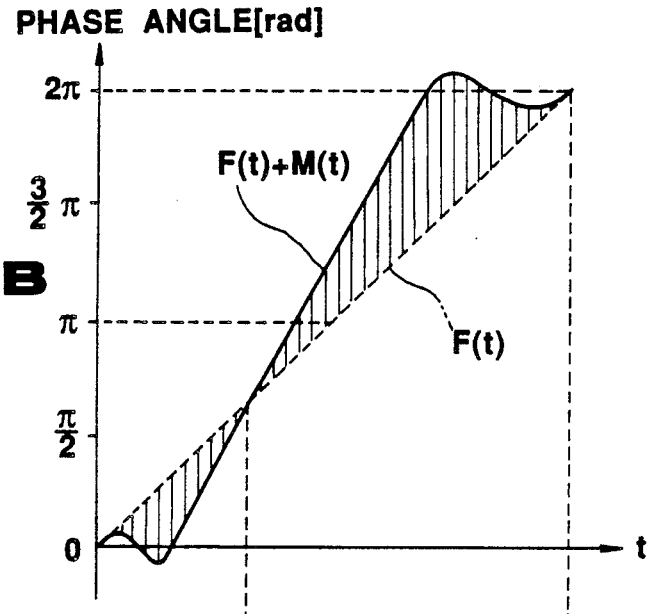
Figure 3C:
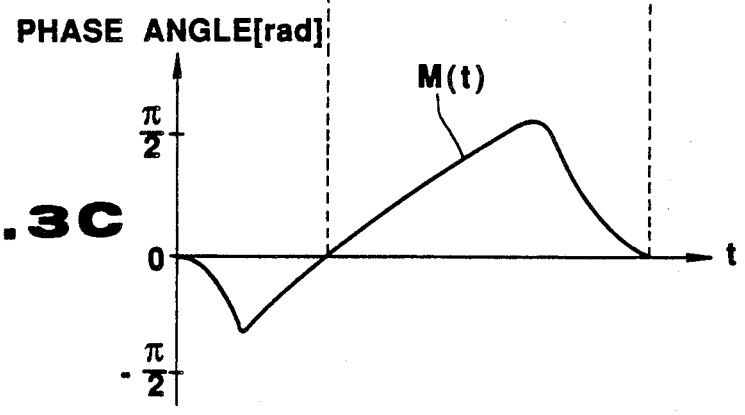

Next, phase difference data M(t) read from waveform data ROM 1 of FIG. 1 is such data as allows the original waveform ORG(t) for one waveform period, in which the maximum value of amplitude absolute values is normalized to 1, to be read as waveform output OUT(t) as shown in FIG. 3A when a sine wave corresponding to one period is read modulated from sin ROM 2 using phase angle data F(t)+M(t) shown in FIG. 3B from adder 3 with the value of modulation index I taken as 1. The phase difference data is shown in FIG. 3C.

The normalization coefficient K(period) read from waveform data ROM 1 for each of waveform periods is used to return the output of sin ROM 2 to the amplitude of the original waveform ORG(t) for each of the waveform periods because the maximum value of amplitude absolute values of each sine wave stored in sin ROM 2 of FIG. 1 is normalized to 1 as described above.

From the above, OUT(t) and ORG(t) are given by $$OUT(t)=K(period)\cdot sin(F(t)+I\cdot M(t)) \quad (1)$$

$$ORG(t)=K(period)\cdot sin(F(t)+M(t)) \quad (2)$$

As can be seen from the above relations, in order to obtain a desired original waveform ORG(t) as a waveform output OUT(t) for each of the waveform periods when modulation index has a value of 1, it is required to find period data F(t), phase difference data M(t) and normalization coefficient K(period) which correspond to original waveform ORG(t) in a corresponding waveform period. A way of finding them will be explained taking waveform period A of original waveform ORG(t) of FIG. 2 by way of example.

First, the way of finding period data F(t) was already described with reference to FIG. 2(*b*).

Next, the maximum value of the amplitude absolute values of original waveform ORG(t) in waveform period A of FIG. 2(*a*) is assumed to be the normalization coefficient K(period A). By dividing each amplitude value of original waveform ORG(t) in the period A by the normalization coefficient K(period A), the amplitude is normalized so that it lies within ±1 as shown in FIG. 3A. In FIG. 3A, the positive and negative maximum values are both 1 in absolute value. It does not matter if one of the maximum values assumes 1 and the other is 1 or below.

Figure 4:
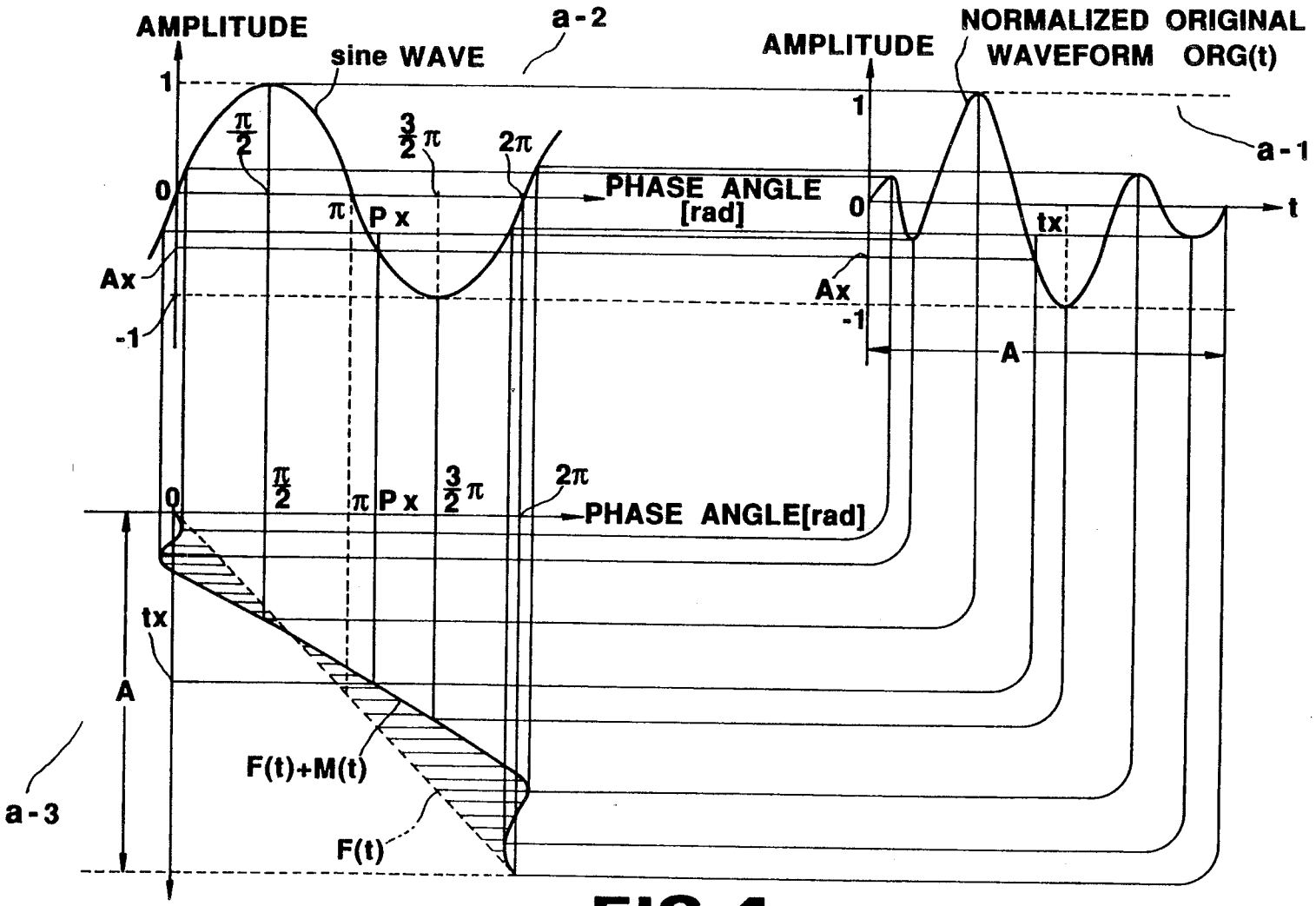
FIG. 4 is a diagram illustrating how to find the M(t)

Next, the following processes (1) to (4) are performed to find phase difference data M(t) using the normalized original waveform ORG(t) (refer to FIG. 4).

(1) The amplitude Ax of the normalized original waveform ORG(t) that corresponds to an arbitrary time tx within waveform period A of the normalized original waveform ORG(t) is found.

(2) The phase angle px of the position whose amplitude is equal to the amplitude Ax found in process (1) on a sine wave having a maximum value of 1 absolute value of amplitude (refer to FIG. 4*a*-2) is found. In this case, the phase angle px is found such that the position of time tx within the original waveform ORG(t) and the position of phase angle px in the sine wave are in substantially the same relation. That is, for example, when time tx is located within about ¼ period from the beginning of waveform period A, the phase angle should be determined in the neighborhood of 0 to $\pi/2$ within about ¼ period from the beginning of the sine wave.

(3) Using the phase angle px found in process (2) and the period data F(t) in waveform period A which has been found beforehand, the phase difference data M(tx) corresponding to time tx is found as px−F(tx) (FIG. 4*a*-3).

(4) Processes (1) to (3) are repeated while time tx is varied over the entire region within waveform period A to find the phase difference data M(t) corresponding to each time t within waveform period A.

Processes (1) to (4) are repeated for each of waveform periods A to D of the original waveform ORG(t) of FIG. 2(*a*) to obtain period data F(t), phase difference data M(t) and normalization coefficient K(period) for each of the waveform periods. The obtained data and coefficients are stored in waveform data ROM 1 of FIG. 1.

By performing the modulating operation shown in equation (1) using above data with modulation index I for multiplication in multiplier 4 of FIG. 1 taken as 1, the original waveform ORG(t) can be obtained as waveform output OUT(T) of FIG. 1.

Next, by varying the value of modulation index I for multiplier 4 of FIG. 1, waveform outputs OUT(t) which are modulated variously can be obtained.

First, if I=0, an unmodulated sine wave is obtained within each waveform period as shown in FIG. 2(*c*).

Also, by varying the value of modulation index I as 1.0, 1.5, 2.0, modulated waveforms with varying modulation depths are obtained, as shown in FIGS. 5*a*-1, 5*a*-2 and 5*a*-3, as modulated output D(T) from sin ROM 2 of FIG. 1.

By varying the value of modulation index I as described above, various modulated waveforms are obtained which includes a sine wave and a deeply modulated waveform with the original waveform as center.

Furthermore, by varying modulation index I continuously during a period that elapses from the initiation of tone generation to the time when the tone has faded away, it is possible to obtain a waveform output OUT(t) which varies from a deeply modulated wave to a sine wave as the tone diminishes.

Figure 6:
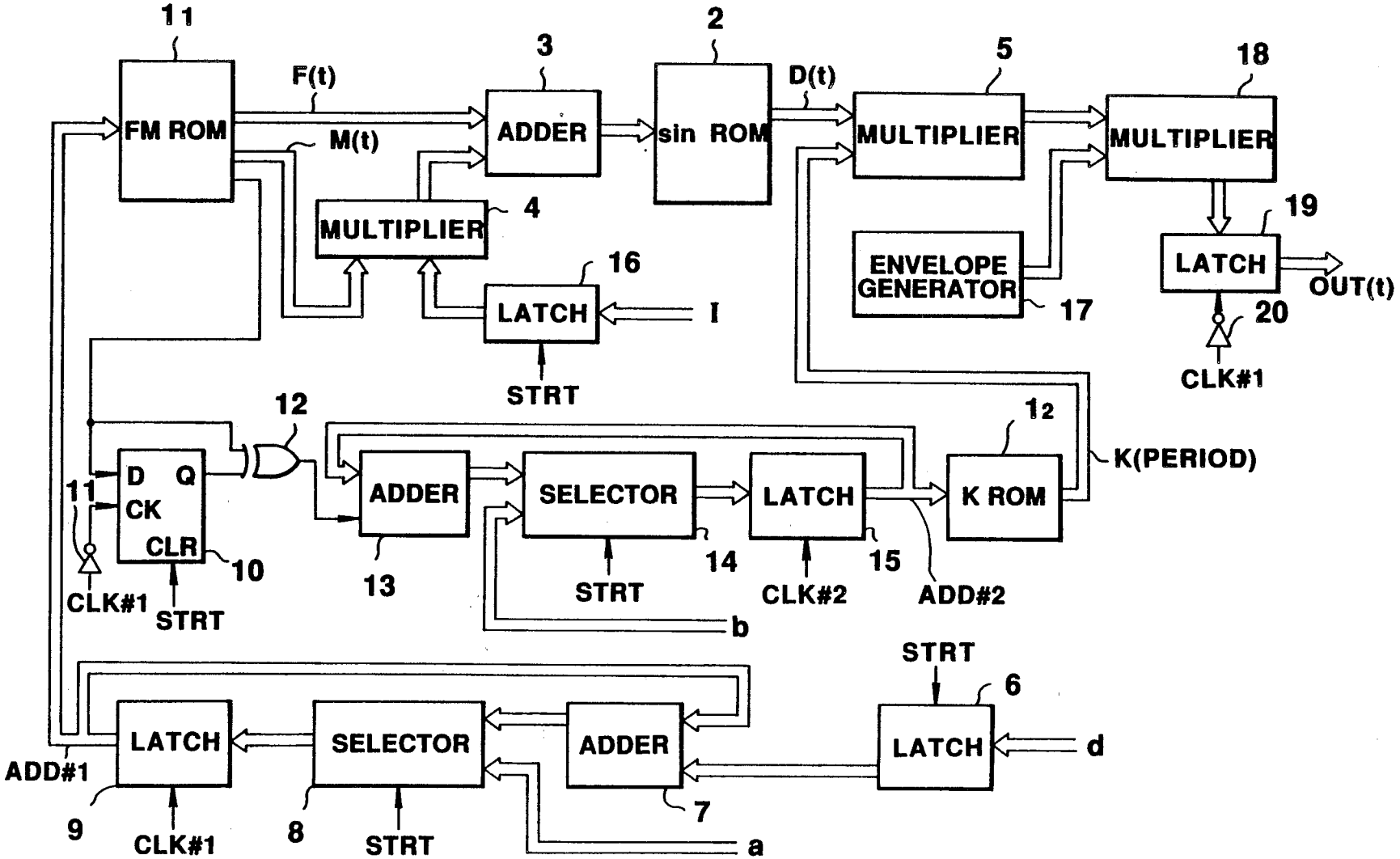
FIG. 6 illustrates a specific arrangement of the first embodiment of the musical sound waveform generator.

Specific arrangement of the first embodiment of the musical sound waveform generator FIG. 6 illustrates a specific arrangement of the first embodiment of the musical sound waveform generator. In the Figure, blocks having the same function as those in FIG. 1 are designated by like reference numerals. Note that waveform data ROM 1 of FIG. 1 is composed of two ROMs FM $ROM1_1$ and K $ROM1_2$ in FIG. 6.

In FIG. 6, address data ADD#1 for reading period data F(t) and phase difference data M(t) from FM $ROM1_1$ is accumulated in an accumulating section comprised of a adder 7, a selector 8 and a latch 9 with the start address a used as an initial value at periods of addresses of tone pitch data latched in a latch 6 and in synchronism with rises of clocks CLK#1 applied to latch 9. In this case, the start address a is provided from a control section not shown in particular and selected by selector 8 when a start pulse STRT is at a high level for application to latch 9 as the initial value. When the start pulse STRT is at a low level, an output of adder 7 is selected to carry out the accumulating operation. The tone pitch data d is provided from the control section not shown and latched in latch 6 in synchronism with the rise of start pulse STRT.

Phase difference data M(t) read from FM $ROM1_1$ is multiplied in multiplier 4 by modulation index I latched in latch 16 and then added in adder 3 to period data F(t) read from FM $ROM1_1$. Phase angle data F(t)+I M(t) from adder 3 is applied to sin ROM 2 as its read address. Modulation index I is provided from the control section not shown and latched in a latch 16 in synchronism with the rise of start pulse STRT. Thereby a modulated output D(t) is applied from sin ROM 2 to multiplier 5.

Period identifying data IB outputted from FM $ROM1_1$ is applied to a D flip-flop (F/F) 10 responding to the rise of a clock obtained from an inverter 11 for inverting clock CLK#1 and to an exclusive OR circuit (EOR) 12 at its first input. To the second input of EOR 12 is applied positive-logical-output Q of F/F 10. By virtue of this circuit arrangement, the output of EOR 12 goes to a logic 1 when period identifying data IB outputted from FM $ROM1_1$ changes its value.

Address data ADD#2 serving as an address input to K $ROM1_2$ is accumulated, with a start address b as its initial value, by one address each time the output of EOR 12 goes to logic 1 in an accumulating section comprised of an adder 13, a selector 14 and a latch 15. Start address b is provided from the control section not shown and selected by selector 14 when start pulse STRT is at a high level for application to latch 15. When start pulse STRT is low, the output of adder 13 is selected to carry out the accumulating operation.

Thereby address data ADD#2 is applied to K $ROM1_2$ so that normalization coefficient K(period) is outputted therefrom to multiplier 5.

In multiplier 5 modulated output D(t) from sin ROM 2 is multiplied by normalization coefficient K(period) and the result of the multiplication is further multiplied by an envelope value generated by an envelope generator 17 in a multiplier 18.

The result of the multiplication is latched in latch 19 in synchronism with the rise of a clock from an inverter 20 for inverting clock CLK#1 and outputted as waveform output OUT(t).

In the above arrangement, clocks CLK#1 and CLK#2 and start pulse STRT are provided by the control section not shown.

Figure 7:
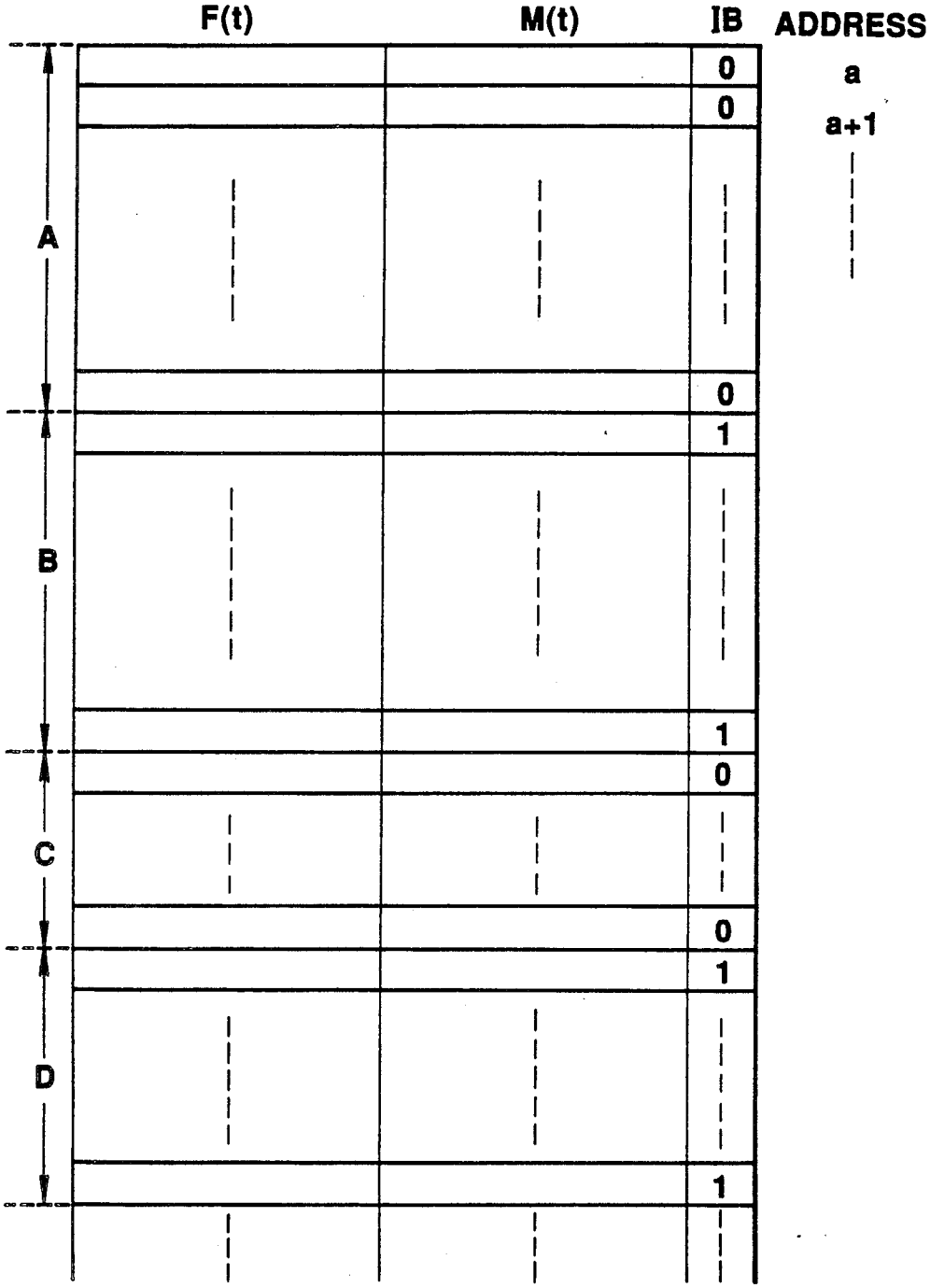
FIG. 7 illustrates a data structure of the FM ROM.

The structure of data stored in FM $ROM1_1$ is illustrated in FIG. 7.

In FIG. 7, a set of waveform data utilized from the initiation of generation of a tone to the time when the tone has faded away is sequentially stored in the order of addresses starting at start address a. In one address is stored a subset of a piece of period data F(t), a piece of phase difference data M(t) and 1-bit period identifying data IB. In this case, data on sampling points in waveform periods A, B, C, D and so on of FIG. 2(*a*) are stored in an ascending order of addresses. As the waveform period advances through A, B, C, D and so on, period identifying data IB alternates between 0 and 1 in units of periods such that 0 during period A, 1 during period B, 0 during period C, 1 during period D and so on. Period identifying data IB serves to identify the boundary between periods in order to update the address specified in K $ROM1_2$ as described later.

The structure of data stored in K $ROM1_2$ of FIG. 6 is illustrated.

In K $ROM1_2$ are stored normalization coefficients K(period) corresponding to respective waveform periods A, B, C, D and so on in ascending order of addresses beginning with the start address b.

The operation of the embodiment arranged as described above will be described with reference to a timing diagram of FIG. 9. Hereinafter FIG. 6 is referred to unless otherwise specified.

To initiate tone generation, start pulse STRT outputted from the control section not shown (hereinafter referred simply to as the control section) goes to a logic 1 (hereinafter referred simply to as 1, the same being applied to logic 0) at a time t1 in FIG. 9 and tone generation is initiated at a time t2 when clock CLK#1 goes to 1 immediately after time t1. In this case, the period of clock CLK#1 corresponds to the sampling period for generating musical sounds and clock CLK#2 has the same period as clock CLK#1 but is delayed by ¼ period. The following operations are controlled in accordance with clocks CLK#1 and CLK#2. Start pulse STRT is maintained at 1 during one cycle period of clock CLK#1 from the time when clock CLK#1 goes to 0 to the time when clock CLK#1 next goes to 0 at the time of initiation of tone generation and is then maintained at 0 until the next time of initiation of tone generation.

Figure 9:
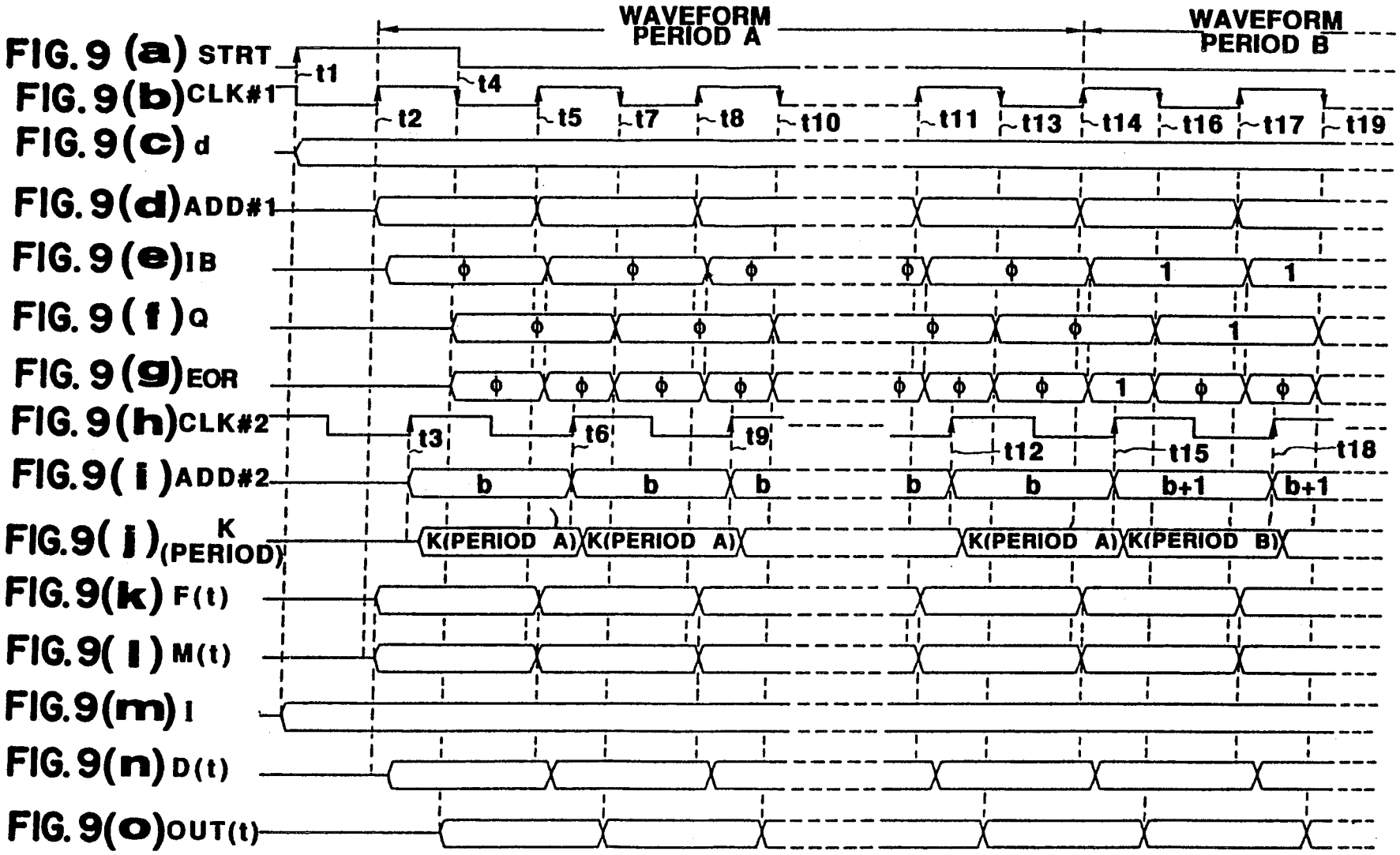
FIGS. 9(*a*) to 9(*o*) are timing diagrams of a specific arrangement of a second embodiment of the musical sound waveform generator.

First, at time t1 when start pulse STRT from the control section goes to 1 as shown in FIG. 9(*a*), tone pitch data d from the control section is latched as shown in FIG. 9(*c*).

Subsequently, selector 8 selects start address a from the control section during a period from t1 to t4 in which start pulse STRT is 1. Start address a is latched in latch 9 at time t2 when clock CLK#1 goes to 1, thereby determining the initial value of address data ADD#1 as shown in FIG. 9(d).

As a result, period data F(T), phase difference data M(t) and period identifying data IB (refer to FIG. 7) stored in start address a of FM $ROM1_1$ are read shortly after time t2 as shown in (e), (k) and (l) of FIG. 9.

Afterward address data ADD#1 from latch 9 is fed back to adder 7 so that tone pitch data d latched in latch 6 is accumulated progressively. In this case, the accumulated values are sequentially latched in latch 9 via selector 8 at times t5, t8, t11, t14, t17 and so on when clock CLK#1 goes to 1 to serve as new address data ADD#1. Consequently period data F(t), phase difference data M(t) and period identifying data IB (refer to FIG. 7) are read from corresponding addresses on FM $ROM1_1$ as shown in (e), (k) and (l) of FIG. 9. It is to be noted that selector 8 selects the output of adder 7 after t4 because start pulse STRT goes to 0 at time t4.

The initiation of tone generation is commanded by, for example, a player's depressing of any key on a keyboard not shown. If, at this point, a high-note key is depressed, tone pitch data d which is large in value will be latched in latch 6. Thereby, the range or width of addresses skipped over on FM $ROM1_1$ become large so that a waveform output OUT(t) having a high-pitch period is produced. If, conversely, the lowest-note key is depressed, a value 1 will be latched as tone pitch data d. In this case, data are sequentially read from FM $ROM1_1$ piece by piece (i.e., from each address) so that a waveform output OUT(t) of the lowest-pitch period is produced.

Of the data read from FM $ROM1_1$ phase difference data M(t) is applied to multiplier 4. At time t1 when start pulse STRT goes to 1, modulation index I from the control section is latched in latch 16. Thus, in multiplier 4, phase difference data M(t) is multiplied by modulation index I. The output of multiplier 4 is inputted to adder 3 where it is added to period data F(t) outputted from FM $ROM1_1$ to produce phase angle data $F(t)+I\cdot M(t)$.

Sin ROM 2 is accessed by phase angle data $F(t)+I\cdot M(t)$ so that a modulated output D(t) is outputted a short time after corresponding period data F(t) and phase difference data M(t) have been outputted (shortly after times t2, t5, t8, t11, t14, t17 and so on in (k) and (l) of FIG. 9) as shown in (n) of FIG. 9.

On the other hand, during a time period from t1 to t4 in which start pulse STRT is 1, selector 14 selects start address b from the control section and the start address b is then latched in latch 15 at time t3 when clock CLK#2 goes to 1 so that the initial value of address data ADD#2 is determined as shown in FIG. 9(*i*).

As a result, normalization coefficient K(period A) is read from start address of K $ROM1_2$ after a short time delay from t3 as shown in FIG. 9(*j*). Subsequently address data ADD#2 outputted from latch 15 is fed back to adder 13 where an output value of either 0 or 1 of EOR 12 is added to address data ADD#2. Output values of adder 13 are sequentially latched in latch 15 via selector 14 at times t6, t9, t10, t12, t15, t18 and so on when clock CLK#2 goes to 1 in FIG. 9(*h*) so that they are specified as new address data ADD#2. As a result, normalization coefficients K(period) are sequentially read from corresponding addresses of K $ROM1_2$ as shown in FIG. 9(*j*). Note that, since start pulse STRT goes to 0 at time t4, selector 14 selects the output of adder 13 after t4.

In parallel with the above operation, period identifying data IB are sequentially outputted from FM $ROM1_1$ as shown in FIG. 9(*e*) shortly after times t2, t5, t8, t11, t14, t17 and so on when clock CLK#1 goes to 1 in FIG. 9(*b*). These data sequentially appear at positive-logical-output Q of F/F 10 at times t4, t7, t10, t13, t16, t19 and so on of FIG. 9(*b*) when clock CLK#1 goes to 0 so that the states of positive-logical-output Q are sequentially determined as shown in FIG. 9(*f*). Positive-logical-output Q of F/F 10 and period identifying data IB from FM $ROM1_1$ are EXCLUSIVE ORed by EOR 12.

Here, as shown in FIG. 7, period identifying data IB outputted from FM $ROM1_1$ alternates between 0 and 1 in units of waveform periods as shown in FIG. 7. More specifically, period identifying data IB changes from 0 to 1, from 1 to 0 and from 0 to 1 when the waveform period changes from A to B, from B to C and from C to D, respectively. Thus, the output of EOR 12 goes to 1 only when the waveform period changes and remains at 0 at other times. In the example of FIG. 9, the output of EOR 12 becomes 1 only during a time period between immediately after t14 when the waveform period changes from A to B and t16 in which clock CLK#1 is 1. Therefore, 1 is added to the initial value b of address data ADD#2 from latch 15 in adder 13 only during that time period. The resulting value b+1 is latched in latch 15 as new address data ADD#2 at time t15 in FIG. 9(*h*) when clock CLK#2 goes to 1. Thus, normalization coefficient K(period B) is read from K $ROM1_2$ in accordance with new address data having a value of b+1 after time t15 when clock CLK#2 goes to 1 as shown in FIG. 9(*j*).

At other times when the output of EOR 12 is 0, no adding operation is performed in adder 13. Thus, the same address data ADD#2 as the address of one timing step before is latched in latch 15. Therefore, at each of times t6, t9, t12, t18 in FIG. 9(*h*), the same normalization coefficient K(period) as that of one timing step before is read from K $ROM1_2$ as shown in FIG. 9(*j*).

In such a manner, when modulated outputs D(t) are outputted during each waveform period, normalization coefficient K(period) for the corresponding waveform period is read from K $ROM1_2$. More specifically, when modulated outputs D(t) are read from sin ROM 2 on the basis of period data F(t) and phase difference data M(t) for waveform period A from FM $ROM1_1$, normalization coefficient K(period A) corresponding to the waveform period A is read from K $ROM1_2$. Likewise, normalization coefficient K(period B) corresponding to waveform period B is read from K $ROM1_2$ during waveform period B.

In such a manner, modulated outputs D(t) are read, as shown in FIG. 9(*n*), from sin ROM 2 shortly after times t2, t5, t8, t11, t14, t17 and so on when clock CLK#1 of FIG. 9(*b*) goes to 1. In parallel with this operation, normalization coefficients K(period) are outputted from K $ROM1_2$ as shown in FIG. 9(*j*) shortly after times t3, t6, t9, t12, t15, t18 and so on when clock CLK#2 of FIG. 9(*h*) goes to 1. Modulated output D(t) and normalization coefficient K(period) which coincide in time are multiplied in multiplier 5 and then further multiplied by envelope data from envelope generator 17. The outputs of multiplier 18 are sequentially latched, as shown in FIG. 9(*o*), in latch 19 at times t4, t7, t10, t13, t16, t19 and so on when clock CLK#1 of FIG. 9(*b*) goes to 0 so that waveform output OUT(t) for each of timing steps is determined. It is to be noted here that, though not shown in FIG. 1, envelope generator 17 and multiplier 18 are only required to add other envelopes than the original waveform to waveform outputs OUT(t) and thus they are not necessarily needed.

As can be seen from the above operation, the embodiment of FIG. 6 enables the same operation as that of the musical sound waveform generator of FIG. 1 shown in FIGS. 2 through 5 to be realized.

Modifications of the specific arrangement of the first embodiment of the musical sound waveform generator In the electronic musical instrument of FIG. 6, two ROMs, FM $ROM1_1$ and K $ROM1_2$, are provided for waveform data ROM 1 of FIG. 1. If some increase in complexity of addressing could be tolerated, a single ROM might be used.

In FM $ROM1_1$, period data F(t) is stored for each of sampling points as shown in FIG. 7. Period data F(t) has a linear characteristic in which the phase angle varies from 0 to $2\pi$ [rad] over each waveform period as shown in FIG. 2(*b*). If there were sufficient time for calculation, period data F(t) could be calculated and outputted for each of sampling points. If done so, the storage capacity could be economized.

In particular, if each of waveform periods A, B, C, D and so on were selected to be constant, each of the waveform periods and phase difference data M(t) within each of the waveform periods could be selected from FM $ROM1_1$ by means of high-order bits and low-order bits of address data ADD#1 of FIG. 6, respectively, and the low-bits of address data ADD#1 could be used as each value of period data F(t) directly. In this case, there would be no need for storing period data F(t).

The first embodiment of FIG. 6 is based on a musical sound waveform generator adapted for generating musical tones, one note at a time. By operating various parts on a time-division basis, it would be possible to generate a plurality of musical tones at a time, i.e., to realize a polyphonic musical instrument.

Modifications of the principle of the first embodiment of the musical sound waveform generator In the principle of the first embodiment shown in FIG. 1, when I=0, equation (1) is rewritten as follows.

$$OUT(t)=K(period)\cdot sin(F(t)) \quad (3)$$

Since period data F(t) increases linearly within each of the waveform periods as shown in FIG. 2(*b*) and normalization coefficient K(period) is constant in each waveform period, a sine wave is obtained as waveform output OUT(t).

On the other hand, when I=1, original waveform ORG(t) is obtained which is represented, as in equation (2), by $$ORG(t)=K(period)\cdot sin(F(t)+M(t)) \quad (2)$$

By varying modulation index I from 0 to 1, a waveform can be changed continuously from a sine waveform to an original waveform. Also, by setting modulation index I to more than 1 , a waveform can be varied continuously from an original waveform to a further modulated waveform.

As described above, the present embodiment is characterized in that at least a sine wave and an original waveform can be outputted by the use of period data F(t) varying linearly in each waveform period and phase difference data M(t) which is difference data of F(t). If, therefore, a sine wave can be outputted when I=0 and an original waveform can be obtained when I=1, it is not required to stick to equations (1) and (2). The present invention covers any embodiment which implements an operation given by $$OUT(t)=K(period)\cdot f(g(F(t))+I\cdot M(t)) \quad (4)$$

where f and g are each a function to satisfy f(g(F(t)) =sin F(t).

For example, in equation (4), assume that f is defined as a triangular wave function which satisfies $$f(\alpha) = (2/\pi)\alpha \ldots (0 \leqq \alpha \leqq \pi/2) \quad (5)$$

$$f(\alpha) = -1 + (2/\pi)(3\pi/2 - \alpha) \ldots (\pi/2 \leqq \alpha \leqq 3\pi/2)$$

$$f(\alpha) = -1 + (2/\pi)(\alpha - 3\pi/2) \ldots (3\pi/2 \leqq \alpha \leqq 2\pi)$$

where $\alpha$ is an input.

Furthermore, assume that g is defined as a function which satisfies $$g(\beta) = (\pi/2) \sin \beta \ldots (0 \leqq \beta\ \pi/2) \quad (6)$$

$$g(\beta) = \pi - (\pi/2) \sin \beta \ldots (\pi/2 \leqq \beta \leqq 3\pi/2)$$

-continued $$g(\beta) = 2\pi + (\pi/2)\sin\beta \ldots (3\pi/2 \leqq \beta \leqq 2\pi)$$

were $\beta$ is an input.

When modulation index I is 0, i.e., when no modulation is performed, substituting equations (5) and (6) into equation (4) yields $$\begin{aligned} f(g(\beta)) &= K(\text{period}) \cdot f((\pi/2)\sin\beta) \\ &= K(\text{period}) \cdot (2/\pi)(\pi/2)\sin\beta \\ &= K(\text{period}) \cdot \sin\beta \ldots (0 \leqq \beta \leqq \pi/2) \end{aligned} \quad (7)$$

$$\begin{aligned} f(g(\beta)) &= K(\text{period}) \cdot f((\pi - (\pi/2) \cdot \sin\beta)) \\ &= K(\text{period}) \cdot (-1 + (2/\pi)(3\pi/2 - \pi + (\pi/2)\sin\beta)) \\ &= K(\text{period}) \cdot \sin\beta \ldots (\pi/2 \leqq \beta \leqq 3\pi/2) \end{aligned}$$

$$\begin{aligned} f(g(\beta)) &= K(\text{period}) \cdot f(2\pi + (\pi/2) \cdot \sin\beta) \\ &= K(\text{period}) \cdot (-1 + (2/\pi)(2\pi + (\pi/2)\sin\beta - 3\pi/2)) \\ &= K(\text{period}) \cdot \sin\beta \ldots (3\pi/2 \leqq \beta \leqq 2\pi) \end{aligned}$$

That is, a single sine wave is outputted at the time of nonmodulation.

In order to obtain original waveform ORG(t) by substituting equations (5) and (6) into equation (4) when I=0, it is only required that the sine wave of FIG. 4a-2 be replaced with the triangular wave function defined by equation (5), the period data F(t) of FIG. 4a-3 be replaced with the function g(t) defined by equation (6), and phase data M(t) be determined as difference data from g(t).

In this case, as means for producing a triangular wave which corresponds to sin ROM 2 of FIG. 1, a decoder circuit can be used in addition to a ROM.

In addition to the above, various combinations of functions may be defined as functions f and g which satisfy equation (4).

Moreover, the above example is arranged such that a sine wave can be outputted at the time of nonmodulation and an original waveform can be outputted when I=1. Alternatively, a sine wave and an original waveform may be outputted when the modulation index has a first predetermined value and a second predetermined value, respectively.

Also, it is possible to output a rectangular wave, a sawtooth wave, a guitar sound waveform and so on, not a sine wave.

According to the first embodiment, as described above, by setting the mixing ratio of the modulation signal to a predetermined value (for example, 1), it is possible to obtain desired musical sound waveforms such as musical sounds of traditional instruments.

If, therefore, the mixing ratio is set to, for example, 1 immediately after initiation of tone generation and the mixing ratio is then decreased to, for example, 0 with the elapse of time during performance, the frequency characteristic of a musical sound waveform can be controlled gradually so that it may finally contain only a component of a sine wave, rectangular wave or a sawtooth wave, a guitar sound waveform and so on. Alternatively, by continuously varying the mixing ratio to more than 1 by way of example, it is possible to control a musical sound so that at first a musical sound with a desired waveform may be produced and finally an individual musical sound with a more complex harmonic structure may be produced.

By controlling the envelope of a musical sound waveform so as to decay with time by means of envelope generator 17 and multiplier 18 of FIG. 6 in addition to the above operation, a process in which a musical sound waveform decays gradually after the musical sound has been produced can be realized like traditional musical instruments.

As described above, the first embodiment can easily provide both a state in which a natural musical sound is produced and a state in which only a different waveform is contained and moreover can generate various harmonic characteristics. This can be implemented only by a combination of usual ROMs, decoders, adders, multipliers, etc.. That is, complex musical sound waveforms can be produced by circuitry simple in construction. As a result, high-performance electronic musical instruments can be provided at low cost.

In this case, each of the waveform periods of FIG. 2 is not necessarily required to be divided according to a desired waveform pitch period, but it may be divided at an appropriate period (for example, every zero-crossing point). Thus difference data and period data for a desired waveform can readily be determined.

The principle of a second embodiment of the musical sound waveform generator

Next, a second embodiment of the musical sound waveform generator of the present invention will be described. With the first embodiment, arbitrary waveforms are generated which correspond to musical sound waveforms of a traditional musical instrument, each with a pitch period, during a time period from when tone generation is initiated before the tone fades away, and moreover the waveform characteristics can continuously be varied between the generated waveform and a sine wave. In contrast to the first embodiment, the second embodiment is characterized in that a desired waveform, such as a sawtooth wave, a rectangular wave, or a nonsymmetrical rectangular wave, which is repeated regularly every pitch period can be generated as a waveform output e and moreover the waveform characteristics can continuously be varied between the generated waveform and a sine wave.

Figure 10:
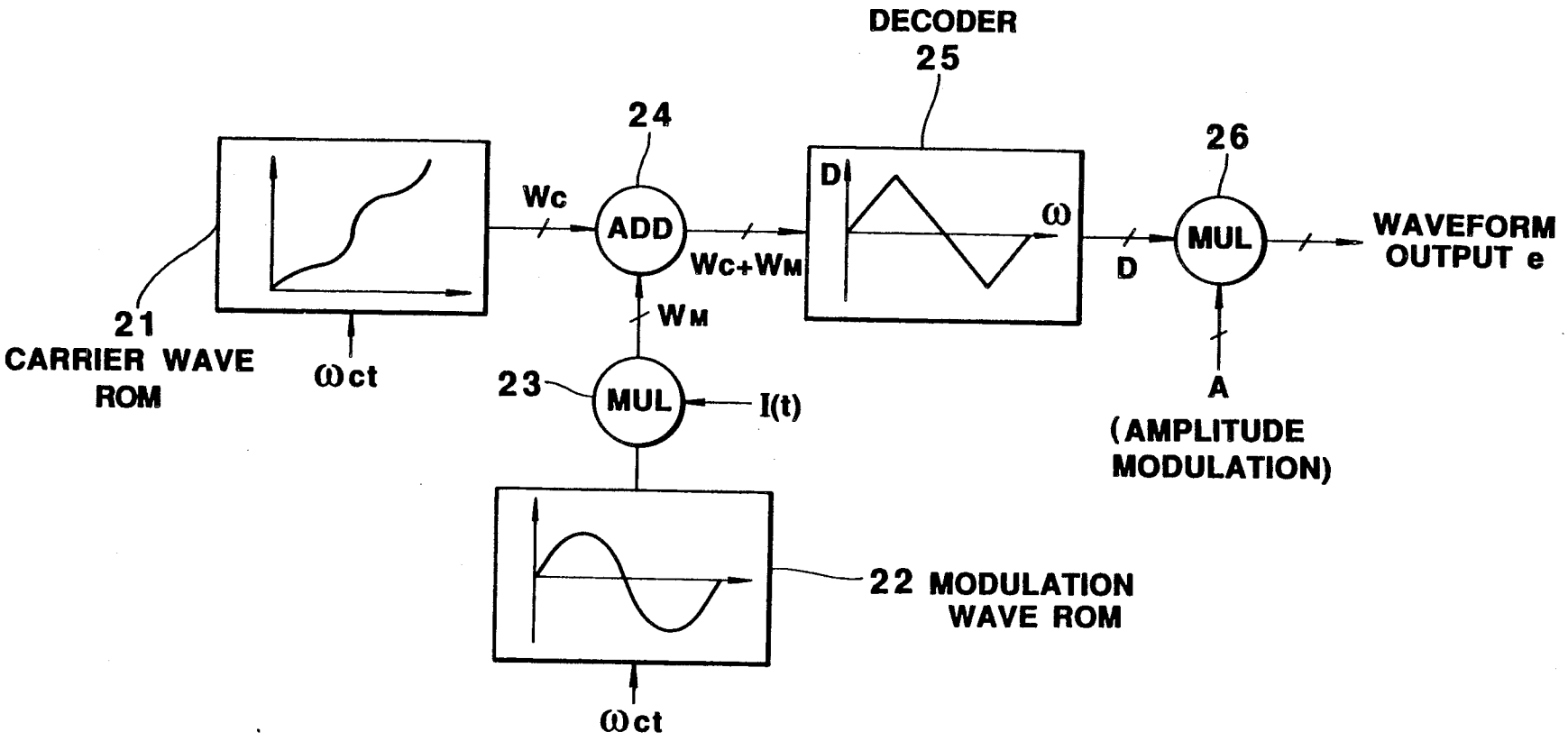
FIG. 10 is a diagram illustrating the principle of the second embodiment of the musical sound waveform generator of the present invention.

FIG. 10 illustrates the principle of the second embodiment of the musical sound waveform generator of the present invention.

Carrier wave phase angle $\omega ct$, which increases linearly between 0 and $2\pi$[rad] and increases again from 0 after a point immediately prior to $2\pi$ is reached, is used as address data for a carrier wave ROM 21 to read a carrier signal Wc therefrom. Carrier wave phase angle $\omega ct$ is obtained by multiplying angular velocity $\omega c$ [rad/sec] and time t [sec]. Hereinafter, unless otherwise mentioned, "ct" is represented in the form of subscripts.

Carrier wave phase angle $\omega ct$ is also used as address data for a modulation wave ROM 22. A modulation signal read from ROM 22 is multiplied in a multiplier (hereinafter referred to as MUL) 23 by a time-varying modulation index I(t), thereby producing a modulation signal $W_M$.

Modulation signal $W_M$ and carrier signal Wc are added together in an adder (hereinafter referred to as ADD) 4, and the resulting waveform $Wc + W_M$[rad] is then decoded by a decoder 25 to provide a decoded output D.

Decoded output D is multiplied by an amplitude coefficient A in MUL 26 to provide a final waveform output e.

Figure 11:
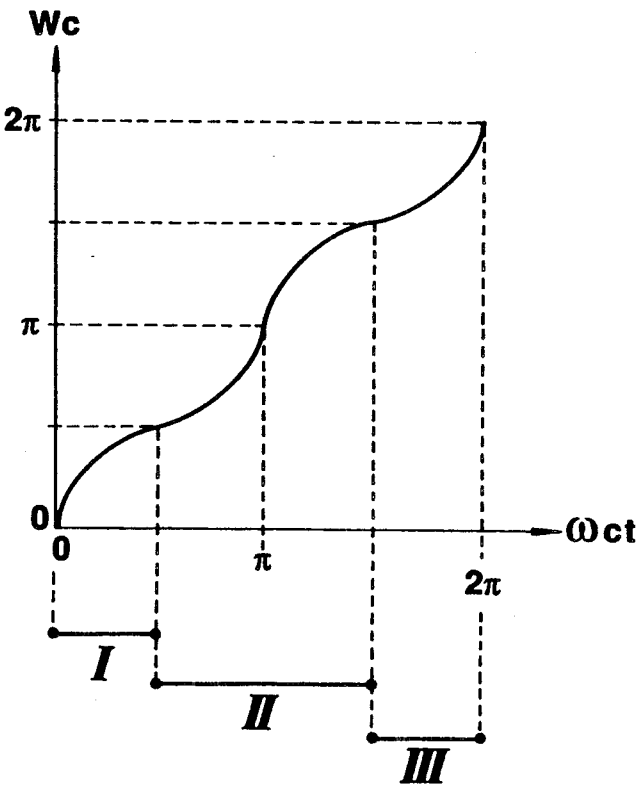
FIG. 11 illustrates the stored contents of the carrier wave ROM.

In the musical sound waveform generator arranged as above, such a function waveform as shown in FIG. 11 is stored in carrier wave ROM 21. Assuming that $\pi$ stands for the ratio of the circumference of a circle to its diameter, the relation between carrier wave phase angle $\omega ct$ [rad] and carrier signal Wc [rad] in each of regions I, II and III in FIG. 11 is as follows:

$$W_c = (\pi/2)\sin \omega_{ct} \ldots \text{(region I: } 0 \leqq \omega_{ct} \leqq \pi/2) \quad (8)$$

$$W_c = \pi - (\pi/2)\sin \omega_{ct} \ldots \text{(region II: } \pi/2 \leqq \omega_{ct} \leqq 3\pi/2)$$

$$W_c = 2\pi + (\pi/2)\sin \omega_{ct} \ldots \text{(region III: } 3\pi/2 \leqq \omega_{ct} \leqq 2\pi)$$

On the other hand, carrier wave phase angle $\omega ct$ applied to modulation wave ROM 22 and modulated signal $W_M$ outputted from MUL 23 are related by $$W_M = I(t)\Delta f(\omega ct) \quad (9)$$

where function $\Delta f$ is a phase difference function to be described later.

The carrier signal Wc and modulation signal $W_M$ represented by equations (8) and (9) are added together and then applied to decoder 25. Thus, decoded output D is outputted from decoder 25 and then multiplied by amplitude coefficient A in multiplier MUL 26. The resulting waveform output e is represented by $$\begin{aligned} e &= A \cdot TRI\,\{(\pi/2)\sin \omega_{ct} + I(t)\Delta f(\omega_{ct})\} \ldots (0 \leqq \omega_{ct} \leqq \pi/2) \quad (10) \\ e &= A \cdot TRI\,\{\pi - (\pi/2)\sin \omega_{ct} + I(t)\Delta f(\omega_{ct})\} \ldots (\pi/2 \leqq \omega_{ct} \leqq 3\pi/2) \\ e &= A \cdot TRI\,\{2\pi + (\pi/2)\sin \omega_{ct} + I(t)\Delta f(\omega_{ct})\} \ldots (3\pi/2 \leqq \omega_{ct} \leqq 2\pi) \end{aligned}$$

If modulation index I(t) has a value of 0, namely, no modulation is performed, then the input waveform to decoder 25 will be carrier signal Wc itself defined by equation (8). Namely, $$e = A \cdot TRI(Wc) \quad (11)$$

Figure 12:
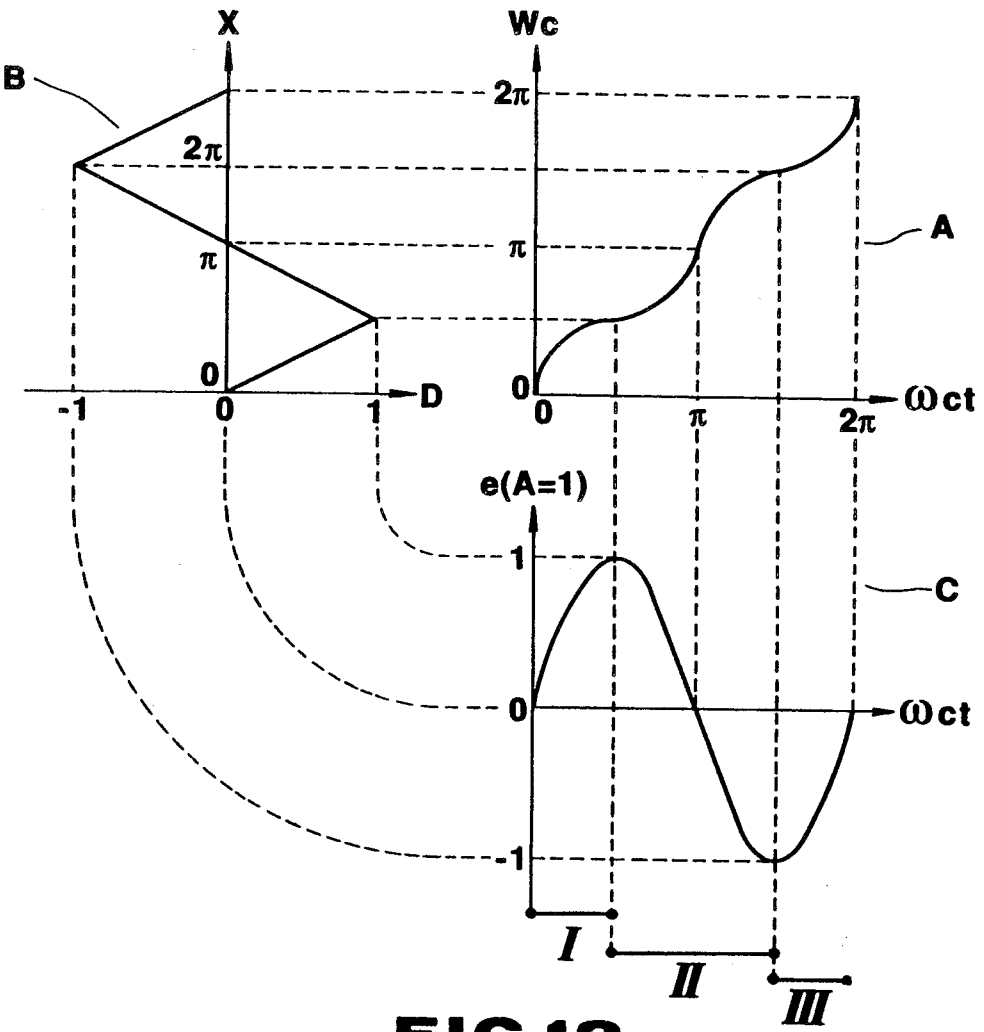
FIG. 12 is a diagram for explaining the operation at a time of nonmodulation of the second embodiment of the musical sound waveform generator.

The relation between carrier signal Wc and carrier wave phase angle $\omega ct$ is represented by relation A of FIG. 12 on the basis of equation (8) or FIG. 11.

On the other hand, a triangular wave function D=TRI(x) (x stands for an input) obtained by decoder 25 is defined by $$\begin{aligned} D &= TRI(x) = (2/\pi)x \ldots \text{(region I: } 0 \leqq x \leqq \pi/2) \quad (12) \\ D &= TRI(x) = -1 + (2/\pi)(3\pi/2 - x) \ldots \text{(region II: } \pi/2 \leqq x \leqq 3\pi/2) \\ D &= TRI(x) = -1 + (2/\pi)(x - 3\pi/2) \ldots \text{(region III: } 3\pi/2 \leqq x \leqq 2\pi) \end{aligned}$$

This function is represented by relation B in FIG. 12.

As can be seen from relations A and B of FIG. 12, carrier signal Wc applied to decoder 25 and triangular wave function D=TRI(x) operated in decoder 25 are each a monotone increasing function in each of regions I, II and III defined by equation (8) or (12). Therefore, carrier wave phase angle $\omega ct$ which is an input of equation (8) and x which is an input of equation (12) always have values of the same region. Thus, equations (8), (11) and (12) can be combined in the same region. That is, substituting equations (8) and (12) in equation (11) yields $$\begin{aligned} e &= A \cdot TRI\{(\pi/2)\sin \omega_{ct}\} \quad (13) \\ &= A \cdot (2/\pi)(\pi/2)\sin \omega_{ct} \\ &= A \cdot \sin \omega_{ct} \ldots \text{(region I: } 0 \leqq \omega_{ct} \leqq \pi/2) \\ e &= A \cdot TRI\{\pi - (\pi/2)\sin \omega_{ct}\} \\ &= A \cdot \{-1 + (2/\pi)(3\pi/2 - \pi + (\pi/2)\sin \omega_{ct})\} \\ &= A \cdot \sin \omega_{ct} \ldots \text{(region II: } \pi/2 \leqq \omega_{ct} \leqq 3\pi/2) \\ e &= A \cdot TRI\{2\pi + (\pi/2)\sin \omega_{ct}\} \\ &= A \cdot \{-1 + (2/\pi)(2\pi + (\pi/2)\sin \omega_{ct} - 3\pi/2)\} \\ &= A \cdot \sin \omega_{ct} \ldots \text{(region III: } 3\pi/2 \leqq \omega_{ct} \leqq 2\pi) \end{aligned}$$

In other words, at the time of nonmodulation, a single sine wave A sin $\omega ct$ which contains no harmonics at all is outputted for any region of carrier wave phase angle $\omega ct$. That is, if A=1, then carrier wave phase angle $\omega ct$ and waveform output e will be related by a single sine wave as shown by relation C in FIG. 12.

As can be seen from the above relations, in order to realize the process in which a single sine wave component is left as a tone decays or the generation of a musical sound containing only a single sine wave component, it is only required that the value of modulation index I(t) be decreased to as small as 0 with time in equation (10).

Figures 13A, 13B, 13C:
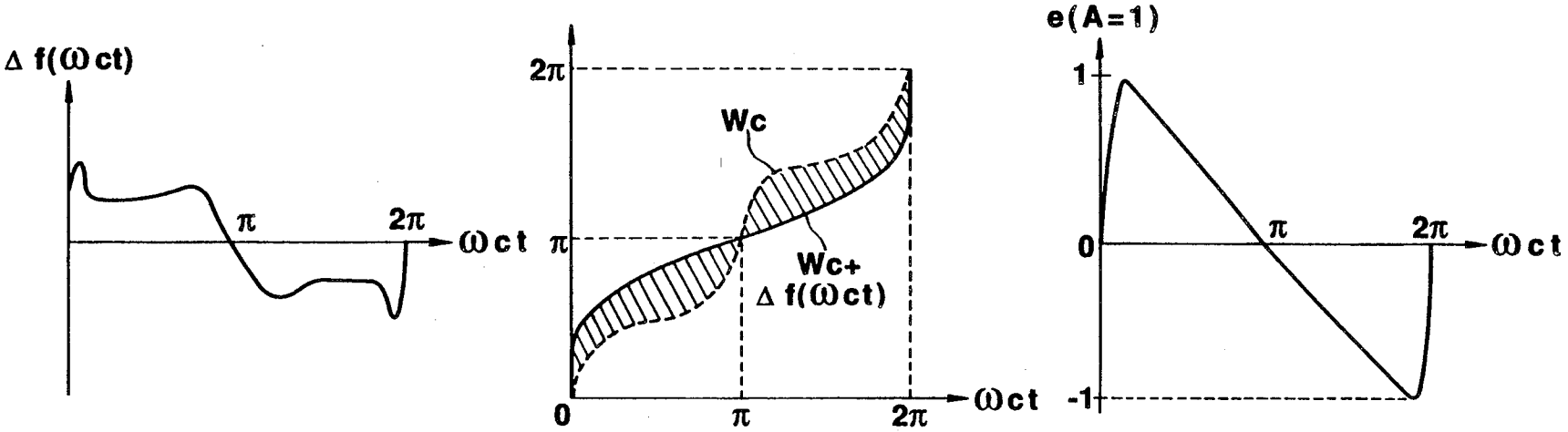
FIGS. 13A, 13B and 13C are diagrams illustrating a relation between $\Delta f(\omega ct)$ and Wc when the waveform output e is a sawtooth wave.

Next, phase difference function $\Delta f(\omega ct)$ in modulation wave ROM 22 in FIG. 10 may be such data as allows a sawtooth wave for one waveform period having the amplitude absolute maximum value normalized to 1 to be read from decoder 25 as waveform output e as shown in FIG. 13C when accessing decoder 25 in accordance with added waveform $Wc + W_M = Wc + \Delta f(\omega ct)$ outputted from ADD 24 when modulation index I(t) has a value of 1. In ROM 22 is stored a waveform corresponding to an oblique line portion in FIG. 13B which is obtained by subtracting carrier signal Wc from added waveform $Wc + \Delta f(\omega ct)$, namely, a waveform shown in FIG. 13A.

Figures 14A, 14B, 14C:
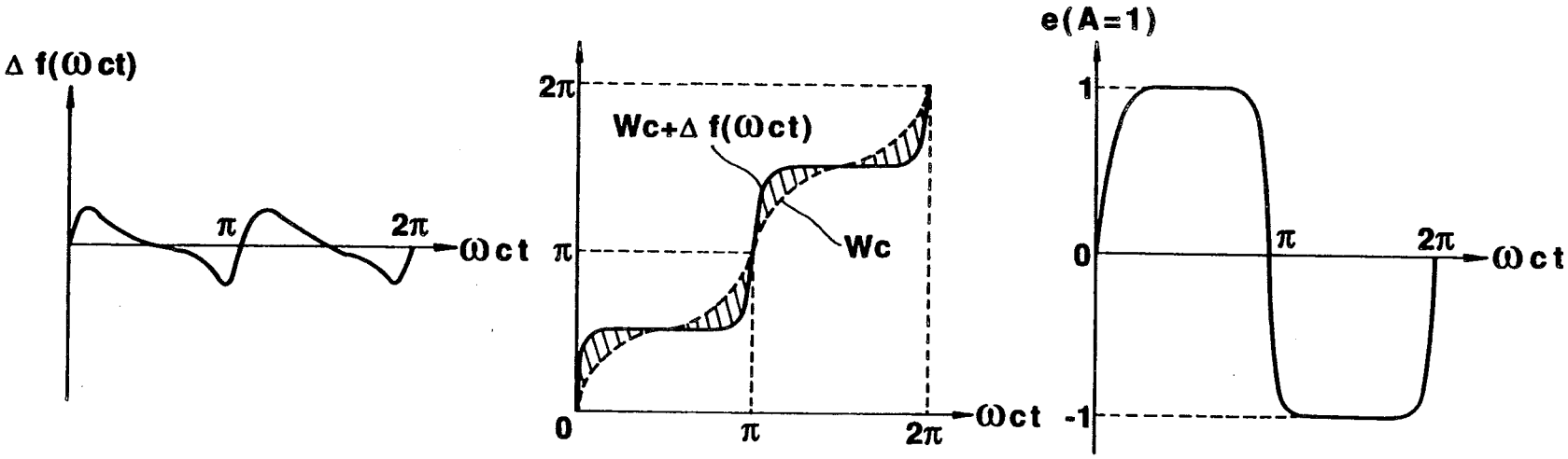
FIGS. 14A, 14B and 14C are diagrams illustrating a relation between $\Delta f(\omega ct)$ and Wc when the waveform output e is a rectangular wave.

As another example, phase difference function $\Delta f(\omega ct)$ may be such data as allows a rectangular wave for one waveform period having the amplitude absolute maximum value normalized to 1 as shown in FIG. 14C to be read as waveform output e in the same way as above. In this case, in ROM 22 is stored a waveform corresponding to an oblique portion of FIG. 14B which is obtained by subtracting carrier signal Wc from added waveform $Wc + \Delta f(\omega ct)$, namely a waveform shown in FIG. 14A.

Figures 15A, 15B, 15C:
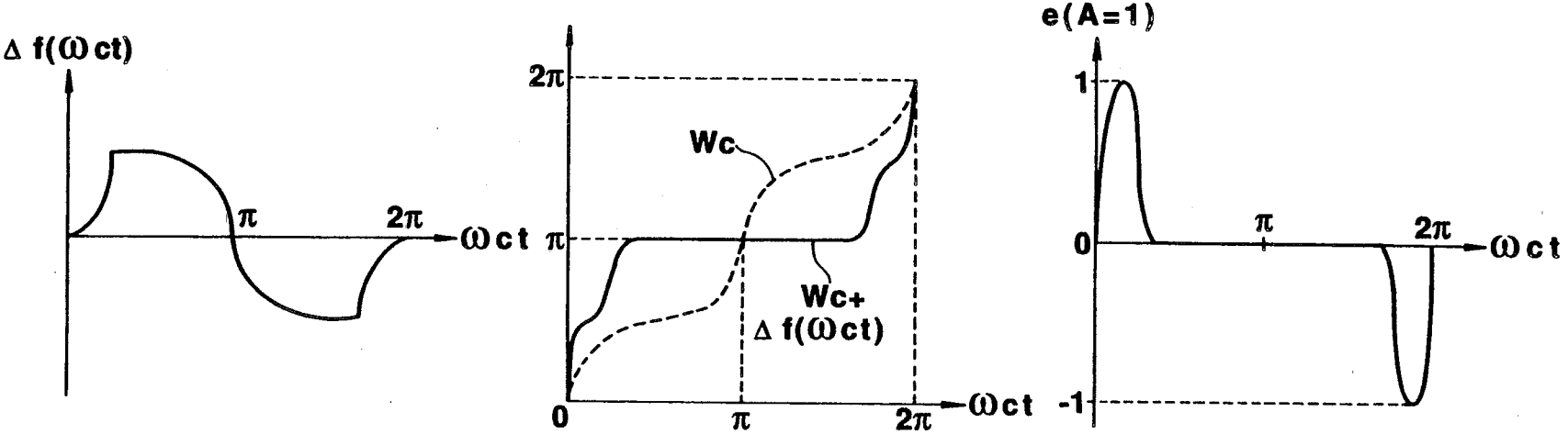
FIGS. 15A, 15B and 15C are diagrams illustrating a relation between $\Delta f(\omega ct)$ and Wc when the waveform output e is a nonsymmetrical rectangular wave.

As still another example, phase difference function $\Delta f(\omega ct)$ may be such data as allows a nonsymmetrical rectangular wave for one waveform period having the amplitude absolute maximum value normalized to 1 as shown in FIG. 15C to be read as waveform output e in the same manner as above. In this case, in ROM 22 is stored a waveform corresponding to an oblique line portion of FIG. 15B which is obtained by subtracting carrier signal Wc from added waveform $Wc+\Delta f(\omega ct)$, namely, a waveform shown in FIG. 15A.

As can be seen from the above, when it is desired to obtain a sawtooth wave, a rectangular wave or a non-symmetrical rectangular wave as waveform output e when modulation index I(t) is set at 1, a corresponding phase difference function $\Delta f(\omega ct)$ should be found. The way of finding the corresponding phase difference function is as follows:

(1) First, the amplitude of a normalized waveform output e is found that corresponds to an arbitrary phase angle $\omega ct$ of the waveform output e for one period having its amplitude normalized to within $\pm 1$;

(2) On a triangular function (refer to equation (12)) whose amplitude absolute maximum value is 1, the phase angle in the same position as the amplitude found (1) is found;

(3) The value of carrier signal Wc corresponding to the carrier wave phase angle $\omega ct$ found in (1) is subtracted from the phase angle found in (2) to find a value of phase difference function $\Delta f(\omega ct)$ corresponding to the carrier wave phase angle $\omega ct$ found in (1); and (4) The carrier wave phase angle $\omega ct$ is varied over the entire region of waveform output e to repeat processes (1) to (3) so as to find a value of phase difference function $\Delta f(\omega ct)$ corresponding to each carrier wave phase angle $\omega ct$ of waveform output e.

The phase difference function $\Delta f(\omega ct)$ obtained by processes (1) to (4) is stored in ROM 22.

By storing phase difference function $\Delta f(\omega ct)$ found for each of waveform outputs e shown in FIGS. 13A through FIG. 15C in modulation wave ROM 22 so that they may selectively be read as required and setting the value of modulation index I(t) used in MUL 23 at 1, various waveform outputs e will be obtained.

Next, a case where modulation index I(t) is varied in FIG. 10 will be considered.

Figures 16A, 16B, 16C, 16D:
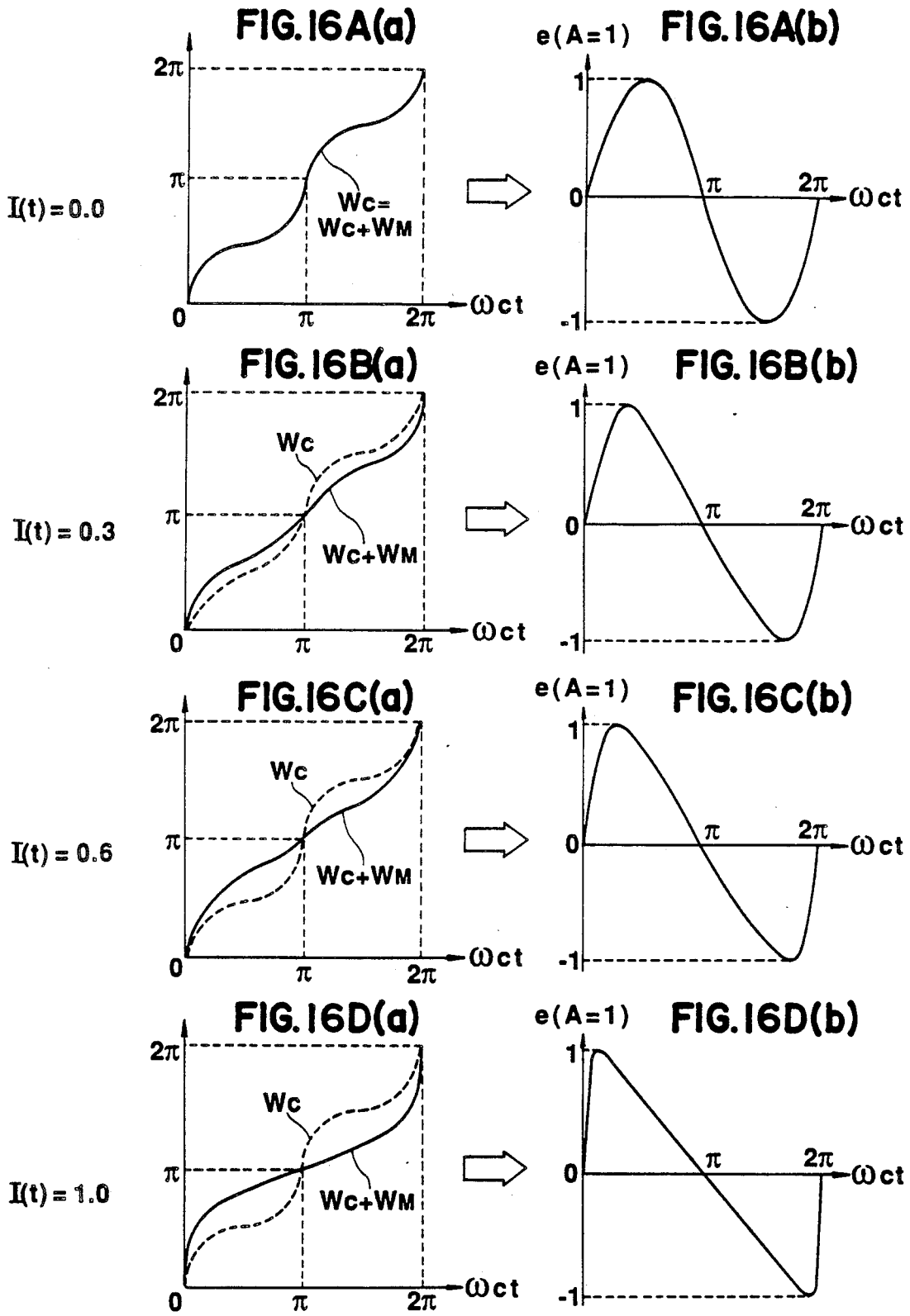
FIGS. 16(*a*) to 16(*b*) illustrate a relation among Wc, $Wc+W_M$ and e when I(t) is varied.

First, if I(t)=0.0 (unchanged with time), then $Wc+W_M=Wc$ results as shown in FIG. 16A. In this case, an unmodulated sine wave output e is obtained.

By varying modulation index I(t) to 0.3, 0.6 and 1.0 (unchanged with time), correspondingly deeply modulated outputs e are obtained as shown in FIGS. 16B, 16C and 16D.

By varying the value of modulation index I(t) in this way, various modulated waveforms from a sine wave to an original waveform are obtained. Also, by varying modulating index I(t) continuously during a time period from when tone generation is initiated until the tone has faded away, it is possible to obtain a waveform output e which changes from a deeply modulated waveform to a sine wave as a musical sound decays. Moreover, if the modulation index is set at more than 1, a more deeply modulated waveform output e will be obtained.

Examples of other combinations of decoder 25 and carrier wave ROM 21 in the principle of the second embodiment With the above principle of the musical sound waveform generator, for decoder 25 having the characteristic defined by equation (12) or shown in by relation B in FIG. 12, such a carrier signal Wc, which is defined by equation (8) or shown in FIG. 11 or by relation A in FIG. 12, as allows a sine waveform output e to be outputted from decoder 25 is stored in carrier wave ROM 21, thereby producing a single sine wave. When I(t)=0 in particular, a sine wave is obtained as waveform output e on the basis of equation (11).

By storing such a phase difference function $\Delta f(\omega ct)$ as shown in FIG. 13A, 14A or 15A in carrier wave ROM 22 and setting modulation index I(t)=1 in equation (10), such a desired waveform output e as shown in FIG. 13C, 14C or 15C will be obtained.

If, therefore, a sine wave is obtained when I(t) =0 and a desired waveform output e is obtained when I(t)=1, then a combination of the characteristic of decoder 25 and the characteristic of carrier signal WC stored in carrier wave ROM 21 need not limited to the one of the characteristic defined by equation (12) or shown by B in FIG. 12 and the characteristic defined by equation (8) or shown in FIG. 11 or shown by A in FIG. 12. The same effect will be obtained by causing decoder 25 to perform an arithmetic operation of a function which contains harmonic components from the beginning, storing such a function as allows decoded output D to be a sine wave in carrier wave ROM 21 and storing such a phase difference function $\Delta f(\omega ct)$ as allows waveform output e to be a desired waveform in modulation wave ROM 22. FIGS. 17A through 17D illustrate exemplary combinations of a function calculated by decoder 25 and a function stored in carrier wave ROM 21. A function which relates carrier wave phase angle $\omega ct$ and carrier signal WC is stored in carrier wave ROM 21, and a function which relates input x and decoder output D is calculated by decoder 25. The characteristics corresponding to FIGS. 17A to 17D will be illustrated below.

Figure 17A:
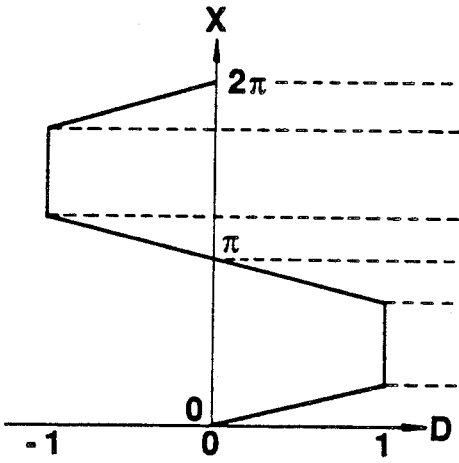
FIGS. 17(*a*) to 17(*b*) illustrate other examples of stored waveforms in the carrier wave ROM and triangular wave decoder.
Figure 17A:
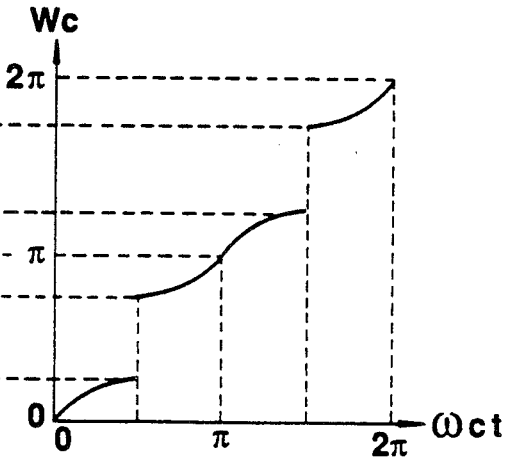

First, a function calculated by decoder 25 in correspondence with FIG. 17A is represented by $$\begin{aligned} D &= (4/\pi)x && \ldots\ (0 \leqq x \leqq \pi/4) \\ D &= 1 && \ldots\ (\pi/4 \leqq x \leqq 3\pi/4) \\ D &= -(4/\pi)x + 4 && \ldots\ (3\pi/4 \leqq x \leqq 5\pi/4) \\ D &= -1 && \ldots\ (5\pi/4 \leqq x \leqq 7\pi/4) \\ D &= (4/\pi)x - 8 && \ldots\ (7\pi/4 \leqq x \leqq 2\pi) \end{aligned} \tag{14}$$

A function stored in carrier wave ROM 21 in correspondence with FIG. 17A is represented by $$\begin{aligned} W_c &= (\pi/4)\sin\omega_{ct} \ldots (0 \leqq \omega_{ct} \leqq \pi/2) \\ W_c &= -(\pi/4)\sin\omega_{ct} + \pi \ldots (\pi/2 \leqq \omega_{ct} \leqq 3\pi/2) \\ W_c &= (\pi/4)\sin\omega_{ct} + 2\pi \ldots (3\pi/2 \leqq \omega_{ct} \leqq 2\pi) \end{aligned} \tag{15}$$

Figure 17B:
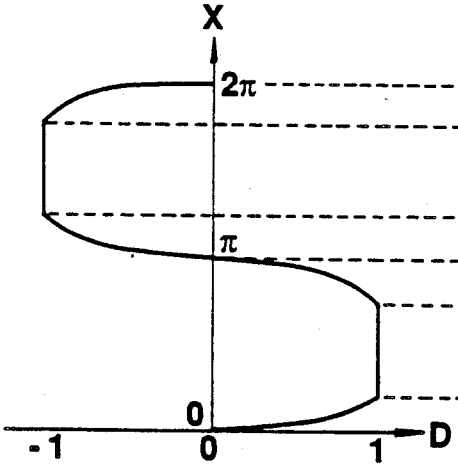
Figure 17B:
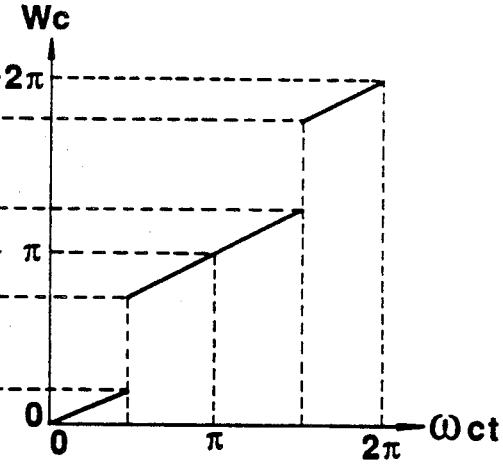

A function calculated by decoder 25 in correspondence with FIG. 17B is represented by $$\begin{aligned} D &= \sin 2x && \ldots\ (0 \leqq x \leqq \pi/4) \\ D &= 1 && \ldots\ (\pi/4 \leqq x \leqq 3\pi/4) \\ D &= \sin(2x - \pi) && \ldots\ (3\pi/4 \leqq x \leqq 5\pi/4) \\ D &= -1 && \ldots\ (5\pi/4 \leqq x \leqq 7\pi/4) \\ D &= \sin(2x - 2\pi) && \ldots\ (7\pi/4 \leqq x \leqq 2\pi) \end{aligned} \tag{16}$$

A function stored in carrier wave ROM 21 in correspondence with FIG. 17B is represented by $$W_c = \omega_{ct}/2 \quad \ldots \quad (0 \leqq \omega_{ct} \leqq \pi/2) \tag{17}$$
$$W_c = \omega_{ct}/2 + \pi/2 \quad \ldots \quad (\pi/2 \leqq \omega_{ct} \leqq 3\pi/2)$$
$$W_c = \omega_{ct}/2 + \pi \quad \ldots \quad (3\pi/2 \leqq \omega_{ct} \leqq 2\pi)$$

Figure 17C:
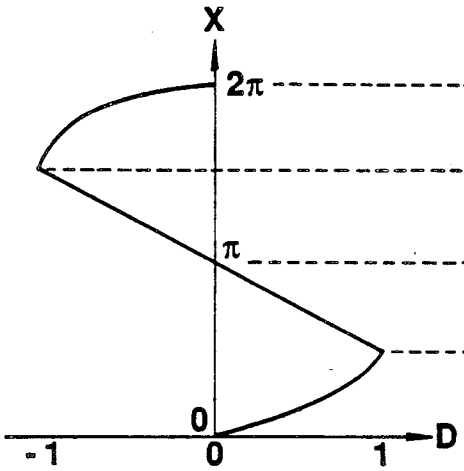
Figure 17C:
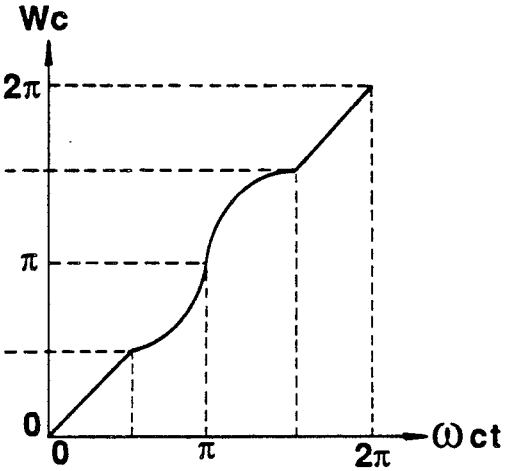

A function calculated by decoder 25 in correspondence with FIG. 17C is represented by $$D = \sin x \quad \ldots \quad (0 \leqq x \leqq \pi/2) \tag{18}$$
$$D = -(2/\pi)x + 2 \quad \ldots \quad (\pi/2 \leqq x \leqq 3\pi/2)$$
$$D = \sin x \quad \ldots \quad (3\pi/2 \leqq x \leqq 2\pi)$$

A function stored in carrier wave ROM 21 in correspondence with FIG. 17C is represented by $$W_c = \omega_{ct} \quad \ldots \quad (0 \leqq \omega_{ct} \leqq \pi/2) \tag{19}$$
$$W_c = -(\pi/2)\sin\omega_{ct} + \pi \quad \ldots \quad (\pi/2 \leqq \omega_{ct} \leqq 3\pi/2)$$
$$W_c = \omega_{ct} \quad \ldots \quad (3\pi/2 \leqq \omega_{ct} \leqq 2\pi)$$

Figure 17D:
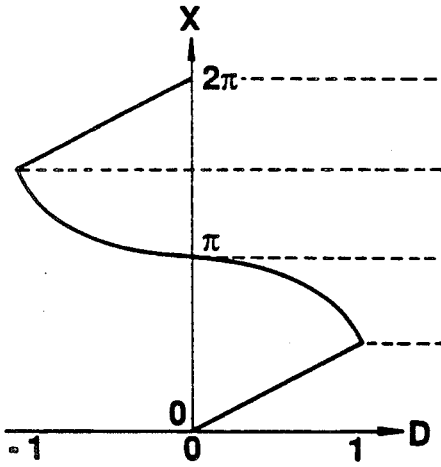
Figure 17D:
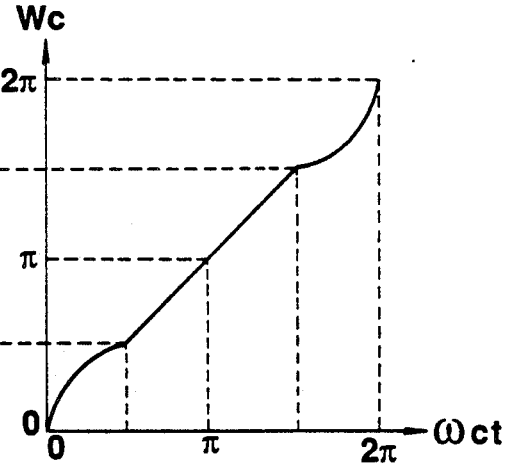

A function calculated by decoder 25 in correspondence with FIG. 17D is represented by $$D = (2/\pi)x \quad \ldots \quad (0 \leqq x \leqq \pi/2) \tag{20}$$
$$D = \sin x \quad \ldots \quad (\pi/2 \leqq x \leqq 3\pi/2)$$
$$D = (2/\pi)x - 4 \quad \ldots \quad (3\pi/2 \leqq x \leqq 2\pi)$$

A function stored in carrier wave ROM 21 in correspondence with FIG. 17D is represented by $$W_c = (\pi/2)\sin\omega_{ct} \quad \ldots \quad (0 \leqq \omega_{ct} \leqq \pi/2) \tag{21}$$
$$W_c = \omega_{ct} \quad \ldots \quad (\pi/2 \leqq \omega_{ct} \leqq 3\pi/2)$$
$$W_c = (\pi/2)\sin\omega_{ct} + 2\pi \quad \ldots \quad (3\pi/2 \leqq \omega_{ct} \leqq 2\pi)$$

In the combination of equations (14) and (15), (16) and (17), (18) and (19) or (20) and (21), when modulation index I(t) for MUL 23 is set at 0, carrier signal Wc from carrier wave ROM 21 is applied to decoder 25 as input x so that a sine wave is outputted as waveform output e.

In order to obtain a desired waveform output, such as a sawtooth wave, a rectangular wave or nonsymmetrical wave, in accordance with a decoder function shown in each of FIG. 17A to 17D with modulation index I(t) set at 1, phase difference function $\Delta f(\omega ct)$ has only to be determined in accordance with the procedure (1)–(4) described in connection with FIGS. 13A through 15C and then stored in modulation wave ROM 22.

Although amplitude coefficient A used for multiplication in MUL 26 of FIG. 10 has been explained as being a fixed value, in practice it may be varied with time. Thereby, an amplitude modulated envelope characteristic can be imparted to a musical sound.

Figure 18:
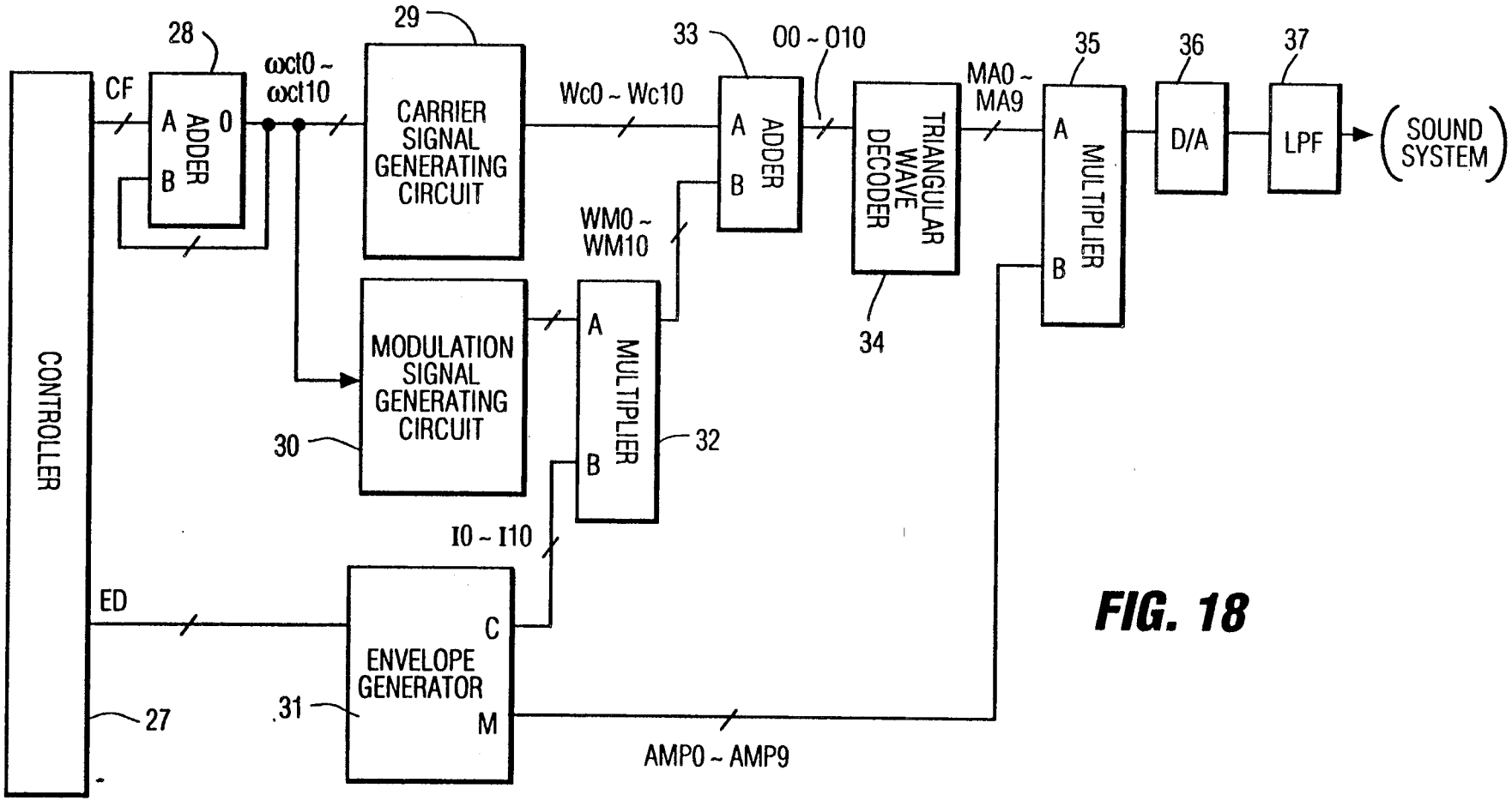
FIG. 18 illustrates a specific arrangement of the musical sound waveform generator of a second embodiment of the present invention.

Specific arrangement of the second embodiment of the musical sound waveform generator FIG. 18 illustrates a specific arrangement of the musical sound waveform generator of the second embodiment. The specific arrangement is based on the principle of the second embodiment shown in FIG. 10 and thus in the following description FIG. 10 and so on will also be referred to as needed.

A controller 27 is adapted to generate and output a carrier frequency CF and envelope data ED (data on rate values, amplitude values and so on of an envelope) in accordance with a setting state in a parameter setting section and an operation on a keyboard which are not shown.

An adder 28 receives carrier frequency CF at its addend input A and feeds its output 0 back to its augend input B so that 10-bit carrier wave phase angle ωct0 to ωct10 progressively increases by the step width of the carrier frequency, thereby constituting an accumulator. Carrier wave phase angle ωct0 to ωct10 corresponds to carrier wave phase angle ωct in FIG. 10. Also, carrier frequency CF corresponds to angular velocity ωc of carrier wave phase angle ωct.

Carrier wave phase angle ωct0 to ωct10 is applied to a carrier signal generating circuit 29 and a modulation signal generating circuit 30 as an address signal. Note that carrier signal generating circuit 29 and modulation signal generating circuit 30 correspond to carrier wave ROM 21 and modulation wave phase angle ROM 22 of FIG. 10, respectively.

Responsive to envelope data ED from controller 27, on the other hand, envelope generator 31 outputs a 11-bit modulation index I0 to I10 and a 10-bit amplitude coefficient AMP0 to AMP9 at its outputs C and M. The modulation index and the amplitude coefficient correspond to modulation index I(t) and amplitude coefficient A of FIG. 10, respectively, and they can both vary with time.

Modulation index I0 to I10 assumes a value of 1 or below and is inputted to terminal B of multiplier 32 where it is multiplied by the output of modulation signal generating circuit 30 applied to its terminal A, to thereby produce a 11-bit modulation signal $W_M0$ to $W_M10$. It is to be noted here that multiplier 32 and modulation signal $W_M0$ to $W_M10$ correspond to MUL 23 and modulation signal $W_M$ of FIG. 10, respectively.

Carrier signal Wc0 to Wc10 from carrier signal generating circuit 29 and modulation signal $W_M0$ to $W_M10$ from multiplier 32 are applied to inputs A and B of adder 33 where they are added together, thereby producing a 11-bit added waveform O0 to O10. Adder 33 and added waveform O0 to O10 correspond to ADD 24 and added waveform $Wc+W_M$, respectively, of FIG. 10.

Added waveform O0 to O10 serves as an address signal for triangular wave decoder 34 to output a 10-bit decoded output MA0 to MA9. Triangular wave decoder 34 and decoded output MA0 to MA9 correspond to decoder 25 and decoded output D of FIG. 10, respectively.

Decoded output MA0 to MA9 is inputted to an input A of multiplier 35 where it is multiplied by amplitude coefficient AMP0 to AMP9 applied to its input B for amplitude modulation. Note that amplitude coefficient AMP0 to AMP9 assumes a value of 1 or below.

A digital musical sound signal generated in such a manner is converted to an analog musical sound signal by means of D/A converter 36 and lowpass filter 37 and then sounded by a sound system not shown.

According to the above arrangement, by controlling carrier frequency CF and envelope data ED outputted from controller 27 in response to a performance operation by a player, musical sounds which have been controlled in tone pitch, tone volume, tone color, etc. on the basis of the performance operation can be sounded in exactly the same manner as the musical sound waveform generator of FIG. 10.

Figure 19:
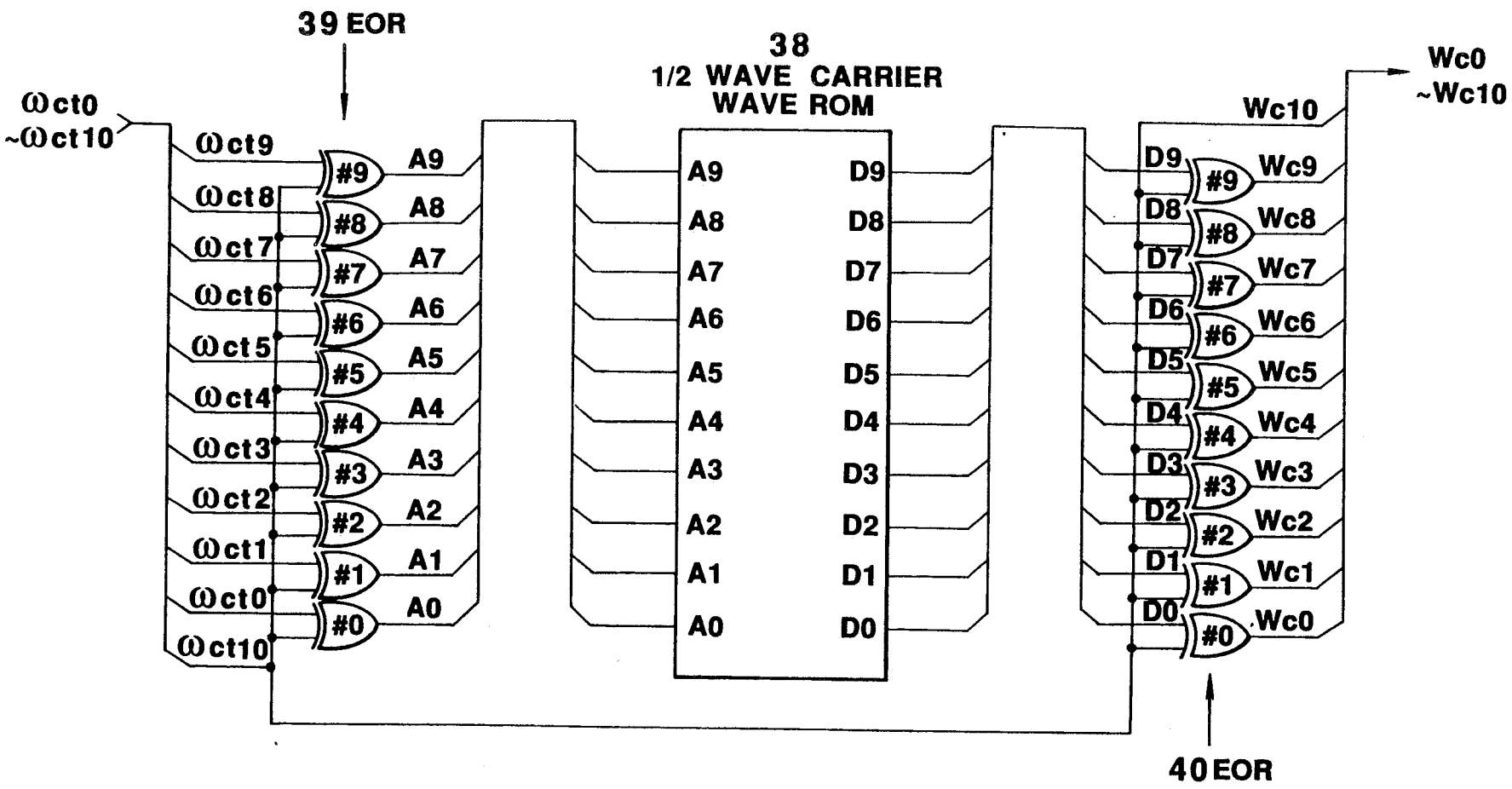
FIG. 19 illustrates an arrangement of a first embodiment of the carrier signal generating circuit.

FIG. 19 illustrates a first example of carrier signal generating circuit 29 of FIG. 18.

Exclusive OR circuits (hereinafter referred to as EORs) 39 (#0 to #9) receive most significant bit carrier wave phase angle ωct10 from adder 28 of FIG. 18 at their first inputs and receive at their second inputs carrier wave phase angle bits ωct0 to ωct9, respectively. Outputs A0 to A9 of #0 to #9 EORs 39 are inputted to ½ wave carrier wave ROM 38 as its address signal.

Outputs D0 to D9 of ½ wave carrier wave ROM 38 are inputted to the first inputs of #0 to #9 EORs 40, respectively. Most significant bit carrier wave phase angle ωct10 is inputted to the second inputs of EORs 40.

The outputs of EORs 40 and the most significant bit carrier wave phase angle ωct10 are applied to adder 33 of FIG. 18 as a carrier signal Wc0 to Wc10.

The operation of the above example will be described with reference to FIG. 20.

In ½ wave carrier wave ROM 38 of FIG. 19 is stored a waveform corresponding to the ½ period (0−π[rad]) of carrier signal Wc explained in connection with FIG. 11 or equation (8). That is, assuming that a value determined by outputs D0 to D9 of ½ wave carrier wave ROM 38 of FIG. 19 in accordance with equation (8) to be Y1, a waveform is stored which is expressed by $$Y1 = (\pi/2)\sin\omega_{ct} \quad \ldots \quad (0 \leqq \omega_{ct} \leqq \pi/2) \qquad (22)$$
$$Y1 = \pi - (\pi/2)\sin\omega_{ct} \quad \ldots \quad (\pi/2 \leqq \omega_{ct} \leqq \pi)$$

In this expression carrier wave phase angle ωct refers to a value determined by ωct0 to ωct9.

Carrier wave phase angle ωct0 to ωct10 from adder 28 of FIG. 10 can specify any phase angle. More specifically, any phase angle in the range 0 to π [rad] can be specified by full range of lower-order 10 bits ωct0 to w ct9 when most significant bit ωct10 is at logic 0 and moreover any phase angle in the range π to 2π [rad] can be specified by full range of lower-order 10 bits ωct0 to ωct9 when most significant bit ωct10 is at logic 1.

Figure 20:
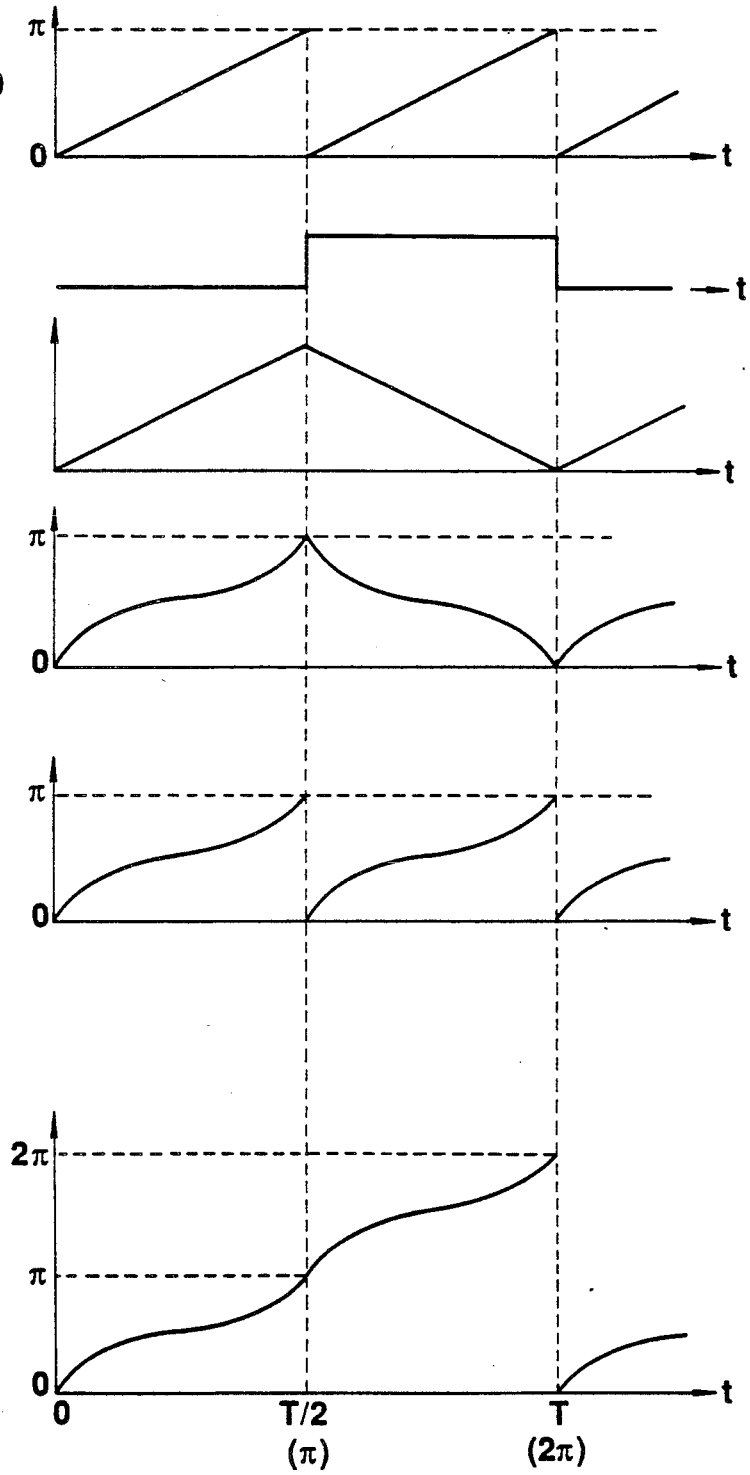
FIG. 20 is a diagram for explaining the operation of the carrier signal generating circuit of FIG. 19.

Supposing now that a time period taken for carrier wave phase angle ωct0 to ωct10 to reach its full range is T, lower order 10 bits ωct0 to ωct9 reach their full range in a time period 0 to T/2 as shown in FIG. 20(*a*) when the most significant bit ωct10 is at logic 0 as shown in FIG. 20(*b*). At this point most significant bit ωct10 at logic 0 is applied to the first inputs of #0 to #9 EORs 39. Thus, when lower-order 10-bit carrier wave phase angle ωct0 to ωct9 progressively increases during a time period from 0 to T/2, address signal A0 to A9 also increases correspondingly. As a result, a waveform ranging in phase from 0 to π [rad] and based on equation (22) is read from outputs D0 to D9 of ½ wave carrier wave ROM 38 of FIG. 19 as shown in FIG. 20(*d*). This waveform output is applied to the first inputs of EORs 40 the second inputs of which are supplied with most significant bit ωct10 at logic 0. Thus, as shown in FIG. 20(*e*), the lower 10-bit carrier signal ωct0 to mct9 assumes the same waveform as that at outputs DO to D9 shown in FIG. 20(*d*). Since most significant bit carrier signal Wc10 is at logic 0 as is most significant bit ωct10, exactly the same waveform as that outputted at D0 to D9 is outputted as carrier signal Wc0 to Wc10 during time period from 0 to T/2 as shown in FIG. 20(*f*).

Next, during a time period T/2 to T, most significant bit carrier wave phase angle ωct10 is at logic 1 as shown in FIG. 20(*b*) and the full range of lower 10-bit carrier wave phase angle ωct0 to ωct9 is specified. At this point most significant bit carrier wave phase angle ωct10 at logic 1 is applied to the first inputs of EORs 39. Thus, address signal A0 to A9 is obtained which decreases, as shown in FIG. 20(*d*), in the opposite relationship to lower 10-bit carrier wave phase angle ωct0 to ωct9 which increases in value during time period from T/2 to T. As a result, the waveform ranging from 0 to π [rad] and based on equation (22) is read from outputs D0 to D9 of ½ wave carrier wave ROM 38 in the opposite direction as shown in FIG. 20(*d*). This waveform output is applied to the first inputs of EORs 40. Since, at this point, most significant bit carrier wave phase angle ωct10 at logic 1 is applied to the second inputs of EORs 40, lower 10-bit carrier signal Wc0 to Wc9 becomes a waveform which is, as shown in FIG. 20(*e*), an inverse of the output waveform at D0 to D9 shown in FIG. 20(*d*). In addition to this, since most significant bit carrier signal Wc10 is at logic 1 as is most significant bit carrier wave phase angle ωct10, the offset of π [rad] corresponding to the full range of lower 10-bit carrier wave phase angle ωct0 to ωct9 is superimposed upon the above output. Consequently such a waveform as shown in FIG. 20(*f*) is outputted as carrier signal Wc0 to Wc10 during a time period from T/2 to T.

As can be seen from the above operation, a waveform outputted during a time period from 0 to T is exactly the same as that of carrier signal described in connection with FIG. 11 or equation (8). In the case of this example, a waveform corresponding to the half period of the waveform of FIG. 11 has only to be stored in ½ wave carrier wave ROM 38 of FIG. 19. Accordingly, the memory capacity can be reduced to the half in comparison with the case where a waveform for one period is stored.

Figure 21:
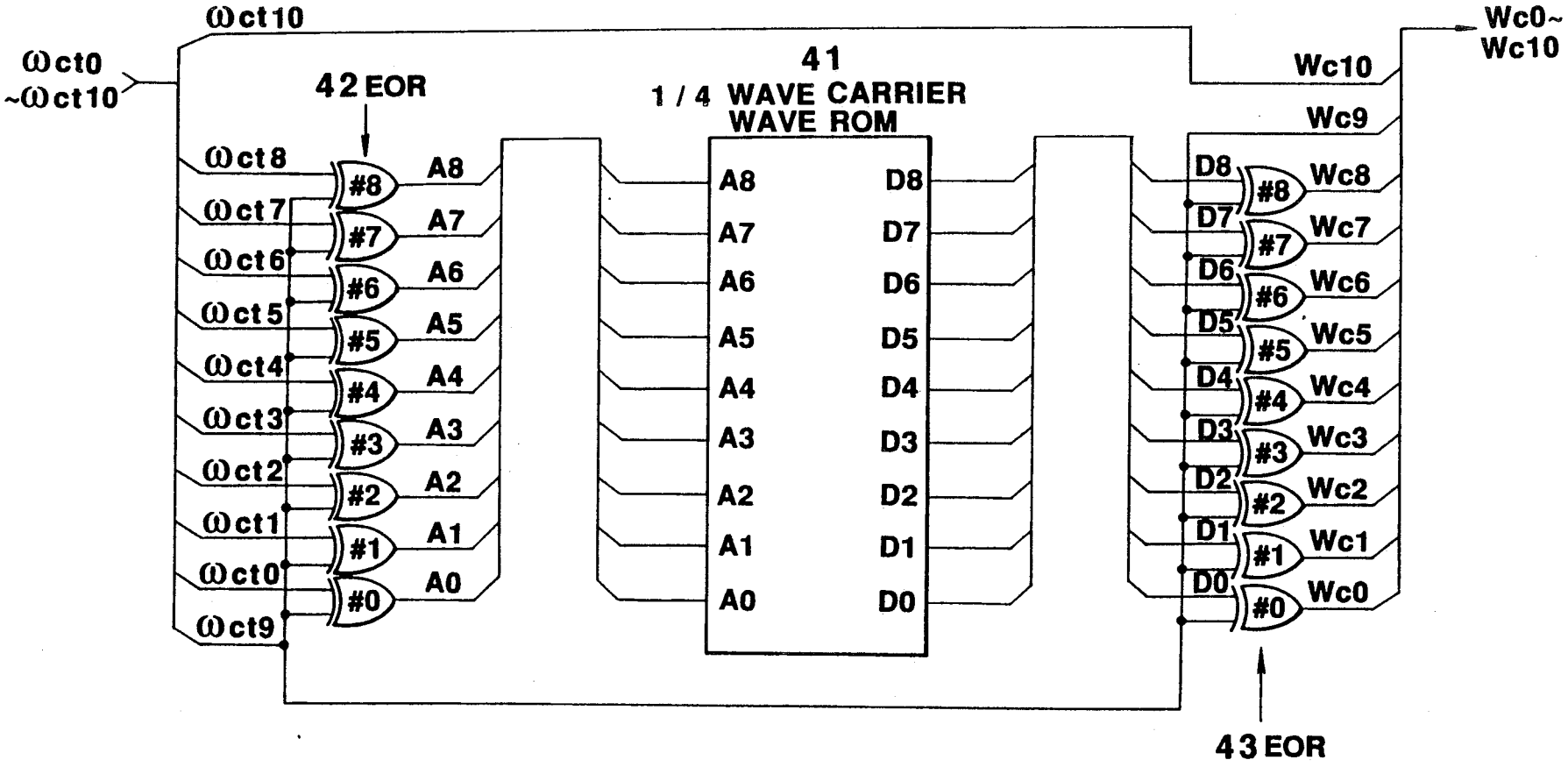
FIG. 21 illustrates an arrangement of a second embodiment of the carrier signal generating circuit.

FIG. 21 illustrates a second example of carrier signal generating circuit 29 of FIG. 18.

#0 to #8 EORs 42 receive 10th-bit carrier wave phase angle ωct9 from adder 28 of FIG. 18 at their first inputs and 0th to 8th-bit carrier wave phase angle ωct0 to ωct8 at their second inputs. Outputs A0 to A8 of EORs 42 serve as an address signal to ¼ wave carrier wave ROM 41.

Outputs D0 to D8 of ¼ wave carrier wave ROM 41 are coupled to first inputs of #0 to #8 EORs 43, respectively. EORs 43 receive 10th-bit carrier wave phase angle &Xct9 at their second inputs.

Outputs of EOR43, 10th-bit carrier wave phase angle ωct9 and most significant bit carrier wave phase angle ωct10 are applied to adder 33 of FIG. 18 as carrier signal Wc0 to Wc10.

The operation of the second example of the carrier signal generating circuit will be described with reference to FIG. 22.

In ¼ wave carrier wave ROM 41 of FIG. 21 is stored a waveform corresponding to one-quarter period (0 to π/2 [rad]) of carrier signal Wc described in connection with FIG. 11 or equation (8). That is, assuming that a value determined by outputs D0 to D9 of ¼ wave carrier wave ROM 41 of FIG. 21 in accordance with equation (8) to be Y1, a waveform is stored which is expressed by $$Y2 = (\pi/2)\sin\omega_{ct} \ldots (0 \leqq \omega_{ct} \leqq \pi/2) \qquad (23)$$

In this expression carrier wave phase angle ωct refers to a value determined by ωct0 to ωct8.

Carrier wave phase angle ωct0 to ωct10 from adder 28 of FIG. 18 can specify any phase angle. More specifically, any phase angle in the range 0 to $\pi/2$ [rad] can be specified by lower-order 9 bits ωct0 to ωct8 when a logical combination of most significant bit ωct10 and 10th-bit ωct9 is (0, 0). Any phase angle in the range $\pi/2$ to $\pi$ [rad] can be specified by lower-order 9 bits ωct0 to ωct8 when the logical combination is (0, 1). Furthermore, any phase angle in the range $\pi$ to $3\pi/2$ [rad] can be specified when the logical combination is (1, 0). In addition, any phase angle in the range $3\pi/2$ to $2\pi$ [rad] can be specified when the logical combination is (1, 1). Hereinafter a description will be given of each of the above four cases.

Figure 22:
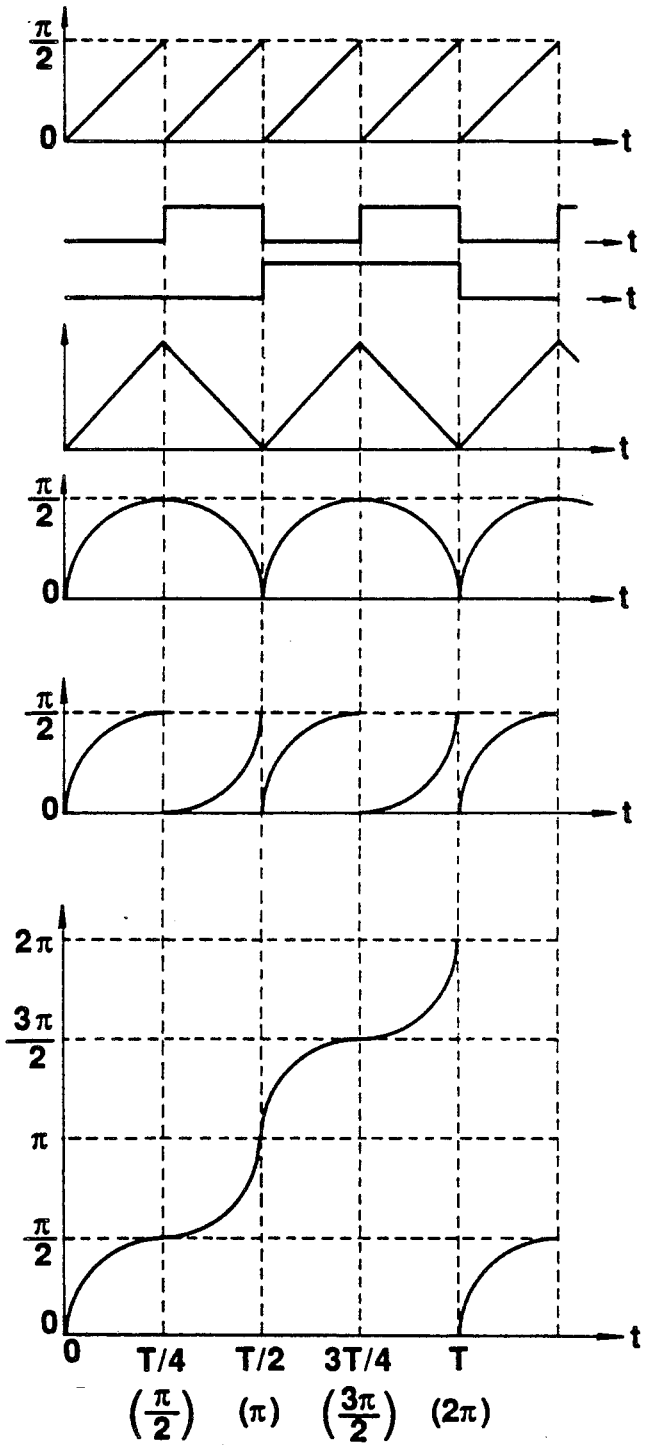
FIG. 22 is a diagram for explaining the operation of the carrier signal generating circuit of FIG. 21.

Assuming the time required for 11-bit carrier wave phase angle ωct0 to ωct10 to reach its full range to be T, a time period in which 9-bit carrier wave phase angle ωct0 to ωct8 reaches its full range in the first case where (ωct10, ωct9)=(0, 0) is 0 to T/4 as shown in FIG. 22(*b*) and (*c*). Since, during this time period 0 to T/4, 10th-bit carrier wave phase angle ωct9 at logic 0 is applied to the first inputs of #0 to #8 EORs 42, address signal A0 to A8 is obtained which increases with time as shown in FIG. 22(*d*) as does lower 9-bit carrier wave phase angle ωct0 to ωct8. As a result, a waveform ranging from 0 to $\pi/2$ [rad] and based on equation (23) is read from outputs D0 to D8 of ¼ wave carrier wave ROM 41 as shown in FIG. 22(*e*). Although this waveform output is applied to the first inputs of #0 to #8 EORs 43, 10th-bit carrier wave phase angle ωct9 at logic 0 is applied to the second inputs of all of EORs 43. Thus, lower 9-bit carrier signal Wc0 to Wc8 from EORs 43 exhibits exactly the same waveform as that at outputs D0 to D8 as shown in FIG. 22(*f*). Moreover, since 10th-bit and most significant bit carrier signal Wc9 and Wc10 are both at logic 0 as are 10th-bit and most significant bit carrier wave phase angle ωct9 and ωct10, exactly the same waveform as that at outputs D0 to D8 is outputted as 10-bit carrier signal Wc0 to Wc10 during time period 0 to T/4 as shown in FIG. 22(*g*).

Next, the second case where (ωct10, ωct9)=(0, 1) corresponds to a time period from T/4 to T/2 as shown in FIG. 22(*b*) and (*c*). Since, during this time period T/4 to T/2, 10th-bit carrier wave phase angle ωct9 at logic 1 is applied to the first inputs of #0 to #8 EORs 42, address signal A0 to A8 is obtained which decreases with time as shown in FIG. 22(*d*) as opposed to lower 9-bit carrier wave phase angle ωct0 to ωct8 which increases with time. As a result, a waveform ranging from 0 to $\pi/2$ [rad] and based on equation (23) is read in the opposite direction from outputs D0 to D8 of ¼ wave carrier wave ROM 41 as shown in FIG. 22(*e*). Although this waveform output is applied to the first inputs of #0 to #8 EORs 43, 10th-bit carrier wave phase angle ωct9 at logic 1 is applied to the second inputs of all of EORs 43. Thus, as shown in FIG. 22(*f*), lower 9-bit carrier signal Wc0 to Wc8 from EORs 43 exhibits a waveform which is an inverse of that at outputs D0 to D8 shown in FIG. 22(*e*). Moreover, since the 10th bit and the most significant bit of the carrier signal, Wc9 and Wc10, are both at logic 0 as are the 10th bit and the most significant bit of the carrier wave phase angle, ωct9 and ωct10, an offset of $\pi/2$ [rad] corresponding to the full range of lower 10-bit carrier wave phase angle ωct0 to ωct9 is superimposed upon the above output. As a result, such a waveform as shown in time period from T/4 to T/2 of FIG. 22(*g*) is outputted as 10-bit carrier signal Wc0 to Wc10.

Subsequently, the third case where (ωct10, ωct9)=(1, 0) corresponds to a time period from T/2 to 3T/4 as shown in FIG. 22(*b*) and (*c*). Since, during this time period T/2 to 3T/4, 10th-bit carrier wave phase angle ωct9 is at logic 1, EORs 42, ¼ wave carrier wave ROM 41 and EORs 43 operate in exactly the same manner as in the first case. Thus, as lower 9-bit carrier signal Wc0 to Wc8 from EORs 43, a waveform is obtained which is, as shown in FIG. 22(*f*), exactly the same as that at outputs D0 to D8 shown in FIG. 22(*e*). Moreover, since the 10th bit and the most significant bit of the carrier signal, Wc9 and Wc10, are at logic 0 and at logic 1, respectively, as are the 10th bit and the most significant bit of the carrier wave phase angle, ωct9 and ωct10, an offset of $\pi$[rad] corresponding to twice the full range of lower 9-bit carrier wave phase angle ωct0 to ωct8 is superimposed upon the above output. As a result, such a waveform as shown in time period from T/2 to 3T/4 of FIG. 22(*g*) is outputted as 10-bit carrier signal Wc0 to Wc10.

Finally, the fourth case where (ωct10, ωct9)=(1, 1) corresponds to a time period from 3T/4 to T as in FIG. 22(*b*) and (*c*). Since, during this time period, 10th-bit carrier wave phase angle ωct9 is at logic 1, EORs 42, ¼ wave carrier wave ROM 41 and EORs 43 operate in exactly the same manner as in the second case. Thus, as lower 9-bit carrier signal Wc0 to Wc8 from EORs 43, a waveform is obtained which is, as shown in FIG. 22(*f*), an inverse of that at outputs D0 to D8 shown in FIG. 22(*e*). Moreover, since the 10th bit and the most significant bit of the carrier signal, Wc9 and Wc10, are both at logic 1 as are the 10th bit and the most significant bit of the carrier wave phase angle, ωct9 and ωct10, an offset of $3\pi/2$ [rad] corresponding to triple the full range of lower 9-bit carrier wave phase angle ωct0 to ωct8 is superimposed upon the above output. As a result, such a waveform as shown in time period from 3T/4 to T of FIG. 22(*g*) is outputted as 10-bit carrier signal Wc0 to Wc10.

As can be seen from the above operation, a waveform outputted during the time period 0 to T is exactly the same as that carrier signal Wc described in connection with FIG. 11 and equation (8). In the second example, ¼ wave carrier wave ROM 41 of FIG. 21 has only to store a waveform corresponding to one fourth of its full period. Thus, the storage capacity can be reduced to one half of that in the first example and to one fourth of that in the case where a waveform is stored over its full period.

Figure 23:
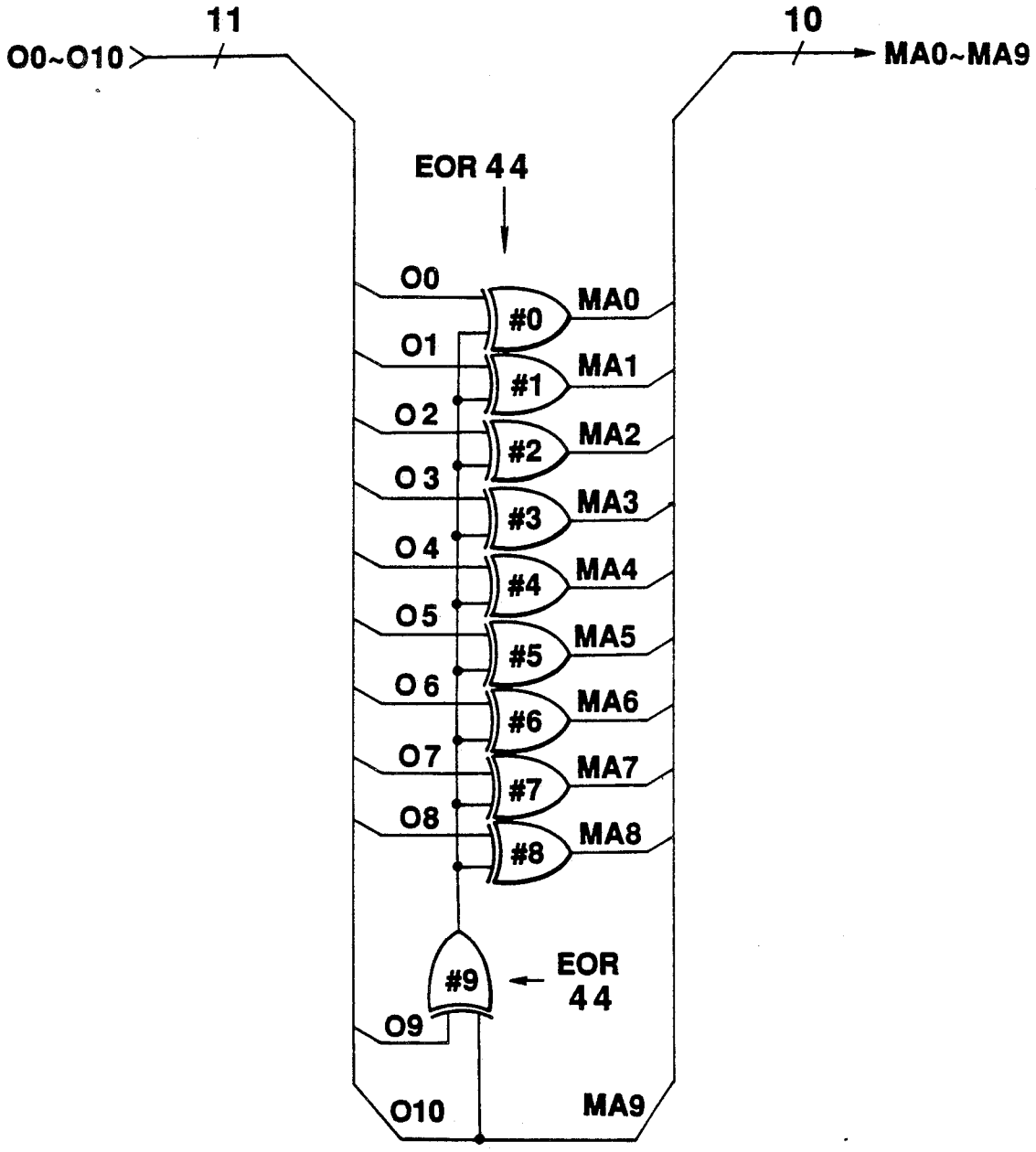
FIG. 23 illustrates an arrangement of the triangular wave decoder.

FIG. 23 illustrates an example of triangular wave decoder 34 of FIG. 18.

The 10th bit 09 and most significant bit 010 of the added waveform from adder 33 are inputted to respective inputs of #9 EOR 44 the output of which is coupled to first inputs of #0 to #8 EORs 44. The 0th to 8th bits O0 to O8 of the added waveform are applied to the second inputs of #0 to #8 EORs 44. The outputs of #0 to #8 EORs serving as decoded outputs MA0 to MA8 and the most significant bit 010 of the added waveform serving as the most significant bit decoded output MA9 representing a sign are outputted to multiplier 35 of FIG. 18.

The operation of the triangular wave decoder of FIG. 23 will be described below.

It is assumed that a value Z determined by added waveform O0 to O10 increases linearly with time and any phase angle in the range from 0 to $2\pi$ [rad] corresponding to one period can be designated by the full range of added waveform O0 to O10. In a first case where a logical combination (O10, O9) of most significant bit 010 and 10th bit 09 of the added waveform is (0, 0), the value of added waveform O0 to O10 varies from 0 to one-quarter the full range, namely, $\pi/2$ [rad]. In this range the output of #9 EOR 44 is at logic 0. Thus, as added waveform O0 to O8 applied to #0 to #8 EORs 44 increases with time, exactly the same waveform as O0 to O8 appears at lower 9-bit decoded outputs MA0 to MA8. Furthermore, most significant bit decoded output MA9, which is a sign bit, is at logic 0 as is the most significant bit O10 of the added waveform. Thus, a positive decoded output is produced in the above range. A value W determined by decoded outputs MA0 to MA9 will be given by $$W=Z \text{ where } (0 \leqq Z \leqq \pi/2) \quad (24)$$

In a second case where (010, 09) is (0, 1), the value of added waveform O0 to O10 varies from $\pi/2$ to $\pi$ [rad]. In this range the output of #9 EOR 44 is at logic 1. Thus, as added waveform O0 to O8 applied to #0 to #8 EORs 44 increases with time, a waveform which decreases with time in contrast with O0 to O8 appears at lower 9-bit decoded outputs MA0 to MA8. Furthermore, most significant bit decoded output MA9 is at logic 0 as is the most significant bit O010 of the added waveform. Thus, a positive decoded output is produced in the above range, which will be given by $$W=-Z+\pi \text{ where } (\pi/2 \leqq Z \leqq \pi) \quad (25)$$

In a third case where (O10, O9) is (1, 0), the value of added waveform O0 to O10 varies from $\pi$ to $3\pi/2$ [rad]. In this range the output of #9 EOR 44 is at logic 1 as in the second case. Thus, as added waveform O0 to O8 applied to #0 to #8 EORs 44 increases with time, a waveform which decreases with time in contrast with O0 to O8 is outputted at lower 9-bit decoded outputs MA0 to MA8. Furthermore, most significant bit decoded output MA9, which is a sign bit, is changed to logic 1 as is the most significant bit O10 of the added waveform. Thus, a negative decoded output is produced in the above range, which will be given by $$W=-Z+\pi \text{ where } (\pi \leqq Z \leqq 3\pi/2) \quad (26)$$

In a fourth case where (O10, O9) is (1, 1), the value of added waveform 00 to 010 varies from $3\pi/2$ to $2\pi$ [rad]. In this range the output of #9 EOR 44 is at logic 1 as in the first case. Thus, as added waveform O0 to O8 applied to #0 to #8 EORs 44 increases with time, a waveform which is exactly the same as O0 to O8 is outputted at lower 9-bit decoded outputs MA0 to MA8. Furthermore, most significant bit decoded output MA9, which is the sign bit, is at logic 1 as is the most significant bit O10 of the added waveform. Thus, a negative decoded output is produced in the above range, which will be given by $$W=Z-2\pi \text{ where } (3\pi/2 \leqq Z \leqq 2\pi) \quad (27)$$

Equations (24) to (27) corresponding to the above four cases will be arranged as follows:

$$W=Z \text{ where } (0 \leqq Z \leqq \pi/2)$$

$$W=-Z+\pi \text{ where } (\pi/2 \leqq Z \leqq 3\pi/2)$$

$$W=Z-2\pi \text{ where } (3\pi/2 \leqq Z \leqq 2\pi) \quad (28)$$

Transforming equation (12) which describes the characteristic of decoder 25 of FIG. 10 yields $$\begin{aligned} D &= (2/\pi)x && \ldots\ (0 \leqq x \leqq \pi/2) \\ D &= (2/\pi)(-x+\pi) && \ldots\ (\pi/2 \leqq x \leqq 3\pi/2) \\ D &= (2/\pi)(x-2\pi) && \ldots\ (3\pi/2 \leqq x \leqq 2\pi) \end{aligned} \quad (29)$$

As a result of comparison between equations (28) and (29), their input and output relations are substantially the same except for a difference of $2/\pi$ in gain therebetween. Thus, it will be appreciated that triangular wave decoder of FIG. 18, which is detailed in FIG. 23, operates in exactly the same manner as decoder 25 of FIG. 10 whose characteristic is represented by equation (12)

Subsequently, modulation signal generating circuit 30 of FIG. 18 corresponds to modulation wave ROM 22 of FIG. 10.

Figure 24:
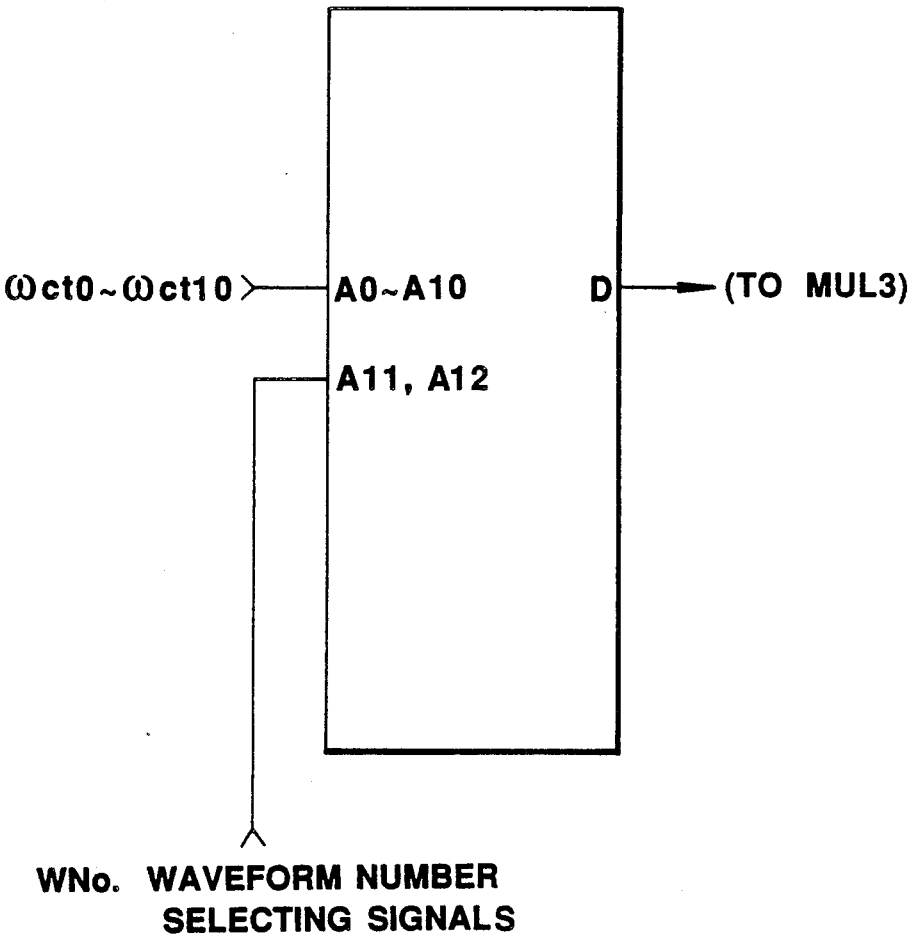
FIG. 24 illustrates an arrangement of the modulation wave ROM.

First, the arrangement of modulation wave ROM 22 is shown in FIG. 24. This ROM has 13-bit address inputs A0 to A12. Two higher-order 2-bit address inputs A11 and A12 are for inputting a value from 0 to 2 (a decimal number) as a waveform number select signal W No. As a result, any one of address areas in which three types of phase difference functions $\Delta f(\omega ct)$ of FIGS. 13A to 15C are stored can be designated. This address designation may be performed by a player as required through a select switch not shown. Controller 27 of FIG. 18 detects the switch state and supplies a corresponding waveform number select signal W No. to modulation signal generating circuit 30.

After a phase difference function $\Delta f(\omega ct)$ has been selected in such a manner, carrier wave phase angle $\omega ct0$ to $\omega ct10$ is inputted from adder 28 of FIG. 18 to lower-order 11 bits A0 to A10. Consequently, modulation signal $W_M0$ to $W_M10$ can be outputted via modulation signal generating circuit 30 and multiplier 32.

Figure 29:
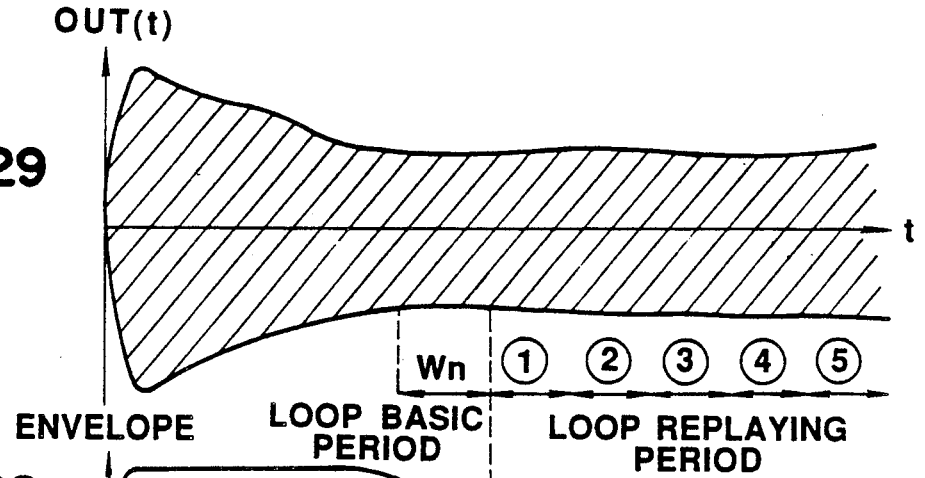
FIGS. 29(*a*) to 29(*e*) are diagrams illustrating the principle of the loop reproduction in the fourth embodiment.
Figure 29:
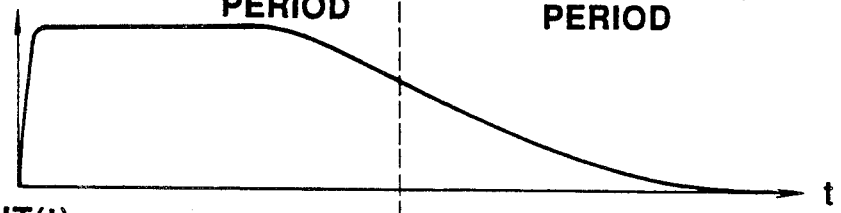
Figure 29:
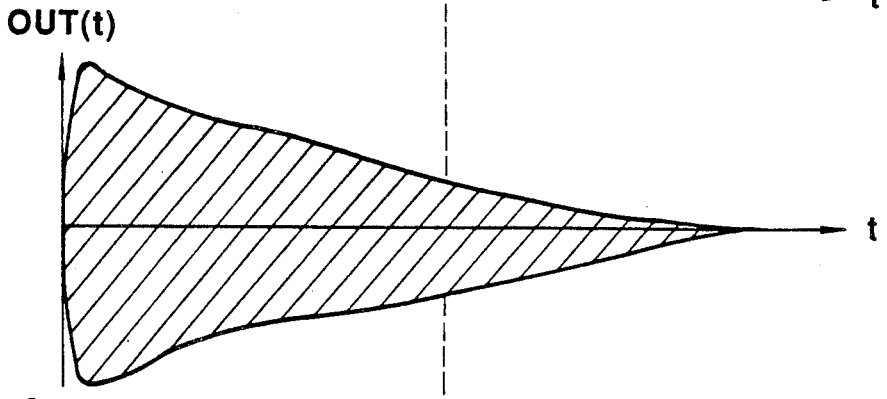
Figure 29:
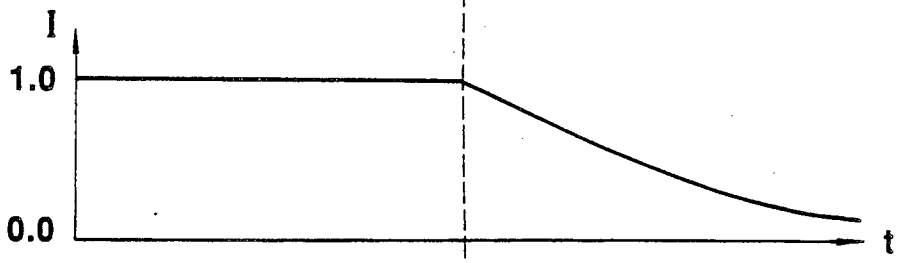
Figure 29:
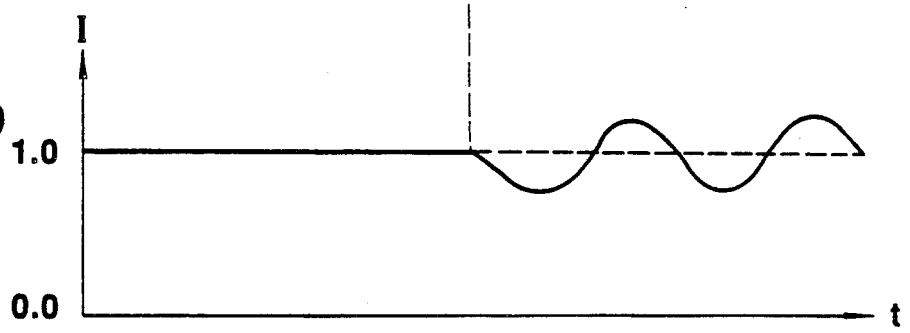

The specific arrangements of carrier signal generating circuit 29, modulation signal generating circuit 30 and triangular wave decoder 34 of FIG. 29 were detailed above. Other circuits, such as adders 28 and 33 and multipliers 32 and 35, can be implemented by well known circuits. Envelope generating circuit 31 can also implemented by using a well known circuit in the field of electronic musical instruments.

The embodiment of FIG. 18 is adapted to generate musical sounds one tone at a time. However, if adder 28, carrier signal generating circuit 29, modulation signal generating circuit 30, envelope generator 31, multiplier 32, adder 33, triangular wave decoder 34 and multiplier 35 were constructed so that they could operate on a time- division basis, and musical sound signals on time-division channels were accumulated at the input stage of D/A converter 36 at sampling periods, then a plurality of musical sounds could be sounded simultaneously.

Third embodiment of the musical sound waveform generator

The principle of the third embodiment is the same as that of the first embodiment described with reference to FIGS. 1 to 5. The specific arrangement of the third embodiment as well is basically the same as that of the first embodiment shown in FIG. 6. The present embodiment is particularly characterized in that the modulation index of FIG. 6 is not only set prior to a performance but also changed in accordance with performance information such as velocity information or tone-range information, to thereby vary the frequency characteristics of musical sound waveform generated in accordance with a performance operation by a player.

Figure 25:
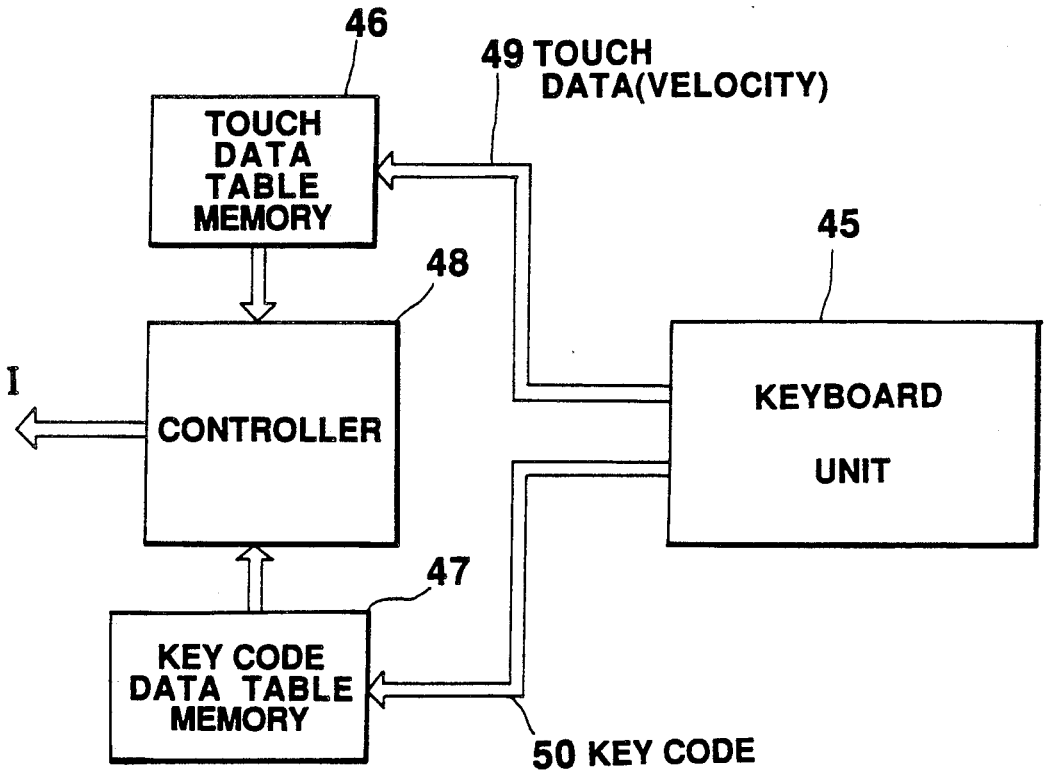
FIG. 25 illustrates an arrangement of a circuit for generating the modulation index I(t) in a third embodiment of the musical sound waveform generator of the present invention.

In the present embodiment, as in the first embodiment of FIG. 6, modulation index I is outputted from a generating circuit shown in FIG. 25 and then latched in latch 16 in synchronism with the rise of start pulse STRT.

In FIG. 25, keyboard unit 45 produces touch data 49 corresponding to a velocity at which a key is depressed by a player and a key code 50 representing the note of the depressed key. Touch data 49 and key code 50 are entered into a touch data table memory 46 and a code data table memory 47, respectively, for conversion to their respective corresponding numeric values. Outputs of table memories 46, 47 are applied to a controller 48 to generate a modulation index I.

By the provision of such a modulation index generating circuit, the following operation is performed when the musical sound waveform generator shown in FIG. 6 is operated on the basis of the timing diagram of FIG. 9 as in the first embodiment.

First, a tone generating operation is performed by depressing any key on the keyboard unit of FIG. 25. As a result, a waveform output OUT(t) having the pitch period corresponding to the note of the depressed key is read from sin ROM 2 as in the first embodiment. For example, when the lowest-note key is depressed, a value of 1 is latched as tone pitch data d. As a result, data is read from each address of FM ROM 11 so that a waveform output of the lowest pitch period is obtained.

In this case, modulation index I latched in latch 16 of FIG. 6 at the time of initiating of tone generation is obtained from the generating circuit of FIG. 25. As described in connection with FIG. 2(*c*) or FIG. 5 of the first embodiment, the modulation index I varies in value. Therefore, various modulated waveforms are obtained which vary from a sine wave to a deeply modulated waveform with an original waveform as center.

In the present embodiment in particular, when a player operates keyboard unit 45 of FIG. 25, touch data 49 corresponding to a key depressing velocity is entered in controller 48 after being converted to a corresponding numeric value by touch data table memory 46. When the player plays a key strongly (fast), controller 48 controls modulation index I to have a large value in accordance with the output of touch data table memory 46 corresponding to entered touch data 49. Thereby, when the keyboard is played powerfully (fast), the extent of modulation becomes large as illustrated in FIG. 5(*c*) and thus a waveform output OUT(t) with many harmonic components is obtained.

When the player plays the keyboard quietly (slowly), modulation index I is controlled to have a small value (approximately 0). Consequently, when a key is depressed quietly, the extent of modulation becomes small and thus such a waveform output OUT(t) containing only a sine wave as shown in FIG. 2(*c*) is obtained.

On the other hand, key code 50 representing the note of a key depressed on keyboard 45 of FIG. 25 is entered into controller 48 after being converted to a corresponding numeric value by key code data table memory 47. Then, controller 48 controls modulation index I to have a large value in accordance with the output of key code data table memory 47 corresponding to key code 50 when a low-note key is depressed. As a result, when a key on the low-note side is depressed, the extent of modulation becomes large as shown in FIG. 5(*c*), to thereby produce a waveform output OUT(t) containing many harmonic components.

When a key on the high-note side is played, modulation index I is controlled to have a small value (approximately 0) in accordance with the output of key code data table memory 47 corresponding to key code 50. As a result, when a key on the high-note side is depressed, a waveform output OUT(t) containing only a sine wave is obtained as shown in FIG. 2(*c*).

As described above, in the present embodiment, the modulation index is not only set prior to the initiation of a performance operation but also varied in accordance with the velocity information or tone range information. Thus, the frequency characteristics of musical sound waveforms can be varied in accordance with a performance operation so that a state in which many higher harmonic components are contained and a state in which only a single waveform component (a sine wave component, a rectangular wave component etc.) is contained can be produced arbitrarily.

Modifications of the specific arrangement of the third embodiment of the musical sound waveform generator In the above embodiment, the value of modulation index I is latched in latch 16 at the time of initiation of tone generation and remains fixed thereafter. Modulation index I may be varied with time so as to vary the frequency characteristic of a musical sound waveform with time. Moreover, if the extent of variation of modulation index I were varied with time according to performance information, the frequency characteristic of a musical sound waveform could be varied with time according to the performance information.

Fourth embodiment of the musical sound waveform generator

The basic principle of the fourth embodiment is the same as that of the first embodiment (FIGS. 1 to 5). The present invention is characterized in that address data ADD(t) of FIG. 1 is repeated in a predetermined period to perform the so-called loop reproduction in which a predetermined waveform period is outputted repeatedly as a waveform output (t). Moreover, in this case, by varying modulation index I with time in a loop reproduction period, the loop reproduction rich in variations can be made possible. A specific arrangement therefore will be described below.

Figure 26A:
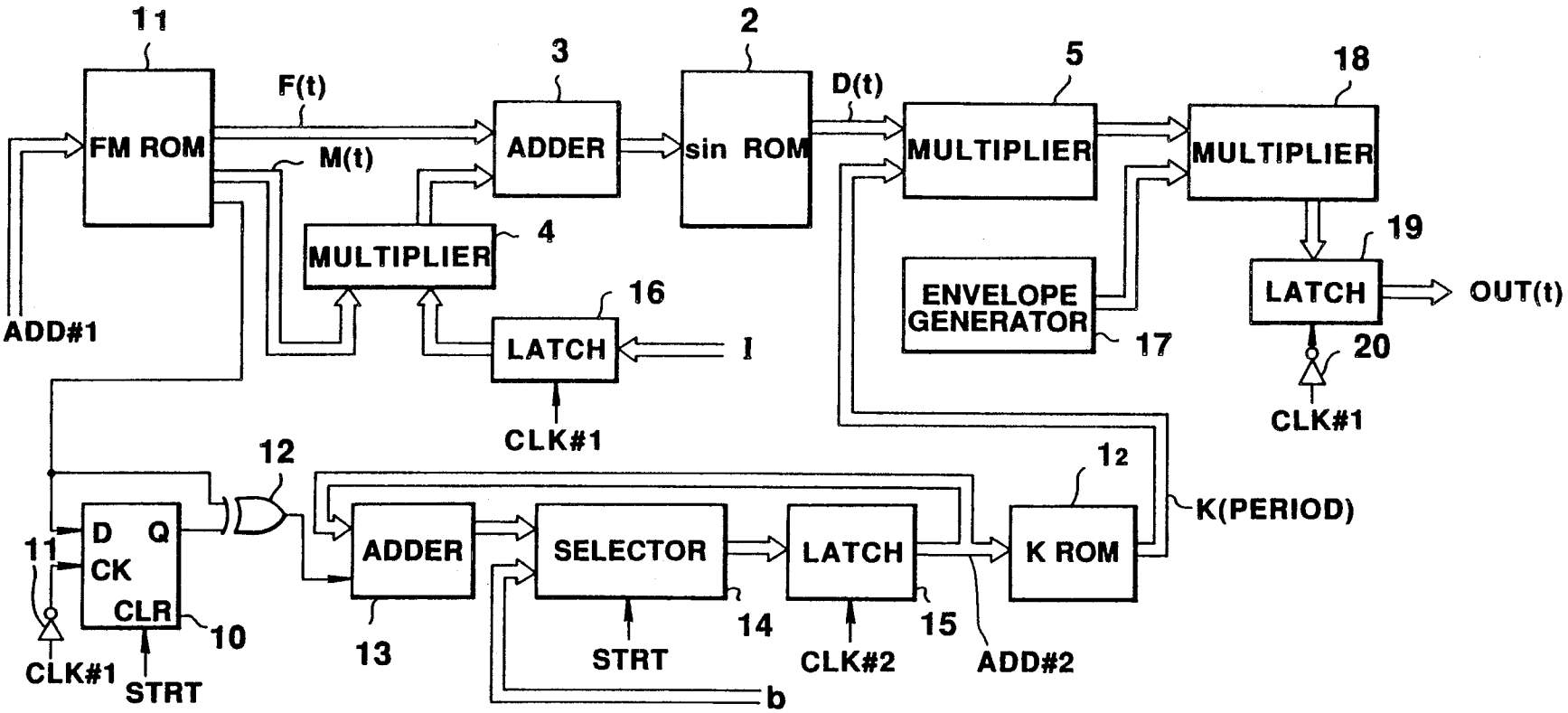
FIG. 26A illustrates a specific arrangement of a fourth embodiment of the musical sound waveform generator of the present invention.
Figure 26B:
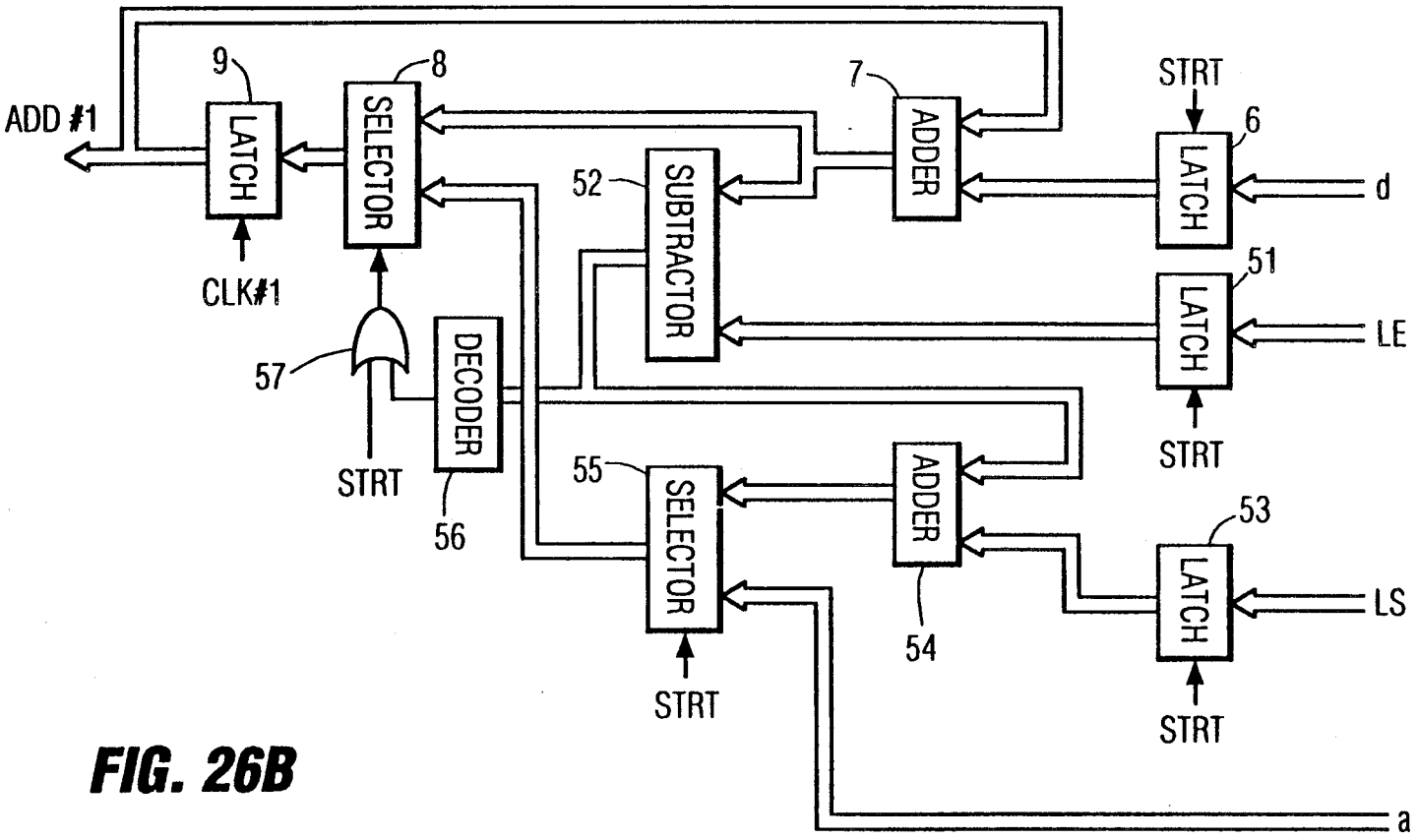
FIG. 26B illustrates an arrangement of the circuit for generating address data ADD#1 in the fourth embodiment.

The fourth embodiment has such a basic arrangement as shown in FIG. 26A, which is a part of the arrangement of FIG. 6 of the first embodiment and operates in the same manner as the arrangement of FIG. 6. A circuit for generating address data ADD#1 of FIG. 26A has such an arrangement as shown in FIG. 26B, which is an expansion of the circuit arrangement comprised of latches 6, 9, adder 7 and selector 8 of FIG. 6. Modulation index I to be latched in latch 16 of FIG. 26A is produced by a circuit shown in FIG. 26C.

The address data generating circuit of FIG. 26B will be described.

In an accumulating section comprised of adder 7, selector 8 and latch 9, address data ADD#1 is accumulated at address periods defined by tone pitch data d latched in latch 6 with start address a taken as an initial value in synchronism with the rise of a clock CLK#1 inputted to latch 9. This basic operation is the same as in the first embodiment of FIG. 6. However, it is to be noted that start pulse STRT is inputted to latch 9 via OR circuit 57.

In latch 53 is latched start address LS of a loop basic period (which will be described with reference to FIG. 26) at the time of a loop reproduction operation, which is outputted from the control section not shown. Also, from the control section, latch 51 is latched, at the same timing as in latch 53, address LE in which the ending address of the loop basic period is incremented by +1.

In subtracter 52, an accumulated value outputted from adder 7 is subtracted from address LE latched in latch 51 and the result of the subtraction is decoded in decoder 56. The output of decoder 56 goes to a high level when the result of subtraction is 0 or negative, that is, when the accumulated value becomes equal to or exceeds address LE. Thereby, selector 8 selects the output of selector 55 in response to the output of OR circuit 57. Selector 55 selects the output of adder 7 when start pulse STRT is low.

At this point, in adder 54, the result of subtraction from subtracter 52, namely, a value by which address LE is exceeded by the accumulated value from adder 7, is added to start address LS of the loop basic period latched in latch 53 and then outputted to selector 55. Thus, in latch 9 is latched the address to which the ending address of the loop basic period is turned back to the start address side by a width of tone pitch data d.

Thereafter, when the address in the loop basic period is accumulated and then exceeds address LE, the operation is performed again from the beginning of the loop basic period. In this way address data ADD#1 in the loop basic period is outputted repeatedly.

Subsequently, the circuit arrangement of FIG. 26C for generating modulation index I of FIG. 26A will be described.

First, prior to initiation of tone generation, a player supplies a control signal SEL to selector 63 through the control section not shown so as to select I ROM 61 or LFO (low frequency oscillator) 62 as a source of modulation index I in the loop basic period.

Flip-flop (F/F) 58 is reset at a time when start pulse STRT goes high at the time of initiation of tone generation so that its positive-logical-output Q goes low. Thereby, selector 59 selects a value of 1 to output this value as modulation index I.

Subsequently, F/F 58 is set at a time when the output of decoder 56 of FIG. 26B goes high, that is, at a time of initiation of the loop reproduction operation, so that its positive-logical-output Q goes high. Afterward selector 59 selects the output of selector 63. At the same time, address counter 60 or LFO 62 is activated.

In a mode in which selector 63 selects I ROM 61, start address x of I ROM 61 in which modulation index data is stored has been set in address counter 60 beforehand from the control section. Address counter 60 is instructed by positive-logical-output Q of F/F 58 to advance the address beginning with start address x in synchronism with the rise of clock CLK#1, then the address counter 60 applies the address to I ROM 61. As a result, modulation index data corresponding to the address is read from I ROM 61 to be outputted as modulation index I via selectors 63 and 59. Thus, modulation index I has a value of 1 prior to the initiation of loop reproduction operation and assumes a value of modulation index data outputted from I ROM 61 after the initiation of loop reproduction operation.

In a mode in which selector 63 selects LFO 62, on the other hand, LFO 62 is instructed by positive-logical-output Q of F/F 58 to start its operation, whereby LFO data are sequentially outputted from LFO 62 in synchronism with the rise of clock CLK#1 as modulation index I. Thus, modulation index I has a value of 1 prior to the initiation of loop reproduction operation and assumes a value of modulation index data I outputted from LFO 62 after the initiation of loop reproduction operation.

Figure 8:
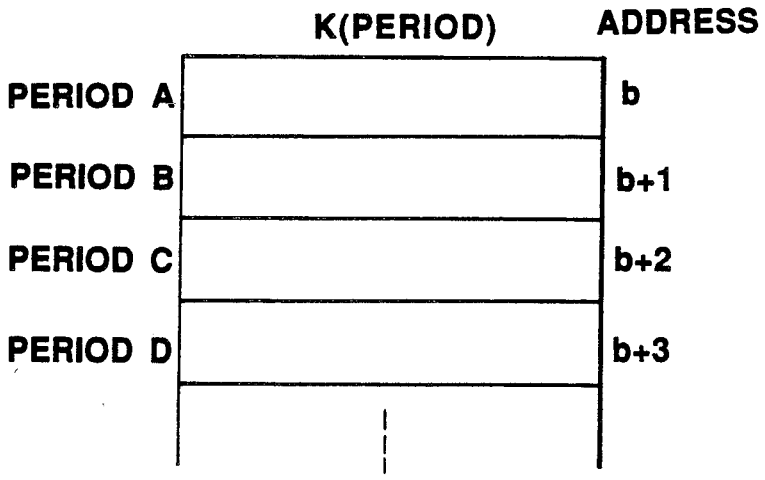
FIG. 8 illustrates a data structure of the K ROM.

The structures of data stored in FM ROM11 and K ROM12 of FIG. 26A are the same as those shown in FIGS. 7 and 8 in the first embodiment.

The operation of the fourth embodiment including the arrangements of FIGS. 26A to 26C will be described below.

FIG. 27 illustrates the timing diagram of the present embodiment which corresponds to the timing diagram of FIG. 9 in the first embodiment. FIG. 27 is the same as FIG. 9 except for the timing of modulation index I.

First, the usual reproduction operation prior to the loop reproduction operation will be described. This operation is almost the same as that based on the timing diagram of FIG. 9 in the first embodiment. Thus, only different points will be described below.

First, start address a from the control section, which is the initial value of address data ADD#1, is selected by selectors 55 and 8 of FIG. 26B during a time period from t1 to t4 when start pulse STRT is 1 and then latched in latch 9 at time t2 when clock CLK#1 goes to 1 (FIG. 27(*d*)). This initial-value setting operation is substantially the same as that in the first embodiment.

Second, modulation index I which is multiplied in multiplier 4 by phase difference data M(t) read from FM ROM 11 is produced as follows. That is, modulation index I having a fixed value of 1 is latched in latch 16 from selector 59 of FIG. 26C at each of times t2, t5, t8, t11, t14, t17 and so on when clock CLK#1 goes to 1 as shown in FIG. 27 (*b*) and (*m*). This is because F/F 58 of FIG. 26C is reset by the rise of start pulse STRT so that its positive-logical-output Q goes low.

The entire operation timing involving the above operation based on FIG. 27 is shown in FIG. 28. Once start pulse STRT rises at time t1 as shown in FIG. 28(*b*), address data ADD#1 outputted from the generating circuit of FIG. 26B to FM ROM11 of FIG. 26A increases with time as shown in FIG. 28(*e*) (corresponding to FIG. 27(*d*)) every time clock CLK#1 of FIG. 28(*a*) goes high. Thereby, period data F(t) and phase difference data M(t) are outputted from FM ROM 11 in synchronism with the rise of clock CLK#1 as the contents of addresses shown in FIG. 7. (Strictly speaking, F(t) and M(t) are read after some delay from the rise of clock CLK#1.) Waveform periods W1, W2, W3, . . . of FIG. 28(*g*) correspond to waveform periods A, B, C, D, . . . of FIG. 2(*a*) or FIG. 7 in the first embodiment. Period data F(t) of FIG. 28(*f*) linearly varies from 0 to $2\pi$ during each of waveform periods W1, W2, W3 and so on as shown in FIG. 2(*b*).

At each rise of clock CLK#1 in each of waveform periods W1, W2, W3 and so on, modulation index I which is multiplied by phase difference data M(t) in multiplier 4 of FIG. 26A has a value of 1. For this reason, phase angle data F(t)+I·M(t) outputted from adder 3 is F(t)+M(t). Thus, waveform output OUT(t) latched in latch 19 from sin ROM 2 of FIG. 26A via multipliers 5 and 18 becomes a desired original waveform ORG(t)

as illustrated in FIG. 3A or equation (2) in the first embodiment.

Next, the loop reproduction operation which is the feature of the present invention will be described. The loop reproduction operation is an operation which is performed when a player desires to reproduce the last waveform period repeatedly after a certain waveform period.

When the loop reproduction is performed simply, waveform output OUT(t) will have such an outline as shown in FIG. 29(*a*). That is, if waveform period Wn is utilized as the loop basic period, reproduction is performed with a waveform in waveform period Wn kept as it is as shown in ① to ⑤ of FIG. 29(*a*). This enables such sustained sounds as obtained by organs to be reproduced as waveform output OUT(t).

Where it is desired to diminish the waveform output while performing the loop reproduction, the waveform output has only to be multiplied by such envelope data as shown in FIG. 29(*b*) outputted from envelope generator 17 of FIG. 26A in multiplier 18. Then, the waveform output OUT(t) of FIG. 29(*a*) is converted as shown in FIG. 29(*c*). Sustained sounds can be produced in this manner. In this case, however, the musical sound characteristics in loop reproduction periods ① to ⑤ will become monotonous as a whole because the musical sound characteristics in the loop basic period Wn are repeated.

Accordingly, in the present embodiment, modulation index I by which phase difference data M(t) is multiplied in multiplier 4 of FIG. 26A is controlled to gradually decrease from 1 during loop reproduction periods as shown FIG. 29(*d*). As described in connection with FIG. 2(*c*) or FIG. 5 in the first embodiment, the waveform output varies from an original waveform ORG(t) to a sine wave as modulation index I approaches 0. Thus, by controlling modulation index I as shown in FIG. 29(*d*), such waveform output OUT(t) as will vary to a sine wave as its amplitude decays like natural sounds can be obtained during loop reproduction periods.

To prevent a monotonous waveform output OUT(t) of sustained sounds from being outputted by the loop reproduction as shown in FIG. 29(*a*), modulation index I may be swung at a low frequency as shown in FIG. 29(*e*) during loop reproduction periods. This will impart variations to a tone color.

The operation of the embodiment of FIGS. 26A, 26B and 26C adapted to realize the above operation will be described below.

When setting the loop basic period to waveform period Wn of FIG. 28 for loop reproduction, a player sets the start address LS of loop basic period Wn and the address LE which is 1 larger than the ending address of loop basic period Wn for FM ROM11 in the control section. This setting operation may be performed by the use of a display section not shown. Thereby, start address LS and address LE are latched in latches 53 and 51, respectively, in synchronism with the rise of start pulse STRT.

After this operation, address data ADD#1 is progressively accumulated as shown in FIG. 28(*e*) in the accumulating section comprised of adder 7, selector 8 and latch 9 of FIG. 26B as has been described. More specifically, the address data is accumulated at address periods defined by tone pitch data d latched in latch 6 with start address a as its initial value and in synchronism with the rise of clock CLK#1 inputted in latch 9 after time t1.

In this case, in subtracter 52 of FIG. 26B, an accumulated value outputted from adder 7 is subtracted from LE latched in latch 51 . The result of subtraction is positive until address data ADD#1 reaches address LE so that the output of decoder 56 remains low. Thus, selector 8 selects the output of adder 7, performing the usual accumulating operation.

At time t15 of FIG. 28, when the output of latch 9 of FIG. 26B approaches or reaches ending address (LE-1) of loop basic period Wn so that the output of adder 7 becomes equal to or exceeds address LE, the result of subtraction by subtracter 52 becomes 0 or negative. Thereby, the output of decoder 56 goes high at time t16 immediately after time t15 as shown in FIG. 28(*c*) so that selector 8 selects the output of selector 55. Selector 55 selects the output of adder 54 because start pulse STRT is low at time t16 of FIG. 28. At this point, in adder 54, the result of subtraction of subtracter 52, namely, a value by which the accumulated value from adder 7 exceeds address LE is added to start address LS of the loop basic period latched in latch 53. Thus, in latch 9 is latched an address which is obtained by turning from the last of the loop basic period back to its start side at a width of tone pitch data d at time t17 when clock CLK#1 rises immediately after t16. Thereby, address data ADD#1 returns back to the start side of the loop basic period as shown in FIG. 28(*e*). Note that the address to which address data ADD#1 returns back varies with tone pitch data d. Since the output of adder 7 goes smaller than address LE because of turning back of address data ADD#1 at time t17, the output of subtracter 52 becomes positive again so that the output of decoder 56 returns to the low level immediately after t17 as shown in FIG. 28(*c*).

Afterward the address in the loop basic period is accumulated and, when exceeding address LE, it is turned back to the start side of the loop basic period at time t18. In this manner address data ADD#1 in the loop basic period is repeatedly outputted (refer to times t19, t20 of FIG. 28(*e*)).

Figure 26C:
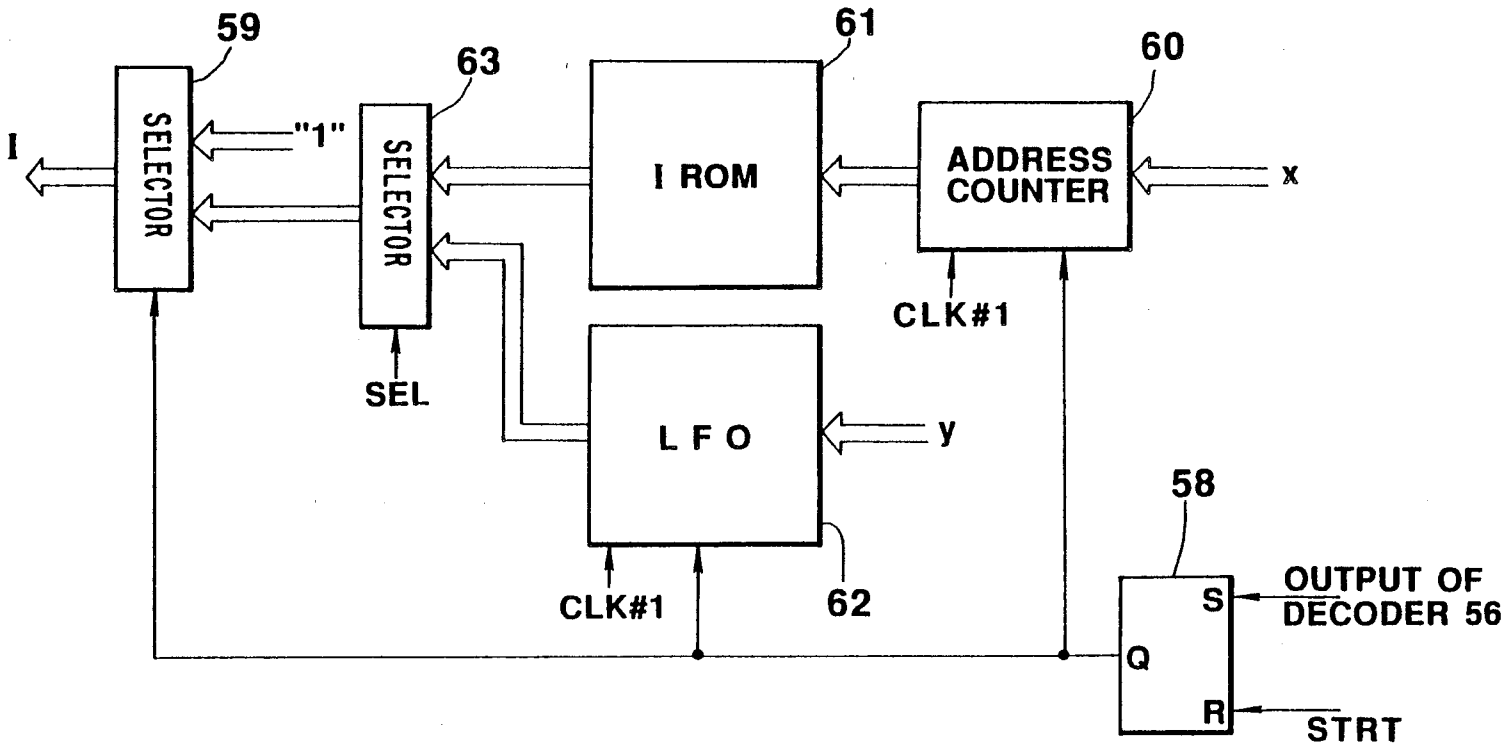
FIG. 26C illustrates an arrangement of the circuit for generating the modulation index I in the fourth embodiment.

In the modulation index generating circuit of FIG. 26C, on the other hand, positive-logical-output Q of F/F 58 remains low until address data ADD#1 exceeds address LE. Thus, selector 9 outputs modulation index I having a value of 1. F/F 58 is set at time t16 when the output of decoder of FIG. 26B goes high so that its positive-logical-output Q goes high. Afterward selector 59 selects the output of selector 63. At the same time, address counter 60 and LFO 62 are activated.

In a mode in which selector 63 selects I ROM 61, start address x of I ROM 61 in which modulation index data is stored has been set in address counter 60 beforehand from the control section. Address counter 60 is instructed by positive-logical-output Q of F/F 58 to advance the address beginning with start address x in synchronism with the rise of clock CLK#1, then address counter 60 applies the address to I ROM 61. As a result, modulation index data corresponding to the address is read from I ROM 61 to be outputted as modulation index I via selectors 63 and 59. Thus, modulation index I has a value of 1 prior to the initiation of loop reproduction operation and assumes a value outputted from I ROM 61 after the initiation of loop reproduction operation. The modulation index data are latched in latch 16 at respective times when clock CLK#1 rises. As a result, the value of modulation index I decreases after time t17 as shown in FIG. 28(*h*). Thereby, the characteristic of FIG. 29(*d*) is realized.

The operation is summarized as follows. Period data F(t) and phase difference data M(t) for the loop basic period Wn are read as shown (*f*) and (*g*) of FIG. 28 from FM ROM 11 of FIG. 26A which is accessed by address data ADD#1 generated in FIG. 26B and modulation index I is latched in latch 16 as shown in FIG. 28(*h*). Sin ROM 2 is accessed by phase angle data F(t)+I·M(t) thus generated with the result that a modulated output D(t) which have its waveform characteristics gradually varied from the waveform characteristic in the loop basic period Wn to the characteristic of a sine wave is produced.

In a mode in which selector 63 selects LFO 62, on the other hand, LFO 62 is instructed by positive-logical output Q of F/F 58 to start its operation, whereby LFO data are sequentially outputted from LFO 62 in synchronism with the rise of clock CLK#1 as modulation index I. Thus, modulation index I has a value of 1 prior to the initiation of loop reproduction operation and assumes a value of LFO data outputted from LFO 62 after the initiation of loop reproduction operation. Thereby, the characteristic of modulation index I of FIG. 29(*e*) is realized though not shown in FIG. 28. Thus, from sin ROM 2 of FIG. 26A is obtained a modulated output D(t) whose waveform characteristics swing with the waveform characteristic in loop basic period Wn as center.

During the loop reproduction operation, period identifying data IB outputted from FM ROM 11 of FIG. 26A has a value of either 0 or 1 in the loop basic period Wn as illustrated in FIG. 7 in the first embodiment. Thus, so long as the addresses in the loop basic period are designated, the output of EOR 12 remains low as described previously. For this reason, address data ADD#2 outputted from latch 15 remains unchanged so that normalization coefficient K(period Wn) corresponding to loop basic period Wn continues to be outputted from K ROM12. In this manner a waveform output having its amplitude normalized correctly according to loop basic period Wn is obtained from multiplier 5 of FIG. 26A.

In addition to the above operation, by outputting such envelope data as shown in FIG. 29(*b*) from the envelope generator of FIG. 26A for multiplication in multiplier 18, it is possible to produce a waveform output OUT(t) which is changed to a sine wave as its amplitude decays like natural sounds in the loop reproduction periods.

Modifications of the fourth embodiment of the musical sound waveform generator In FIGS. 26A and 26B, a period during which the loop reproduction is performed is assumed to be any one of the waveform periods defined in FIG. 2(*a*) etc.. However, the circuit arrangement may be modified so as to perform the loop reproduction over a plurality of waveform periods or during an arbitrary period which is independent of the waveform periods.

Modulation index I is made to have a value of 1 prior to initiation of the loop reproduction operation so as to reproduce an original waveform. Naturally modulation index I may be varied during this period. Similarly, modulation index I outputted from I ROM 61 of FIG. 26C is made to have a decaying characteristic as shown in FIG. 28(*h*) after the initiation of the loop reproduction operation. Modulation index I may be set to have some other characteristic.

According to the present embodiment, as described above, the so-called loop reproduction is made possible. During the loop reproduction as well, the frequency characteristics of a musical sound waveform can be varied gradually from a state of a desired musical sound waveform to a state in which only some other waveform component is contained. By varying a mixing ratio continuously to 1 or above, it is possible to control a musical sound having a desired musical sound waveform so as to allow an individual musical sound having more complex harmonic components to be produced. Thereby, it becomes possible to produce musical sound waveforms rich in variations by the use of only period data and phase difference data corresponding to an arbitrary waveform period, save the storage capacity for period data and phase difference data and prevent tone colors from becoming monotonous during loop reproduction.

In addition to the above operation, if the amplitude envelope characteristics outputted from envelope generator 17 were controlled to decay with time synchronously with the loop reproduction operation, a process in which a musical sound waveform gradually decays after the initiation of tone generation like musical sounds of actual instruments could be realized.

Fifth embodiment of the musical sound waveform generator

The present embodiment enables various kinds of musical sounds to be produced according to performance information in addition to the operation of the first embodiment. More specifically, the present embodiment is controlled to produce different kinds of modulation signals according to performance information and is set such that a musical sound waveform of a traditional instrument is obtained for each of key ranges or for each key depressing velocity according to each of the modulation signals.

Figure 30:
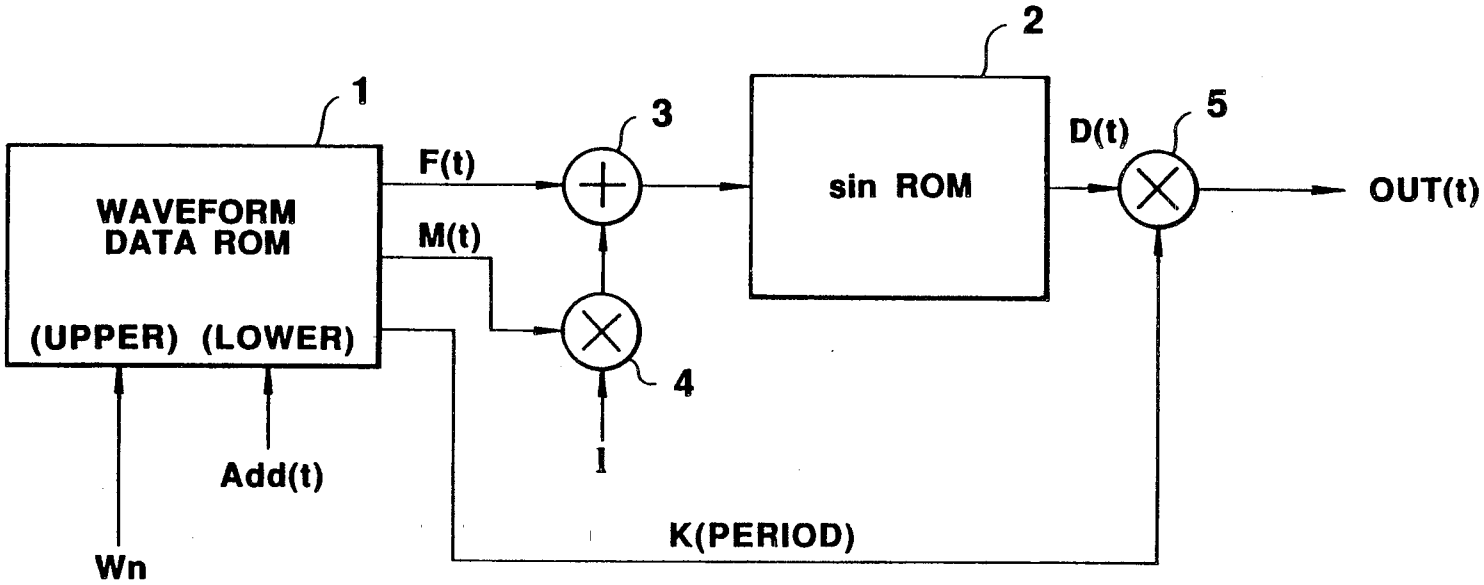
FIG. 30 is a diagram illustrating the principle of a fifth embodiment of the musical sound waveform generator of the present invention.

FIG. 30 illustrates the principle of the fifth embodiment of the musical sound waveform generator of the present invention. This principle is based on the principle of the first embodiment.

In FIG. 30, from waveform data ROM 1 are synchronously read period data F(t), phase difference data M(t) and a normalization coefficient K(period) which is fixed for each of waveform periods to be described later in accordance with time-increasing address data Add(t) applied to lower address inputs thereof. In this case, a plurality of sets of such data are stored in waveform data ROM 1, and one of the sets of data is selected in accordance with waveform selecting address data $W_N$ applied to higher address inputs thereof. The above is distinct from the first embodiment of FIG. 1.

Such an arrangement enables a different kind of waveform output OUT(t) to be produced for each of the sets of data selected in waveform data ROM 1.

In a case where the principle of FIG. 30 is applied to a keyboard musical instrument, if waveform selecting address data $W_N$ is switched according to the velocity (strength) of a key touch, a waveform output OUT(t) corresponding to the key depressing velocity will be obtained. If waveform selecting address data $W_N$ is changed with key code values, a waveform output OUT(t), a different waveform output OUT(t) will be produced for each of key ranges. In general, with acoustic pianos, a piano tone produced varies with strengths at which a key is depressed. A low-note key and a high-note key will produce considerably different piano tones. Thus, if the musical sound waveform generator of FIG. 30 is applied to an electronic piano, a set of period data F(t), phase difference data M(t) and a normalization coefficient K(period) corresponding to an original waveform (a piano tone of an acoustic piano) sampled for each of key depressing velocities or for each of key ranges is obtained in accordance with the method as described above, and a plurality of sets of such data are stored in waveform data ROM 1, then very realistic musical sounds will be produced.

In addition to the above, if modulation index I is varied as described above, various modulated waveforms which range from a sine wave to a deeply modulated waveform with an original waveform as center will be produced, thereby providing colorful effects.

A specific arrangement of the fifth embodiment based on the principle may be the same as that of the first embodiment shown in FIG. 6.

In this case, a plurality of such data sets as described above are stored in FM ROM11 of FIG. 6 beforehand. Start address a to be inputted to selector 8 of FIG. 6 is varied in accordance with performance information such as a key depressing velocity or a key range so as to select one of the data sets. Thereby, a musical sound waveform generator which enables musical sounds to be produced with a realistic sensation according to performance information will be implemented.

Principle of sixth embodiment of the musical sound waveform generator.

In the sixth embodiment, in addition to the operation of the first embodiment, modulation signals which correspond to musical sound waveforms of an actual instrument which are obtained in accordance with some performance states (key depressing velocities, key ranges) are stored beforehand. The modulation signals are combined in arbitrary proportions according to actual performance information such as key velocity information and key range information, to thereby enable musical sounds to be produced which have their characteristics varied continuously and thus are very close to the characteristics of the traditional instrument.

Figure 31:
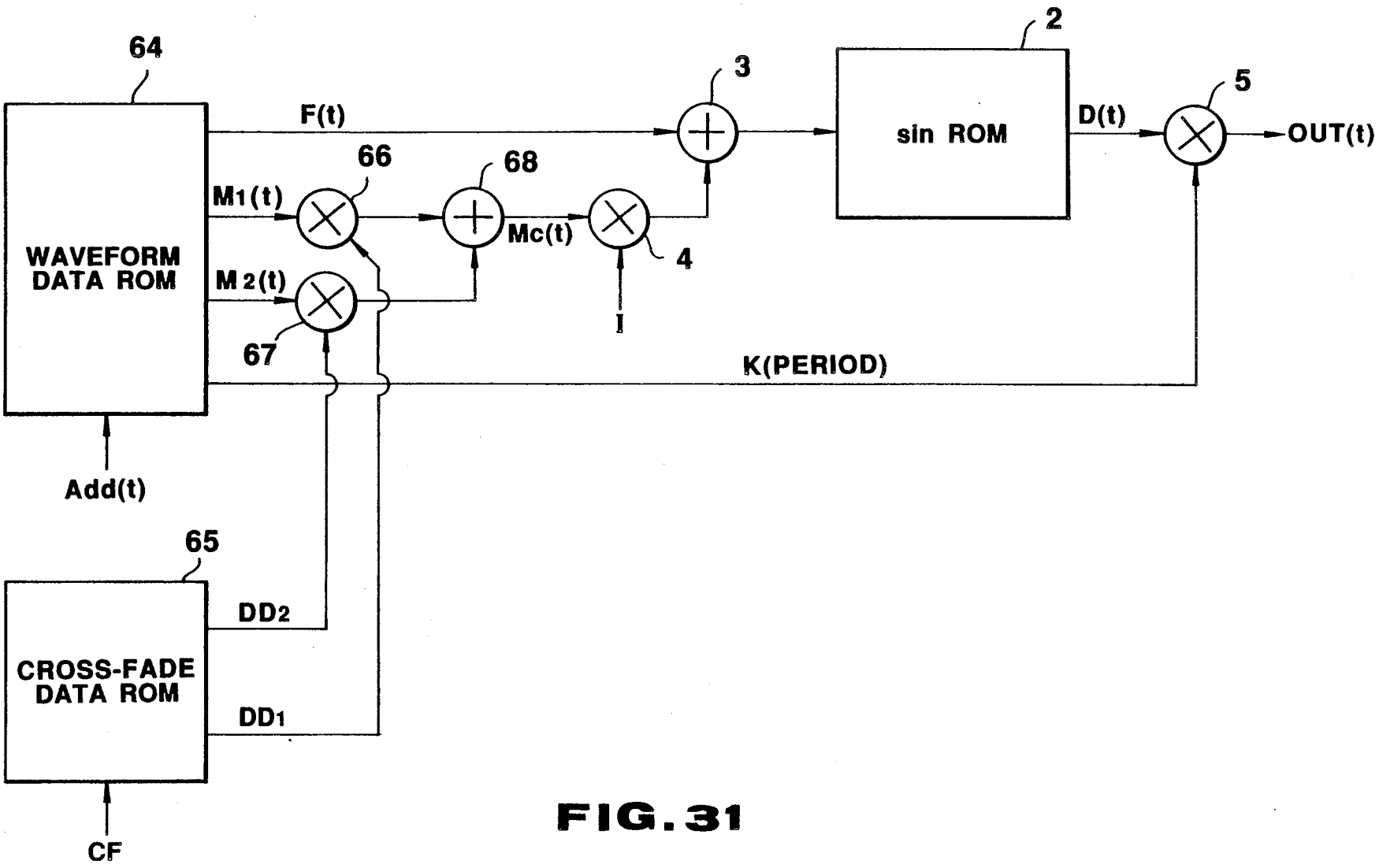
FIG. 31 is a diagram illustrating the principle of a sixth embodiment of the musical sound waveform generator of the present invention.

FIG. 31 illustrates the principle of the sixth embodiment. Parts designated by the same numerals and symbols as in the first embodiment of FIG. 1 have the same functions.

From waveform data ROM 64 are synchronously read period data F(t), first phase difference data M1(t), second phase difference data M2(t) and a normalization coefficient K(period) in accordance with time-increasing address data Add(t) applied to address inputs thereof.

On the other hand, from cross-fade data ROM 65 are read a set of cross-fade coefficients DD1 and DD2 to multipliers 66 and 67, respectively, in response to address data CF which is determined according to each operation of a player. Note that DD1+DD2=1.

First phase difference data M1(t) and second phase difference data M2(t) are respectively multiplied by cross-fade coefficients DD1 and DD2 in multipliers 66 and 67 and then added together in adder 68, to thereby produce phase difference data Mc(t).

The process based on phase difference data Mc(t) [rad] and period data F(t) [rad] is the same as that of the first embodiment of FIG. 1.

The operation of the principle of FIG. 31 will be described below.

First, period data F(t), first phase difference data M1(t) and normalization coefficient K(period) are set such that a first original waveform ORG1(t) is obtained as waveform output OUT(t) when DD2=0 (DD1=1) and I=0. This setting may be made in the same manner as that made by the use of FIGS. 2 to 4 in the principle of the first embodiment.

Next, second phase difference data M2(t) is set such that a second original waveform ORG2(t) is obtained as waveform output (t) when DD1=0 (DD2=1) and I=0. If second original waveform ORG2(t) is adjusted such that its maximum value equals the maximum value of first original waveform ORG1(t), then normalization coefficients K(period) for the first and second original waveforms can be made common to each other. As described in connection with FIG. 2, each of the waveform period of period data F(t) need not correspond to the pitch period correctly. If, therefore, the time base is interpolated and is normalized beforehand such that the average pitch period of second original waveform ORG2(t) becomes approximately equal to that of first original waveform ORG1(t), then period data F(t) set for finding first original waveform ORG1(t) may be used as it is to determine second phase difference data M2(t).

Figure 32:
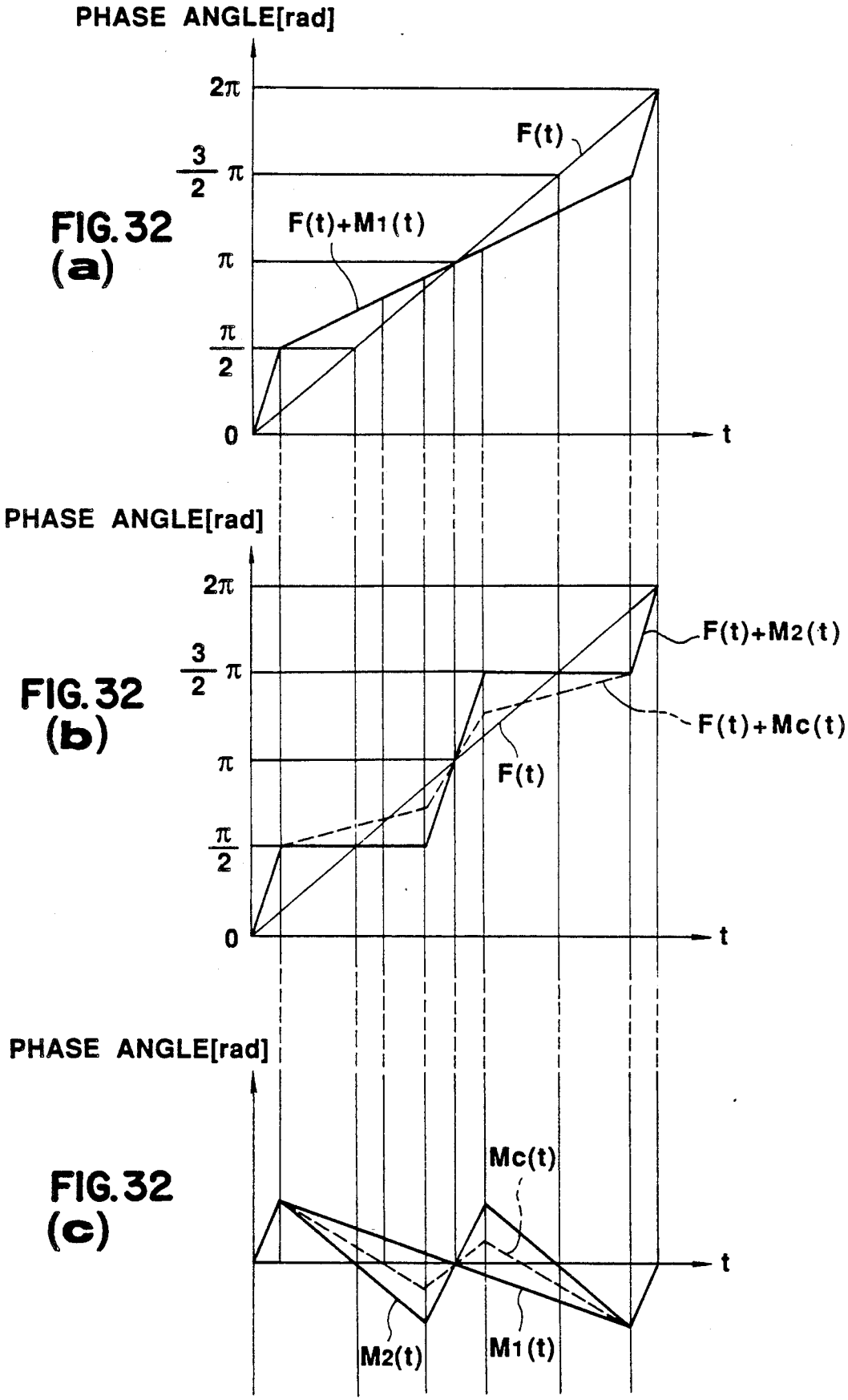
FIGS. 32(*a*) to 32(*c*) are diagrams illustrating a relation among the M1(t), M2(t) and Mc(t) in the principle of the sixth embodiment.
Figure 33:
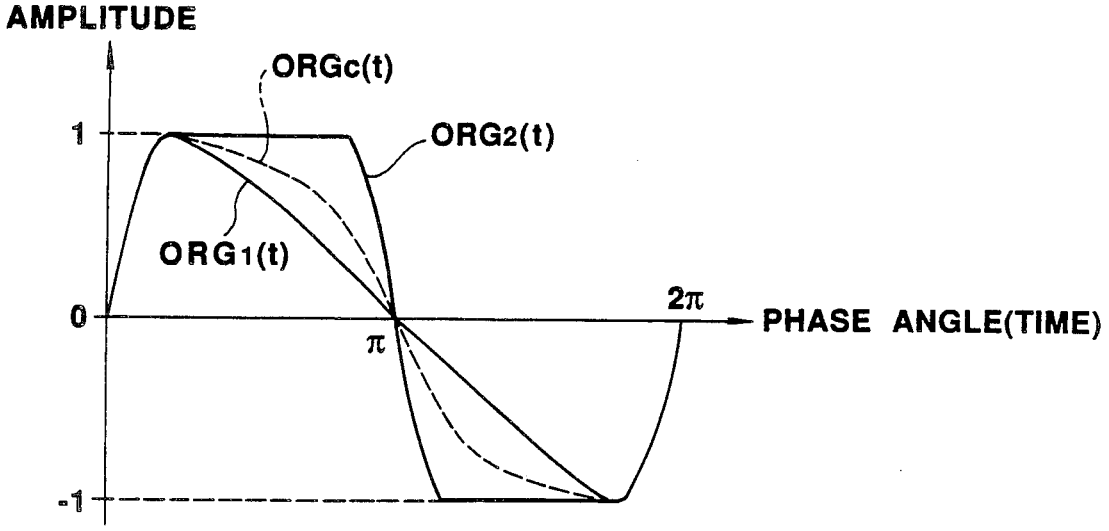
FIG. 33 is a diagram illustrating a relation among the ORG1(t), ORG2(t) and ORGc(t) in the principle of the sixth embodiment.

Suppose now that, when DD2=0 (DD1=1) and I=0, phase angle data F(t)+M1(t) as shown in FIG. 32(*a*) is applied from adder 3 to sin ROM 2 and consequently such a rectangular wave as shown in FIG. 33 is obtained from sin ROM 2 as first original waveform ORG1(t). Note that the amplitude is within ±1 for simplicity. On the other hand, suppose that, when DD1=0 (DD2=1) and I=0, phase angle data F(t)+M2(t) as shown in FIG. 32(*b*) is applied from adder 3 to sin ROM 2 and consequently such a sawtooth wave as shown in FIG. 33 is obtained from sin ROM 2 as first original waveform ORG2(t). Varying the value of address data CF inputted to cross-fade data ROM 65 allows a set of cross-fade coefficients DD1 and DD2 which satisfy DD1+DD2=1 to be read from the ROM with the result that first and second phase difference data M1(t) and M2(t) are mixed in an appropriate ratio. Thus, such phase difference data Mc(t) as shown in FIG. 32(*b*) or (*c*) is obtained. Thereby, as waveform output OUT(t) such a waveform ORGc(t) as shown in FIG. 33 is obtained, which has an intermediate characteristic between a rectangular wave and a sawtooth wave.

Figure 34:
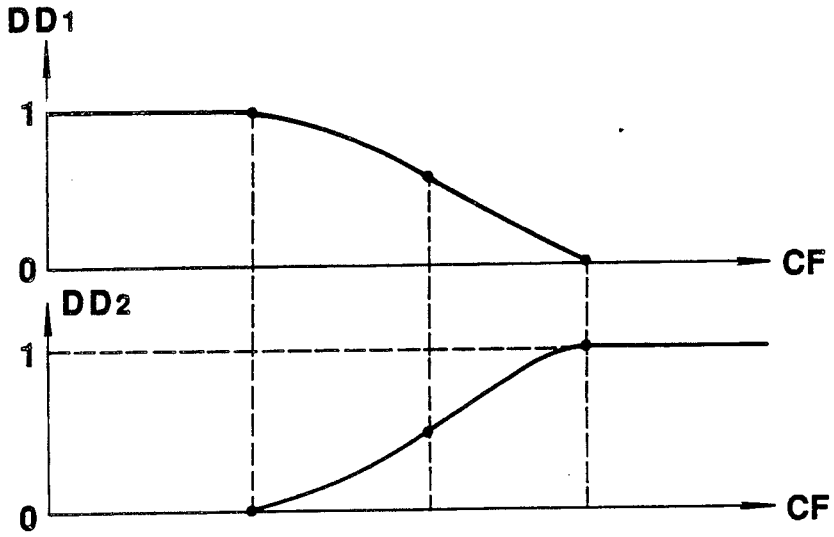
FIG. 34 is a diagram illustrating a relation among the CF, DD1 and DD2 in the principle of the sixth embodiment.
Figure 35:
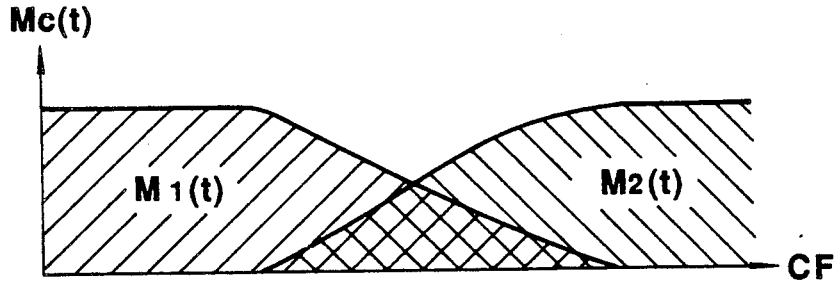
FIG. 35 is a diagram illustrating a relation among the CF, M1(t) and M2(t) in the principle of the sixth embodiment.

Utilizing the above fact, such values of cross-fade coefficients DD1 and DD2 as indicated by the dots in FIG. 34 are stored in cross-fade data ROM65, each cross-fade data value corresponding to a value of address data CF. In FIG. 34, only three sets of cross-fade coefficients are indicated for simplicity. Each set of cross-fade coefficients satisfies DD1+DD2=1. In FIG. 35 there is conceptually illustrated in accordance with FIG. 34 that in what proportion first phase difference data M1(t) and second phase difference data M2(t) are contained in phase difference data Mc(t) when address data CF is varied. It is thereby anticipated that the characteristic of waveform output OUT(t) of FIG. 31 can continuously be varied from that of first original waveform ORG1(t) to that of second original waveform ORG2(t) as address data CF is incremented in value.

If, therefore, the principle of the musical sound waveform generator illustrated in FIG. 31 is applied to a keyboard musical instrument, the following operation will be achieved. That is, if first phase data M1(t) corresponding to a first original waveform ORG1(t) obtained at a time when a key is depressed slowly and second phase difference data M2(t) corresponding to a second original waveform ORG2(t) obtained at a time when the key is depressed quickly are stored in waveform data ROM 64, and the value of address data CF is changed according to the velocity (strength) of the key touch, then a waveform output OUT(t) having its characteristic continuously varied with the key depressing velocity will be outputted. Or, if first phase difference data M1(t) corresponding to a first original waveform ORG1(T) of a low key note and second phase difference data M2(t) corresponding to a second original waveform ORG2(t) of a high key note are stored in ROM 64, and address data CF is changed with key code values, then a waveform output OUT(t) having its characteristic continuously varied according to notes of keys depressed will be outputted.

According to such a principle, only storing sets of data corresponding to about two kinds of original waveforms enables colorful waveform outputs OUT(t) to be produced, each of which has its characteristic continuously varied between two original waveforms. As is the case with the first embodiment, if modulation index I is varied, various waveforms ranging from a sine wave to a deeply modulated waveform with an original waveform as center will be obtained for each of key ranges, thus providing colorful effects.

It is, of course, possible to store a set of data of more than two kinds of original waveforms and produce phase difference data Mc(t) from the data set. For example, this corresponds to a case where a set of data corresponding to original waveforms for a low note, an intermediate note and a high note.

Figure 36:
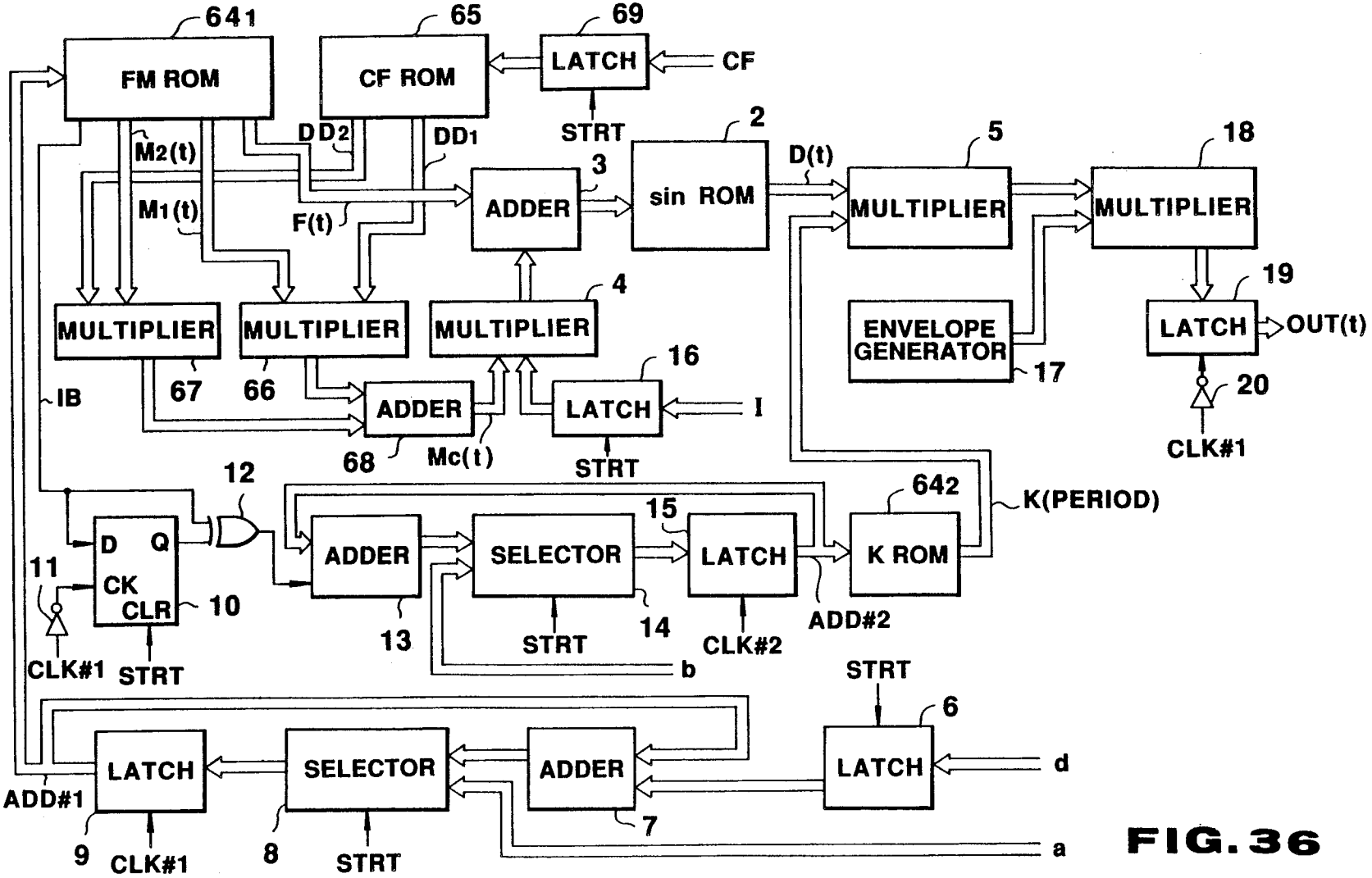
FIG. 36 illustrates a specific arrangement of the sixth embodiment of the musical sound waveform generator of the present invention.

Specific arrangement of the sixth embodiment of the musical sound waveform generator FIG. 36 illustrates a specific arrangement of the sixth embodiment of the musical sound waveform generator based on the principle shown in FIG. 31. Components designated by the same reference numerals or symbols in FIGS. 36 and 31 have the same functions. Also, components designated by the same reference numerals or symbols in FIG. 36 and the specific arrangement of the first embodiment shown in FIG. 6 have the same functions. Note that waveform data ROM 64 is composed of FM ROM $64_1$ and K ROM $64_2$ in FIG. 36.

In FIG. 36, address data ADD#1 adapted to read from FM ROM $64_1$ period data F(t), first phase difference data M1(t) and second phase difference data M2(t) is produced by an accumulating section composed of adder 7, selector 8 and latch 9 as in the case of the first embodiment.

First phase difference data M1(t) and second phase difference data M2(t) outputted from FM ROM $64_1$ are respectively multiplied in multipliers 66 and 67 by cross-fade coefficients DD1 and DD2 which are read from cross-fade data ROM (hereinafter referred to as CF ROM) 65 in accordance with address data CF and then the results of multiplication are added together in adder 68, thereby producing phase difference data Mc(t).

Phase difference data Mc(t) is multiplied in multiplier 4 by modulation index I latched in latch 16 and then added to period data F(t) outputted from FM ROM $64_1$ in adder 3 to produce phase angle data F(t)+I·Mc(t), which, in turn, is inputted to sin ROM 2 as a read address. This operation is the same as in the first embodiment of FIG. 6. As a result, modulated output D(t) is outputted from sin ROM 2 to multiplier 5.

As is the case with the first embodiment of FIG. 6, period identifying data IB outputted from FM ROM $64_1$ is applied to F/F 10 and adder 12 via EOR 12. Address data #2 is produced by adder 13, selector 14 and latch 15. Address data #2 is applied to K ROM $64_2$ to read therefrom normalization coefficient K(period), which, in turn, is applied to multiplier 5. The operations of multiplier 5, envelope generator 17, multiplier 18 and latch 19 are the same as those in the first embodiment.

Figure 37:
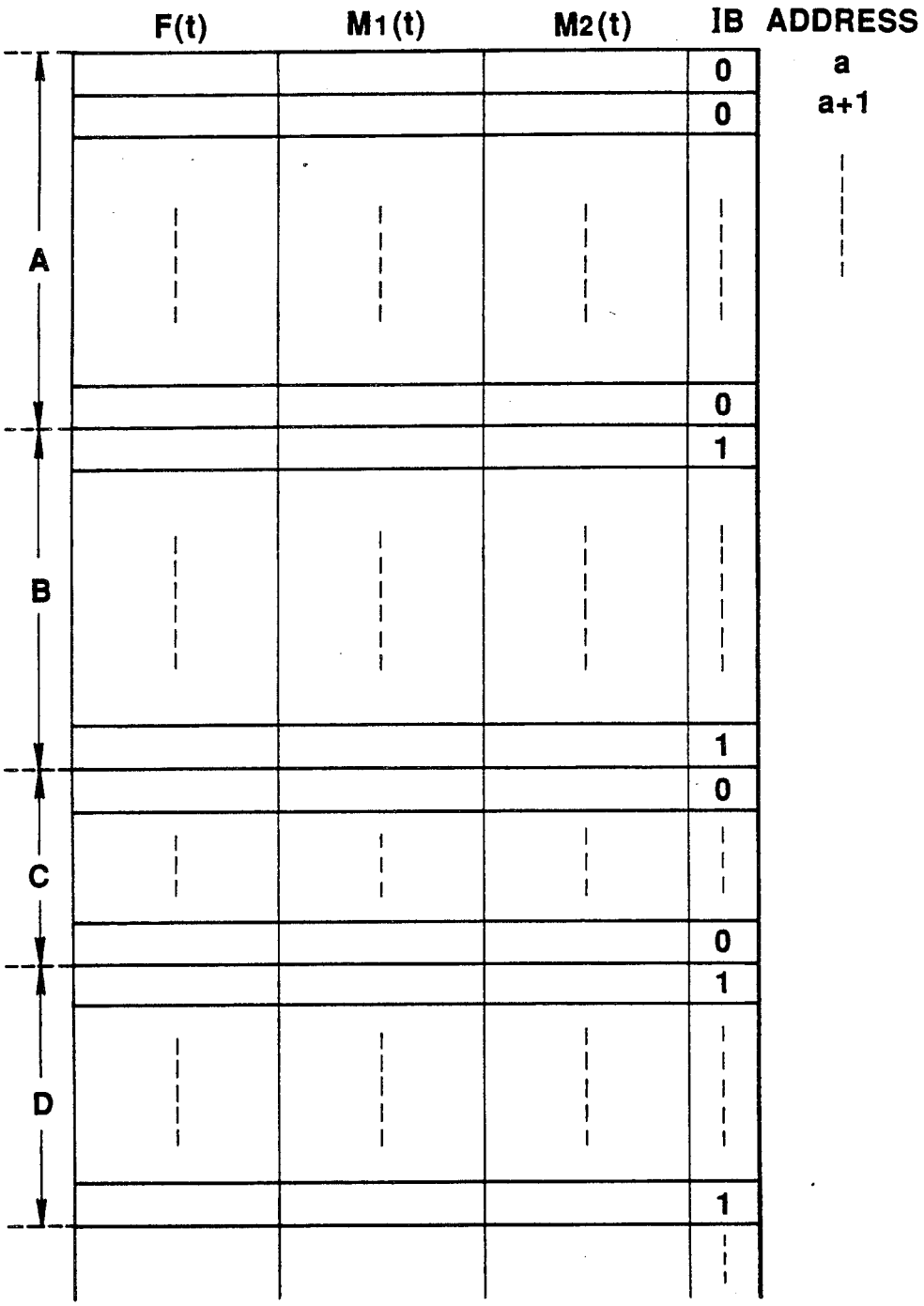
FIG. 37 illustrates a data structure of the FM ROM in the specific arrangement of the sixth embodiment.

FIG. 37 illustrates a structure of data stored in FM ROM $64_1$ of FIG. 36.

In the Figure, groups of a set of data extending from a time of initiating of tone generation to a time when the tone fades away are stored in sequence in addresses beginning with start address a and, in each address, a set of data of period data F(t), first phase difference data M1(t), second phase difference data M2(t) and 1-bit period identifying data IB are stored. Each set of data corresponds to a separate sampling point in one of groups corresponding to waveform periods A, B, C, D and so on (refer to FIG. 2). Period identifying data IB alternates between 0 and 1 as the waveform period varies as shown. Period identifying data IB is adapted to identify the boundary between waveform periods to update the address designated in K ROM $64_2$.

A structure of data stored in K ROM $64_2$ of FIG. 36 is the same as that in the first embodiment of FIG. 8.

In the present embodiment, as described in connection with FIG. 34 or 35, in FM ROM $64_1$ are stored such first phase difference data M1(t) as allows an original waveform of a low note to be produced and such second phase difference data M2(t) as allows an original waveform of a high note to be produced.

The timing diagram of the sixth embodiment is substantially the same as that of the first embodiment shown in FIG. 9. Note that, in the present embodiment, the timing of FIG. 9(*l*) indicates the timing of phase difference data M1(t) and M2(t) and the timing of FIG. 9(*m*) indicates the timing of cross-fade coefficients DD1 and DD2.

Period data F(t), first and second phase difference data M1(t) and M2(t) and period identifying data IB are read as shown in FIG. 9(*e*), (*k*) and (*l*) shortly after time t2. Afterward, as in the case of the first embodiment, address data ADD#1 outputted from latch 9 is progressively accumulated. The accumulated address data is latched in latch 9 at times t5, t8, t11, t14, t17 and so on of FIG. 9(*d*), and period data F(t), phase difference data M1(t), M2(t) and period identifying data IB are read shortly after each of the times as shown in FIG. 9(*e*), (*k*) and (*l*).

First and second phase difference data M1(t) and M2(t) read from FM ROM $64_1$ are applied to multipliers 66 and 67, respectively. Address data CF from the control section is latched in latch 69 at time t1 when start pulse STRT goes to 1. Thereby, a set of cross-fade coefficients DD1 and DD2 is read from an address designated by CF of DF ROM 65 after t1 as shown in FIG. 9(*m*). Thus, first and second phase difference data M1(t) and M2(t) are multiplied, respectively, by cross-fade coefficients DD1 and DD2 in multipliers 66 and 67 and the results of multiplication are added together in adder 68, thereby producing phase difference data Mc(t). Although not shown in FIG. 9, the timing of the generating of the phase difference data Mc(t) is slightly delayed from the timing of the inputting of first phase difference data M1(t) etc. to multiplier 66 etc. shown in FIG. 9(*l*).

In this case, the initiation of the tone generation is instructed by a key operation on the keyboard as described above. If, at this point, a key depressed is of a low note, address data CF having a small value is latched in latch 69. Conversely, if the depressed key is of a high note, large address data CF is latched in latch 69. Therefore, since a combination of cross-fade coefficients DD1 and DD2 read from CF ROM 65 in accordance with address data CF varies as described above in connection with FIGS. 34 and 35, a waveform output OUT(t) can be obtained the characteristic of which varies finely according to a key range. Of course, address data CF may be changed according to the velocity (strength) of a key touch as described above.

The waveform generating timing after phase difference data Mc(t) has been obtained is the same as in the first embodiment.

As described above, the embodiment of FIG. 36 enables the same operation as that in the principle of the musical sound waveform generator illustrated in FIGS. 32 to 36 to be realized.

What is claimed is:

1. A musical sound waveform generator for generating a musical sound waveform according to a mixed signal obtained by mixing a modulation signal with a carrier signal corresponding to a period of a musical sound waveform to be generated, comprising:

carrier signal generating means for generating a carrier signal;

modulation signal generating means for generating a modulation signal;

mixing controlling means for controlling, in mixing said modulation signal with said carrier signal, a mixing ratio of said modulation signal to said carrier signal, and for outputting a mixed signal in which said modulation signal and said carrier signal are mixed in the controlled mixing ratio; and waveform outputting means coupled to said mixing controlling means and having a predetermined functional relation between an input and an output thereof, for outputting a musical sound waveform according to said mixed signal outputted by said mixing controlling means as an input signal to the waveform outputting means, wherein said modulation signal generating means includes means for generating the modulation signal determined on the basis of a predetermined desired musical sound waveform other than a sine or a cosine waveform, said predetermined functional relation, said carrier signal and a predetermined mixing ratio, and said waveform outputting means includes means for outputting said desired musical sound waveform by setting the mixing ratio of said modulation signal to said carrier signal as said predetermined mixing ratio.

2. The musical sound waveform generator according to claim 1, further comprising an amplitude envelope controlling means for varying the amplitude envelope characteristic of said musical sound waveform outputted from said waveform outputting means with time.

3. The musical sound waveform generator according to claim 1, wherein said carrier signal generating means, said modulation signal generating means, said mixing controlling means and said waveform outputting means process a plurality of sound generating channels on a time-division basis and polyphonically output a plurality of musical sound waveforms assigned to corresponding sound generating channels.

4. A musical sound waveform generator for generating a musical sound waveform according to a mixed signal obtained by mixing a modulation signal with a carrier signal corresponding to a period of musical sound waveform to be generated, comprising:

carrier signal generating means for generating a carrier signal;

modulation signal generating means for generating a modulation signal;

mixing controlling means for controlling, in mixing said modulation signal with said carrier signal, a mixing ratio of said modulation signal to said carrier signal, and for outputting a mixed signal in which said modulation signal and said carrier signal are mixed in the controlled mixing ratio; and waveform outputting means coupled to said mixing controlling means and having a predetermined functional relation between an input and an output thereof, for outputting a musical sound waveform according to said mixed signal outputted by said mixing controlling means as an input signal; and wherein said carrier signal generating means includes means for generating the carrier signal determined on the basis of at least a predetermined first desired musical sound waveform and said predetermined functional relation;

said modulation signal generating means includes means for generating the modulation signal determined on the basis of at least a predetermined desired second musical sound waveform, said predetermined functional relation, said carrier signal and a second predetermined mixing ratio; and said waveform outputting means includes means for outputting said predetermined first desired musical sound waveform by setting the mixing ratio of said modulation signal to said carrier signal as a first predetermined mixing ratio, and for outputting said predetermined second desired musical sound waveform by setting the mixing ratio of said modulation signal to said carrier signal as said second predetermined mixing ratio.

5. The musical sound waveform generator according to claim 4, wherein said predetermined first desired musical sound waveform is a predetermined functional waveform.

6. The musical sound waveform generator according to claim 4, wherein to said predetermined first desired musical sound waveform is a sine wave or a cosine wave.

7. The musical sound waveform generator according to claim 4, wherein said carrier signal and said modulation signal are, when the mixing ratio of said modulation signal is controlled to said second predetermined mixing ratio so that said second desired musical sound waveform is repeatedly outputted from said waveform outputting means at a predetermined period, signals which are repeatedly generated from said carrier signal generating means and said modulation signal generating means at said predetermined period.

8. The musical sound waveform generator according to claim 4, wherein said carrier signal generating means and said modulation signal generating means generate a carrier signal and a modulation signal for each of a plurality of fixed waveform periods, each of which allows said second desired musical sound waveform for corresponding waveform period to be outputted from said waveform outputting means when the mixing ratio of said modulation signal is controlled to said second predetermined mixing ratio by said mixing controlling means.

9. The musical sound waveform generator according to claim 4, further comprising an amplitude envelope controlling means for varying the amplitude envelope characteristic of said musical sound waveform outputted from said waveform outputting means with time.

10. The musical sound waveform generator according to claim 4, wherein said carrier signal generating means, said modulation signal generating means, said mixing controlling means and said waveform outputting means process a plurality of sound generating channels on a time-division basis and polyphonically output a plurality of musical sound waveforms assigned to corresponding sound generating channels.

11. A musical sound waveform generator for generating a musical sound waveform according to a mixed signal obtained by mixing a modulation signal with a carrier signal corresponding to a period of musical sound waveform to be generated, comprising:

carrier signal generating means for generating a carrier signal;

modulation signal generating means for generating a modulation signal;

mixing controlling means for controlling, in mixing said modulation signal with said carrier signal, a mixing ratio of said modulation signal to said carrier signal, and for outputting a mixed signal in which said modulation signal and said carrier signal are mixed in the controlled mixing ratio; and waveform outputting means coupled to said mixing controlling means and having a predetermined functional relation between an input and an output thereof, for outputting a musical sound waveform according to said mixed signal outputted by said mixing controlling means as an input signal, said predetermined functional relation being related to said carrier signal, and wherein said waveform outputting means includes means for generating a predetermined first desired musical sound waveform as said musical sound waveform when the mixing ratio of said modulation signal is controlled to a first predetermined mixing ratio by said mixing controlling means, and said carrier signal generating means and said modulation signal generating means generating a carrier signal and a modulation signal for each of a plurality of waveform periods each of an arbitrary period which allow a predetermined second desired musical sound waveform for corresponding waveform period to be outputted from said waveform outputting means when the mixing ratio of said modulation signal is controlled to a second predetermined mixing ratio by said mixing controlling means.

12. The musical sound waveform generator according to claim 11, wherein said first desired musical sound waveform is a predetermined functional waveform.

13. The musical sound waveform generator according to claim 11, wherein said first desired musical sound waveform is a sine wave or a cosine wave.

14. The musical sound waveform generator according to claim 11, further comprising an amplitude envelope controlling means for varying the amplitude envelope characteristic of said musical sound waveform outputted from said waveform outputting means with time.

15. A musical sound waveform generator for generating a musical sound waveform according to a mixed signal obtained by mixing a modulation signal with a carrier signal corresponding to a period of musical sound waveform to be generated, and controlling the characteristic of said musical sound waveform on the basis of performance information produced according to a performance operation, comprising:

carrier signal generating means for generating a carrier signal;

modulation signal generating means for generating a modulation signal;

mixing controlling means for controlling, in mixing said modulation signal with said carrier signal, the mixing characteristic of said modulation signal to said carrier signal according to the performance information and outputting a mixed signal in which said modulation signal and said carrier signal are mixed in a mixing ratio based on the mixing characteristic; and waveform outputting means coupled to said mixing controlling means and having a predetermined functional relation between an input and an output thereof, for outputting a musical sound waveform according to said mixed signal outputted by said mixing controlling means as an input signal, said predetermined functional relation being related to said carrier signal, and wherein said waveform outputting means includes means for generating a predetermined first desired musical sound waveform as said musical sound waveform when the mixing ratio of said modulation signal is controlled to a first predetermined mixing ratio by said mixing controlling means, and said modulation signal generating means including means for generating the modulation signal determined on the basis of said predetermined functional relation and said carrier signal; and said waveform outputting means includes means for outputting a predetermined second desired musical sound waveform by setting the mixing ratio of said modulation signal to said carrier signal as a second predetermined mixing ratio.

16. The musical sound waveform generator according to claim 15, said wherein carrier signal generating means and said modulation signal generating means generate a carrier signal and a modulation signal for each of a plurality of waveform periods each of an arbitrary period which allow said second desired musical sound waveform for corresponding waveform period to be outputted from said waveform outputting means when the mixing ratio of said modulation signal is controlled to said second predetermined mixing ratio by said mixing controlling means.

17. The musical sound waveform generator according to claim 15, wherein said performance information generated according to the performance operation contains tone pitch information indicating the tone pitch of a musical sound waveform to be generated, and wherein said mixing controlling means controls the mixing characteristic of said modulation signal to said carrier signal in accordance with said tone pitch information.

18. The musical sound waveform generator according to claim 15, wherein said performance information generated according to the performance operation contains tone range information indicating the tone range of in which the tone pitch of a musical sound waveform to be generated is contained, and wherein said mixing controlling means controls the mixing characteristic of said modulation signal to said carrier signal in accordance with said tone range information.

19. The musical, sound waveform generator according to claim 15, wherein said performance operation is a key depressing operation in a keyboard musical instrument, said performance information generated according to the performance operation contains velocity information indicating a velocity at which a key is depressed, and wherein said mixing controlling means controls the mixing characteristic of said modulation signal to said carrier signal in accordance with said velocity information.

20. The musical sound waveform generator according to claim 15, wherein said performance operation is a key depressing operation in a keyboard musical instrument, said performance information generated according to the performance operation contains after-touch information indicating a pressure at which a key is depressed, and wherein said mixing controlling means controls the mixing characteristic of said modulation signal to said carrier signal in accordance with said after-touch information.

21. The musical sound waveform generator according to claim 15, wherein said first desired musical sound waveform is a predetermined functional waveform.

22. The musical sound waveform generator according to claim 15, wherein said first desired musical sound waveform is a sine or a cosine wave.

23. The musical sound waveform generator according to claim 15, further comprising an amplitude envelope controlling means for varying the amplitude envelope characteristic of said musical sound waveform outputted from said waveform outputting means with time in accordance with said performance information.

24. A musical sound waveform generator for generating a musical sound waveform according to a mixed signal obtained by mixing a modulation signal with a carrier signal corresponding to a period of a musical sound waveform to be generated, comprising:

carrier signal generating means for generating a carrier signal;

modulation signal generating means for generating a modulation signal;

mixing controlling means for controlling, in mixing said modulation signal with said carrier signal, a mixing ratio of said modulation signal to said carrier signal, and for outputting a mixed signal in which said modulation signal and said carrier signal are mixed in the controlled mixing ratio; and waveform outputting means coupled to said mixing controlling means and having a predetermined functional relation between an input and an output thereof, for outputting a musical sound waveform according to said mixed signal outputted by said mixing controlling means as an input signal, said predetermined functional relation being related to said carrier signal, and wherein said waveform outputting means includes means for generating a predetermined first desired musical sound waveform as said musical sound waveform when the mixing ratio of said modulation signal is controlled to a first predetermined mixing ratio by said mixing controlling means, said carrier signal generating means and said modulation signal generating means having means for generating a carrier signal and a modulation signal which allow a predetermined second desired musical sound waveform to be outputted from said waveform outputting means when the mixing ratio of said modulation signal is controlled to a second predetermined mixing ratio by said mixing controlling means, and for repeatedly generating an arbitrary signal period of said carrier signal and said modulation signal so that an arbitrary waveform period of said first or second desired musical sound waveform is repeatedly outputted from said waveform outputting means, and said mixing controlling means including means for varying said mixing ratio with time during a time period when said arbitrary waveform period is repeatedly outputted.

25. The musical sound waveform generator according to claim 24, wherein said first desired musical sound waveform is a predetermined functional waveform.

26. The musical sound waveform generator according to claim 24, wherein said first desired musical sound waveform is a sine or a cosine wave.

27. The musical sound waveform generator according to claim 24 further comprising an amplitude envelope controlling means for varying the amplitude envelope characteristic of said musical sound waveform outputted from said waveform outputting means with time during a time period said arbitrary waveform period is repeatedly outputted.

28. A musical sound waveform generator for generating a musical sound waveform according to a mixed signal obtained by mixing a modulation signal with a carrier signal corresponding to a period of a musical sound waveform to be generated, comprising:

carrier signal generating means for generating a carrier signal;

modulation signal generating means for selectively generating a plurality of modulation signals;

mixing controlling means for controlling, in mixing each of said selectively generated modulation signals with said carrier signal, a mixing ratio of said modulation signal to said carrier signal, and for outputting a mixed signal in which each of said modulation signals and said carrier signal are mixed in the controlled mixing ratio; and waveform outputting means coupled to said mixing controlling means and having a predetermined functional relation between an input and an output thereof, for outputting a musical sound waveform according to said mixed signal outputted by said mixing controlling means as an input signal, said predetermined functional relation being related to said carrier signal, and wherein said waveform outputting means includes means for generating a predetermined first desired musical sound waveform as said musical sound waveform when the mixing ratio of each of said modulation signals is controlled to each of first mixing ratios for each of said modulation signals, and said carrier signal generating means and said modulation signal generating means having means for generating said carrier signal and said modulation signals which allow each of predetermined second desired musical sound waveforms corresponding to each of said modulation signals to be outputted from said waveform outputting means when the mixing ratio of each of said modulation signals is controlled to each of predetermined second mixing ratios for each of said modulation signals by said mixing controlling means.

29. The musical sound waveform generator according to claim 28 further comprising an performance information generating means for generating a performance information according to a performance operation, and said modulation signal generating means selecting a modulation signal to be generated of said plurality of modulation signals according to said performance information generated by said performance information generating means.

30. The musical sound waveform generator according to claim 28, wherein said first desired musical sound waveform is a predetermined functional waveform.

31. The musical sound waveform generator according to claim 28, wherein said first desired musical sound waveform is a sine wave or cosine wave.

32. The sound waveform generator according to claim 28, further comprising an amplitude envelope controlling means for varying the amplitude envelope characteristic of said musical sound waveform outputted from said waveform outputting means with time.

33. A musical sound waveform generator for generating a musical sound waveform according to a mixed signal obtained by mixing a modulation signal with a carrier signal corresponding to a period of a musical sound waveform to be generated, comprising:

carrier signal generating means for generating a carrier signal;

modulation signal generating means for generating a plurality of modulation signals;

composition modulation signal outputting means for mixing said plurality of modulation signals in arbitrary proportions to output a composite modulation signal;

mixing controlling means for controlling, in mixing said composite modulation signal with said carrier signal, a mixing ratio of said composite modulation signal to said carrier signal, and for outputting a mixed signal in which said composite modulation signal and said carrier signal are mixed in the controlled mixing ratio; and waveform outputting means coupled to said mixing controlling means and having a predetermined functional relation between an input and an output thereof, for outputting a musical sound waveform according to said mixed signal outputted by said mixing controlling means as an input signal, said predetermined functional relation being related to said carrier signal, and wherein said waveform outputting means includes means for generating a predetermined first desired musical sound waveform as said musical sound waveform when the mixing ratio of said composite modulation signal is controlled to a first predetermined mixing ratio by said mixing controlling means, and said carrier signal generating means and said modulation signal generating means having means for generating a carrier signal and each of modulation signals which allow each of predetermined second desired musical sound waveforms corresponding to each of said modulation signals to be outputted from said waveform outputting means when each of said modulation signals is outputted from said composition modulation signal outputting means as it is as each of said composition modulation signals and the mixing ratio of each of said composite modulation signals is controlled to each of second predetermined mixing ratios for each of said modulation signals by said mixing controlling means.

34. The musical sound waveform generator according to claim 33, further comprising an performance information generating means for generating a performance information according to a performance operation, and said composite modulation signal outputting means controlling, in mixing said plurality of modulation signals, said arbitrary proportions according to said performance information generated by said performance information generating means.

35. The musical sound waveform generator according to claim 33, wherein said first desired musical sound waveform is a predetermined functional waveform.

36. The musical sound waveform generator according to claim 33, wherein said first desired musical sound waveform is a sine waves or cosine wave.

37. The musical sound waveform generator according to claim 33, further comprising an amplitude envelope controlling means for varying the amplitude envelope characteristic of said musical sound waveform outputted from said waveform outputting means with time.

* * * * *

UNITED STATES PATENT AND TRADEMARK OFFICE

CERTIFICATE OF CORRECTION

PATENT NO. : 5,103,711

DATED : April 14, 1992

INVENTOR(S) : IWASE, Hiroshi

It is certified that error appears in the above-identified patent and that said Letters Patent is hereby corrected as shown below:

Column 48, lines 34-35 (claim 4), following "predetermined", change "desired second" to read --second desired--.

Column 48, line 52 (claim 6), change "wherein to said" to read --wherein said--.

Column 50, line 12 (claim 15), change "period of musical" to read "period of a musical--.

Column 50, line 53 (claim 16), following "claim 15", change "said wherein" to read --wherein said--.

Column 52, line 52 (claim 28), change "ratio of said" to read --ratio of each of said--.

Column 52, line 53 (claim 28), following "modulation", change "signal" to read --signals--.

Signed and Sealed this

Twenty-first Day of December, 1993

*Attest:*

Bruce Lehman

BRUCE LEHMAN

*Attesting Officer*

*Commissioner of Patents and Trademarks*